US011274508B2

(12) United States Patent
McKenzie et al.

(10) Patent No.: US 11,274,508 B2
(45) Date of Patent: Mar. 15, 2022

(54) ROBOTIC PIPE HANDLING FROM OUTSIDE A SETBACK AREA

(71) Applicant: NATIONAL OILWELL VARCO, L.P., Houston, TX (US)

(72) Inventors: Andrew Ian McKenzie, Cypress, TX (US); Dominick Mancuso, Tomball, TX (US); Justin Benjamin Kinney, Katy, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 16/836,365

(22) Filed: Mar. 31, 2020

(65) Prior Publication Data

US 2021/0301602 A1 Sep. 30, 2021

(51) Int. Cl.
*E21B 19/14* (2006.01)

(52) U.S. Cl.
CPC ..... *E21B 19/14* (2013.01)

(58) Field of Classification Search
CPC ..... B25J 9/102; B25J 9/0084; E21B 19/14; E21B 19/143
See application file for complete search history.

(56) References Cited

U.S. PATENT DOCUMENTS

| | | | |
|---|---|---|---|
| 1,818,278 | A | 8/1931 | Siler |
| 2,531,930 | A | 11/1950 | Woolslayer et al. |
| 2,615,681 | A | 10/1952 | True |
| 2,735,556 | A | 2/1956 | Stone |
| 2,885,096 | A | 5/1959 | De |
| 2,946,464 | A | 7/1960 | Guier |
| 3,225,949 | A | 12/1965 | Erickson et al. |
| 3,272,365 | A | 9/1966 | Stevens |
| 3,533,516 | A | 10/1970 | Guier |
| 3,615,027 | A | 10/1971 | Ham |
| 3,747,789 | A | 7/1973 | Shipley et al. |

(Continued)

FOREIGN PATENT DOCUMENTS

| | | | |
|---|---|---|---|
| CA | 2911388 | A1 | 11/2014 |
| CA | 2855105 | A1 | 12/2015 |

(Continued)

OTHER PUBLICATIONS

U.S. Appl. No. 16/098,160, filed Nov. 1, 2018, System and Method for Offline Standbuilding.

(Continued)

*Primary Examiner* — Gregory W Adams
(74) *Attorney, Agent, or Firm* — Schwegman Lundberg & Woessner, P.A.

(57) ABSTRACT

A pipe handling system for handling drill pipe on a drill rig may include a lifting system configured for handling a load of a pipe stand and a first pipe handling robot arranged at or near a drill floor of the drill rig and configured for manipulating a bottom end of the pipe stand between a setback area on the drill floor and well center. The system may also include a second pipe handling robot arranged at or near a racking board of the drill rig and configured for manipulating a top end of the pipe stand between the racking board and well center. The first pipe handling robot may have a base that is supported from a location outside a plan view envelope of the setback area of the drill floor.

14 Claims, 32 Drawing Sheets

(56) References Cited

U.S. PATENT DOCUMENTS 3,768,663 A 10/1973 Turner et al.
3,840,128 A * 10/1974 Swoboda, Jr. ..... B25J 9/045 414/728
3,877,583 A * 4/1975 Bokenkamp ..... E21B 19/143 414/22.54
3,921,823 A 11/1975 Bourree et al.
3,976,207 A 8/1976 Schultz
3,994,350 A 11/1976 Smith et al.
4,042,123 A * 8/1977 Sheldon ..... E21B 19/20 414/22.71
4,117,941 A 10/1978 Mccleskey, Jr. et al.
4,126,348 A * 11/1978 Palmer ..... E21B 19/14 294/194
4,274,778 A * 6/1981 Putnam ..... B25J 9/0084 175/85
4,289,442 A 9/1981 Stevens
4,348,920 A 9/1982 Boyadjieff
4,397,605 A 8/1983 Cowgill et al.
4,531,875 A 7/1985 Krueger
4,591,006 A 5/1986 Hutchison et al.
4,621,974 A 11/1986 Krueger
4,680,519 A 7/1987 Chand et al.
4,715,761 A * 12/1987 Berry ..... E21B 19/14 104/35
4,738,321 A 4/1988 Olivier
4,846,357 A * 7/1989 Sholl ..... B63B 27/16 212/307
4,899,095 A 2/1990 Kishi et al.
5,038,871 A 8/1991 Dinsdale
5,211,251 A 5/1993 Woolsiayer
5,813,286 A 9/1998 Hansen
5,921,329 A 7/1999 Armstrong
6,047,771 A 4/2000 Roeynestad
6,260,646 B1 7/2001 Fernandez et al.
6,412,576 B1 7/2002 Meiners
7,137,616 B2 11/2006 Kysely
7,249,639 B2 7/2007 Belik
7,370,707 B2 5/2008 Mcdaniel et al.
7,726,929 B1 6/2010 Orgeron
7,905,311 B2 3/2011 Brown
7,946,795 B2 5/2011 Orgeron
7,984,757 B1 7/2011 Keast et al.
8,074,484 B2 * 12/2011 Denkmeier ..... B21D 5/0281 72/420
8,191,637 B2 6/2012 Havinga
8,210,269 B2 * 7/2012 Hudson ..... E21B 19/06 166/380
8,317,448 B2 * 11/2012 Hankins ..... E21B 19/14 414/22.68
8,504,206 B2 8/2013 Fudaba et al.
8,550,761 B2 10/2013 Belik et al.
8,690,508 B1 4/2014 Orgeron
9,291,010 B1 3/2016 Barnes
10,047,908 B1 8/2018 Bohle, II et al.
10,053,934 B2 8/2018 Keogh et al.
10,384,907 B2 8/2019 Upmeier et al.
10,794,126 B2 * 10/2020 Magnuson ..... E21B 19/16
10,995,564 B2 5/2021 Miller et al.
11,035,183 B2 6/2021 Donnally et al.
2004/0057815 A1 3/2004 Woolslayer et al.
2005/0055132 A1 3/2005 Matsumoto et al.
2005/0113971 A1 5/2005 Zhang et al.
2005/0126792 A1 6/2005 Berry
2006/0081379 A1 4/2006 Fehres et al.
2006/0104747 A1 * 5/2006 Zahn ..... E21B 19/14 414/22.63
2006/0124316 A1 6/2006 Pietras
2006/0231344 A1 10/2006 Drzewiecki
2006/0249292 A1 11/2006 Guidry
2007/0062705 A1 3/2007 Schats et al.
2007/0114069 A1 5/2007 Hooper et al.
2007/0228671 A1 10/2007 Norton
2008/0136203 A1 6/2008 Krijnen et al.
2008/0202812 A1 8/2008 Childers et al.
2008/0238095 A1 10/2008 Yater et al.
2008/0296065 A1 12/2008 Standal
2009/0283324 A1 11/2009 Konduc et al.
2010/0193198 A1 8/2010 Murray et al.
2010/0303586 A1 12/2010 Hankins et al.
2011/0079434 A1 4/2011 Belik et al.
2011/0120730 A1 5/2011 Clasen et al.
2011/0226485 A1 9/2011 Seneviratne et al.
2012/0018222 A1 1/2012 Hankins et al.
2012/0259337 A1 10/2012 Del Rio et al.
2013/0075114 A1 3/2013 Dekker et al.
2013/0142607 A1 6/2013 Ditzler
2014/0054089 A1 2/2014 Sondervik
2014/0097027 A1 4/2014 Marica et al.
2014/0145408 A1 5/2014 Midas et al.
2014/0202769 A1 7/2014 Magnuson
2015/0053424 A1 2/2015 Wiens et al.
2015/0127152 A1 5/2015 Nammoto et al.
2015/0148952 A1 5/2015 Shiratsuchi
2015/0232272 A1 8/2015 Magnuson
2015/0272579 A1 10/2015 Leimbach et al.
2015/0273688 A1 10/2015 Harada et al.
2015/0275596 A1 10/2015 Hickie
2015/0283704 A1 10/2015 Watanabe
2015/0330162 A1 11/2015 Magnuson et al.
2016/0060979 A1 3/2016 Magnuson
2016/0115745 A1 4/2016 Bisel
2016/0145954 A1 5/2016 Helms et al.
2016/0160586 A1 6/2016 Keogh et al.
2016/0168929 A1 6/2016 Magnuson et al.
2016/0201408 A1 * 7/2016 Little ..... B66C 1/0262 414/22.55
2017/0172295 A1 6/2017 Tropper
2017/0232620 A1 8/2017 Kalb et al.
2017/0234088 A1 8/2017 Orr et al.
2018/0245408 A1 * 8/2018 Keogh ..... B25J 9/1065
2018/0328112 A1 * 11/2018 Berry ..... E21B 3/02
2018/0334865 A1 11/2018 Miller et al.
2019/0143532 A1 5/2019 Cutkosky et al.
2019/0145197 A1 5/2019 Callaghan
2019/0309585 A1 10/2019 Miller et al.
2020/0032597 A1 1/2020 Jorgic et al.
2020/0040673 A1 2/2020 Donnally et al.
2020/0040674 A1 2/2020 Mckenzie et al.
2021/0246738 A1 8/2021 Mckenzie et al.
2021/0293099 A1 9/2021 Carnegie et al.

FOREIGN PATENT DOCUMENTS

CN 108266139 A 7/2018
CN 110792399 A 2/2020
EP 1953334 A2 8/2008
GB 2091788 A 8/1982
GB 2532267 A 5/2016
JP 09137689 A * 5/1997 ..... E21B 19/08
NO 20151648 A1 12/2015
WO WO-8800274 A2 1/1988
WO WO-9958811 A1 11/1999
WO WO-0123701 A1 4/2001
WO WO-2004018829 A1 3/2004
WO WO-2013082172 A1 6/2013
WO WO-2014179730 A1 11/2014
WO WO-2015043740 A1 * 4/2015 ..... E21B 19/08
WO WO-2016024859 A1 2/2016
WO WO-2016197255 A1 12/2016
WO WO-2017039996 A1 3/2017
WO WO-2017087595 A1 5/2017
WO WO-2017190120 A1 11/2017
WO WO-2017193204 A1 11/2017
WO WO-2019195651 A1 10/2019
WO WO-2020028852 A1 2/2020
WO WO-2020028853 A1 2/2020
WO WO-2020028853 A9 2/2020
WO WO-2020028856 A1 2/2020
WO WO-2020028858 A1 2/2020
WO WO-2020151386 A1 7/2020
WO WO-2020172407 A1 8/2020
WO WO-2021/203122 A1 10/2021

(56) References Cited

FOREIGN PATENT DOCUMENTS

OTHER PUBLICATIONS

U.S. Appl. No. 16/375,927, filed Apr. 5, 2019, System for Handling Tubulars on a Rig.
U.S. Appl. No. 16/431,533, filed Jun. 4, 2019, Devices, Systems, and Methods for Robotic Pipe Handling.
U.S. Appl. No. 16/431,540, filed Jun. 4, 2019, Devices, Systems, and Methods for Top Drive Clearing.
U.S. Appl. No. 16/786,345, filed Feb. 10, 2020, Quick Coupling Drill Pipe Connector.
"U.S. Appl. No. 16/098,160, Advisory Action dated Jul. 22, 2020", 5 pgs.
"U.S. Appl. No. 16/098,160, Examiner Interview Summary dated Jun. 23, 2020", 3 pgs.
"U.S. Appl. No. 16/098,160, Final Office Action dated Apr. 30, 2020", 7 pgs.
"U.S. Appl. No. 16/098,160, Non Final Office Action dated Sep. 30, 2019", 8 pgs.
"U.S. Appl. No. 16/098,160, Preliminary Amendment filed Nov. 1, 2018", 5 pgs.
"U.S. Appl. No. 16/098,160, Response filed Jan. 30, 2020 to Non Final Office Action dated Sep. 30, 2019", 8 pgs.
"U.S. Appl. No. 16/098,160, Response filed Jun. 30, 2020 to Final Office Action dated Apr. 30, 2020", 8 pgs.
"U.S. Appl. No. 16/098,160, Response filed Aug. 24, 2020 to Advisory Action dated Jul. 22, 2020", 9 pgs.
"U.S. Appl. No. 16/375,927, Advisory Action dated Aug. 11, 2020", 6 pgs.
"U.S. Appl. No. 16/375,927, Examiner Interview Summary dated Apr. 24, 2020", 3 pgs.
"U.S. Appl. No. 16/375,927, Final Office Action dated Jun. 5, 2020", 10 pgs.
"U.S. Appl. No. 16/375,927, Non Final Office Action dated Feb. 28, 2020", 9 pgs.
"U.S. Appl. No. 16/375,927, Response filed May 27, 2020 to Non Final Office Action dated Feb. 28, 2020", 10 pgs.
"U.S. Appl. No. 16/375,927, Response filed Aug. 3, 2020 to Final Office Action dated Jun. 5, 2020", 11 pgs.
"U.S. Appl. No. 16/375,927, Response filed Sep. 8, 2020 to Advisory Action dated Aug. 11, 2020".
"U.S. Appl. No. 16/431,540, Non Final Office Action dated Jun. 10, 2020", 13 pgs.
"U.S. Appl. No. 16/431,540, Response filed Sep. 10, 2020 to Non Final Office Action dated Jun. 10, 2020", 24 pgs.
"Canadian Application Serial No. 3,022,888, Voluntary Amendment filed Jul. 12, 2019", 10 pgs.
"International Application Serial No. PCT/CA2017/000125, International Preliminary Report on Patentability dated Nov. 22, 2018", 6 pgs.
"International Application Serial No. PCT/CA2017/000125, International Search Report dated Aug. 14, 2017", 3 pgs.
"International Application Serial No. PCT/CA2017/000125, Written Opinion dated Aug. 14, 2017", 4 pgs.
"International Application Serial No. PCT/CN2019/124443, International Search Report dated Mar. 5, 2020", 4 pgs.
"International Application Serial No. PCT/CN2019/124443, Written Opinion dated Mar. 5, 2020", 4 pgs.
"International Application Serial No. PCT/US2019/025942, International Search Report dated Jun. 27, 2019", 4 pgs.
"International Application Serial No. PCT/US2019/025942, Response filed Feb. 5, 2020 to Witten Opinion dated Feb. 27, 2019", 14 pgs.
"International Application Serial No. PCT/US2019/025942, Response filed Apr. 23, 2020 to Written Opinion dated Apr. 23, 2020", 14 pgs.
"International Application Serial No. PCT/US2019/025942, Written Opinion dated Feb. 24, 2020", 8 pgs.
"International Application Serial No. PCT/US2019/025942, Written Opinion dated Jun. 27, 2019", 9 pgs.
"International Application Serial No. PCT/US2019/025942, Written Opinion dated Jul. 23, 2020", 5 pgs.
"International Application Serial No. PCT/US2019/044974, International Search Report dated Oct. 24, 2019", 6 pgs.
"International Application Serial No. PCT/US2019/044974, Response filed Jun. 2, 2020 to Written Opinion dated Oct. 24, 2019", 13 pgs.
"International Application Serial No. PCT/US2019/044974, Response filed Aug. 18, 2020 to Written Opinion dated Jun. 19, 2020", 4 pgs.
"International Application Serial No. PCT/US2019/044974, Written Opinion dated Jun. 19, 2020", 7 pgs.
"International Application Serial No. PCT/US2019/044974, Written Opinion dated Oct. 24, 2019", 6 pgs.
"International Application Serial No. PCT/US2019/044976, International Search Report dated Oct. 18, 2019", 5 pgs.
"International Application Serial No. PCT/US2019/044976, Response filed Jun. 3, 2020 to Written Opinion dated Oct. 18, 2019", 11 pgs.
"International Application Serial No. PCT/US2019/044976, Response filed Aug. 25, 2020 to Written Opinion dated Jun. 26, 2020", 3 pgs.
"International Application Serial No. PCT/US2019/044976, Written Opinion dated Jun. 26, 2020", 4 pgs.
"International Application Serial No. PCT/US2019/044976, Written Opinion dated Oct. 18, 2019", 8 pgs.
"International Application Serial No. PCT/US2019/044979, International Search Report dated Oct. 22, 2019", 6 pgs.
"International Application Serial No. PCT/US2019/044979, Response filed Jun. 3, 2020 to Written Opinion dated Oct. 22, 2019", 12 pgs.
"International Application Serial No. PCT/US2019/044979, Response filed Aug. 25, 2020 to Written Opinion dated Jun. 26, 2020", 3 pgs.
"International Application Serial No. PCT/US2019/044979, Written Opinion dated Jun. 26, 2020", 4 pgs.
"International Application Serial No. PCT/US2019/044979, Written Opinion dated Oct. 22, 2019", 7 pgs.
"International Application Serial No. PCT/US2019/044983, International Search Report dated Oct. 22, 2019", 5 pgs.
"International Application Serial No. PCT/US2019/044983, Written Opinion dated Oct. 22, 2019", 6 pgs.
"International Application Serial No. PCT/US2020/019039, International Search Report dated May 15, 2020", 2 pgs.
"International Application Serial No. PCT/US2020/019039, Written Opinion dated May 15, 2020", 4 pgs.
"U.S. Appl. No. 16/375,927, Corrected Notice of Allowability dated Jan. 26, 2021", 2 pgs.
"U.S. Appl. No. 16/431,540, Notice of Allowance dated Feb. 11, 2021", 5 pgs.
"U.S. Appl. No. 16/431,540, Response filed Jan. 19, 2021 to Final Office Action dated Nov. 19, 2020", 11 pgs.
"U.S. Appl. No. 16/431,540, Supplemental Notice of Allowability dated Mar. 11, 2021", 2 pgs.
"International Application Serial No. PCT/US2019/044983, International Preliminary Report on Patentability dated Feb. 18, 2021", 8 pgs.
"Moveit—Kinematic constraints: Visibility Constraint Class Reference", [online], [retrieved Apr. 21, 2021], Retrieved from the Internet: <URL: http://docs.ros.org/en/hydro/api/moveit_core/html/classkinematic_constraints_1_1VisibilityConstraint.html>, (2021), 8 pgs.
"Moveit—Moving robots into the future", [online], [archived Dec. 4, 2020], Retrieved from the Internet: <URL: https://web.archive.org/web/20201204224545/https://moveit.ros.org/>, (2020), 7 pgs.
"U.S. Appl. No. 16/098,160, Non Final Office Action dated Oct. 6, 2020", 8 pgs.
"U.S. Appl. No. 16/098,160, Response filed Jan. 6, 2021 to Non Final Office Action dated Oct. 6, 2020", 7 pgs.
"U.S. Appl. No. 16/375,927, Examiner Interview Summary dated Dec. 7, 2020", 7 pgs.
"U.S. Appl. No. 16/375,927, Non Final Office Action dated Sep. 24, 2020", 10 pgs.
"U.S. Appl. No. 16/375,927, Notice of Allowance dated Jan. 1, 2021", 8 pgs.
"U.S. Appl. No. 16/375,927, Response filed Dec. 16, 2020 to Non Final Office Action dated Sep. 24, 2020", 8 pgs.
"U.S. Appl. No. 16/431,540, Examiner Interview Summary dated Jan. 19, 2021", 3 pgs.
"U.S. Appl. No. 16/431,540, Final Office Action dated Nov. 19, 2020", 10 pgs.

(56) References Cited

OTHER PUBLICATIONS

"International Application Serial No. PCT/US2019/025942, International Preliminary Report on Patentability dated Oct. 30, 2020", 7 pgs.
"International Application Serial No. PCT/US2019/025942, Response filed Sep. 22, 2020 to Written Opinion dated Jul. 23, 2020", 4 pgs.
"International Application Serial No. PCT/US2019/044974, International Preliminary Report on Patentability dated Nov. 11, 2020", 7 pgs.
"International Application Serial No. PCT/US2019/044976, Written Opinion dated Nov. 6, 2020", 6 pgs.
"International Application Serial No. PCT/US2019/044979, International Preliminary Report on Patentability dated Nov. 18, 2020", 7 pgs.
"International Application Serial No. PCT/US2019/124443, Response filed Nov. 24, 2020 to Written Opinion dated Mar. 5, 2020", 10 pgs.
"U.S. Appl. No. 16/098,160, Advisory Action dated Aug. 10, 2021", 4 pgs.
"U.S. Appl. No. 16/098,160, Final Office Action dated May 27, 2021", 8 pgs.
"U.S. Appl. No. 16/098,160, Non-Final Office Action dated Sep. 15, 2021", 8 pgs.
"U.S. Appl. No. 16/098,160, Response filed Jul. 27, 2021 to Final Office Action dated May 27, 2021", 9 pgs.
"U.S. Appl. No. 16/098,160, Response filed Aug. 27, 2021 to Advisory Action dated Aug. 10, 2021", 8 pgs.
"U.S. Appl. No. 17/248,669, Non-Final Office Action dated Oct. 5, 2021", 8 pgs.
"International Application Serial No. PCT/CN2019/124443, International Preliminary Report on Patentability dated May 26, 2021 ", 4 pgs.
"International Application Serial No. PCT/US2020/019039, International Preliminary Report on Patentability dated Sep. 2, 2021", 6 pgs.
"International Application Serial No. PCT/US2021/070319, International Search Report dated May 31, 2021", 5 pgs.
"International Application Serial No. PCT/US2021/070319, Written Opinion dated May 31, 2021", 6 pgs.
"International Application Serial No. PCT/US2021/070488, International Search Report dated Sep. 8, 2021", 4 pgs.
"International Application Serial No. PCT/US2021/070488, Invitation to Pay Additional Fees dated Jun. 28, 2021", 2 pgs.
"International Application Serial No. PCT/US2021/0/0488, Written Opinion dated Sep. 8, 2021", 6 pgs.
"International Application Serial No. PCT/US2021/070786, Invitation to Pay Additional Fees dated Sep. 1, 2021", 2 pgs.
U.S. Appl. No. 17/310,672, filed Aug. 17, 2021, Dual Activity Top Drive.
U.S. Appl. No. 17/250,548, filed Feb. 2, 2021, End Effectors for Automated Pipe Handling.
U.S. Appl. No. 17/310,188, filed Jul. 23, 2021, Pipe Handling Arm.
U.S. Appl. No. 17/248,669, filed Feb. 2, 2021, Robot End-Effector Orientation Constraint for Pipe Tailing Path.
U.S. Appl. No. 17/305,299, filed Jul. 2, 2021, Passive Tubular Connection Guide.

* cited by examiner

ROBOTIC PIPE HANDLING FROM OUTSIDE A SETBACK AREA

CROSS-REFERENCE TO RELATED APPLICATIONS

This application is related to U.S. Provisional Application No. 62/797,042, entitled Hoist System Capable of Parking a Top Drive and Including an Elevator and a Claw independently Operated and Automated Robotic Arms for Handling Tubulars on a Drilling Rig, and filed Jan. 25, 2019 and U.S. Non-Provisional application Ser. No. 16/431,533, entitled Devices, Systems, and Methods for Robotic Pipe Handling, and filed Jun. 4, 2019, the content of each of which is hereby incorporated by reference herein in its entirety.

FIELD OF THE INVENTION

The present disclosure relates to drill pipe handling operations. In particular, the present disclosure relates to devices, systems, and methods for tripping drill pipe into and/or out of a well. More particularly, the present disclosure relates to devices, systems, and methods for tripping drill pipe using one or more robots.

BACKGROUND OF THE INVENTION

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Drilling of wells involves tripping of the drill string, during which drill pipes are lowered into (tripping in) or pulled out of (tripping out) a well. Tripping may typically occur in order to change all or a portion of the bottom hole assembly, such as to change a drill bit. Where drill pipe is tripped into a well, stands or lengths of drill pipe may be retrieved one-by-one from a storage position in a setback area of the drill rig and connected end-to-end to lengthen the drill string in the well. Where drill pipe is tripped out of a well, stands or lengths of drill pipe may be disconnected from the drill string and may be positioned in the setback area.

Tripping has conventionally been performed with human operators. In particular, while an elevator or top drive may be used to carry the load of a stand of drill pipe during trip in and trip out operations, human operators may typically maneuver the drill pipe stands around the drill floor, such as between the well center and the setback area. For example, a first human operator may be positioned on the drill floor, at or near the well, to maneuver a lower end of drill pipe stands as they are tripped into or out of the well, while a second human operator may be positioned on or above the racking board to maneuver an upper end of drill pipe stands as the stands are moved between the well and the setback area. Operators often use ropes and/or other tools to maneuver the drill pipe stands on or above the drill floor. Such work is labor-intensive and can be dangerous. Moreover, trip in and trip out operations may be limited by the speed at which the human operators can maneuver the stands between well center and the setback area.

BRIEF SUMMARY OF THE INVENTION

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments.

In one or more embodiments, a pipe handling system for handling drill pipe on a drill rig may include a lifting system configured for handling a load of a pipe stand and a first pipe handling robot arranged at or near a drill floor of the drill rig and configured for manipulating a bottom end of the pipe stand between a setback area on the drill floor and well center. The system may also include a second pipe handling robot arranged at or near a racking board of the drill rig and configured for manipulating a top end of the pipe stand between the racking board and well center. The first pipe handling robot may have a base that is supported from a location outside a plan view envelope of the setback area of the drill floor.

In one or more embodiments, a system of pipe handling robots on a drill rig may include a first pipe handling robot arranged at or near a drill floor of the drill rig and configured for manipulating a bottom end of the pipe stand between a setback area on the drill floor and well center. The system may also include a second pipe handling robot arranged at or near a racking board of the drill rig and configured for manipulating a top end of a pipe stand between the racking board and well center. The first pipe handling robot may have a base that is supported from a location outside a plan view envelope of the setback area of the drill floor.

In one or more embodiments, a method of tripping pipe may include lifting a pipe stand with a pipe lifting system and manipulating a bottom end of the pipe stand between well center and a setback area using a drill floor robot. The drill floor robot may be supported by the drill floor at a point outside the setback area.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to systems and methods for automated drill pipe handling operations. In particular, a pipe handling system of the present disclosure may include a lifting system and one or more pipe handling robots and may be configured for performing trip in, trip out, stand building, and/or other drill pipe or drill collar handling operations. Each pipe handling robot may be configured to engage with and manipulate an end of a pipe stand. The robots and the lifting system may operate together to move stands of drill pipe between a setback area of the drill floor and well center for trip in and trip out operations. In some embodiments, each robot may operate to manipulate an end of the pipe stand without the need for a derrick hand or other human operator to physically handle the pipes. In this way, systems and methods of the present disclosure may provide for safer, more precise, and more efficient pipe handling operations as compared with conventional systems and methods.

One or more embodiments described herein may include robot layouts that are particularly well adapted for retrofit of existing rigs or for new rigs having similar space constraints as existing rigs. That is, the particular robot layouts described may be well suited to accommodate space constraints on a drill floor of a drill rig while managing to also maintain the ability to load and/or unload the setback area of drill pipe stands to support tripping operations.

Figure 1:
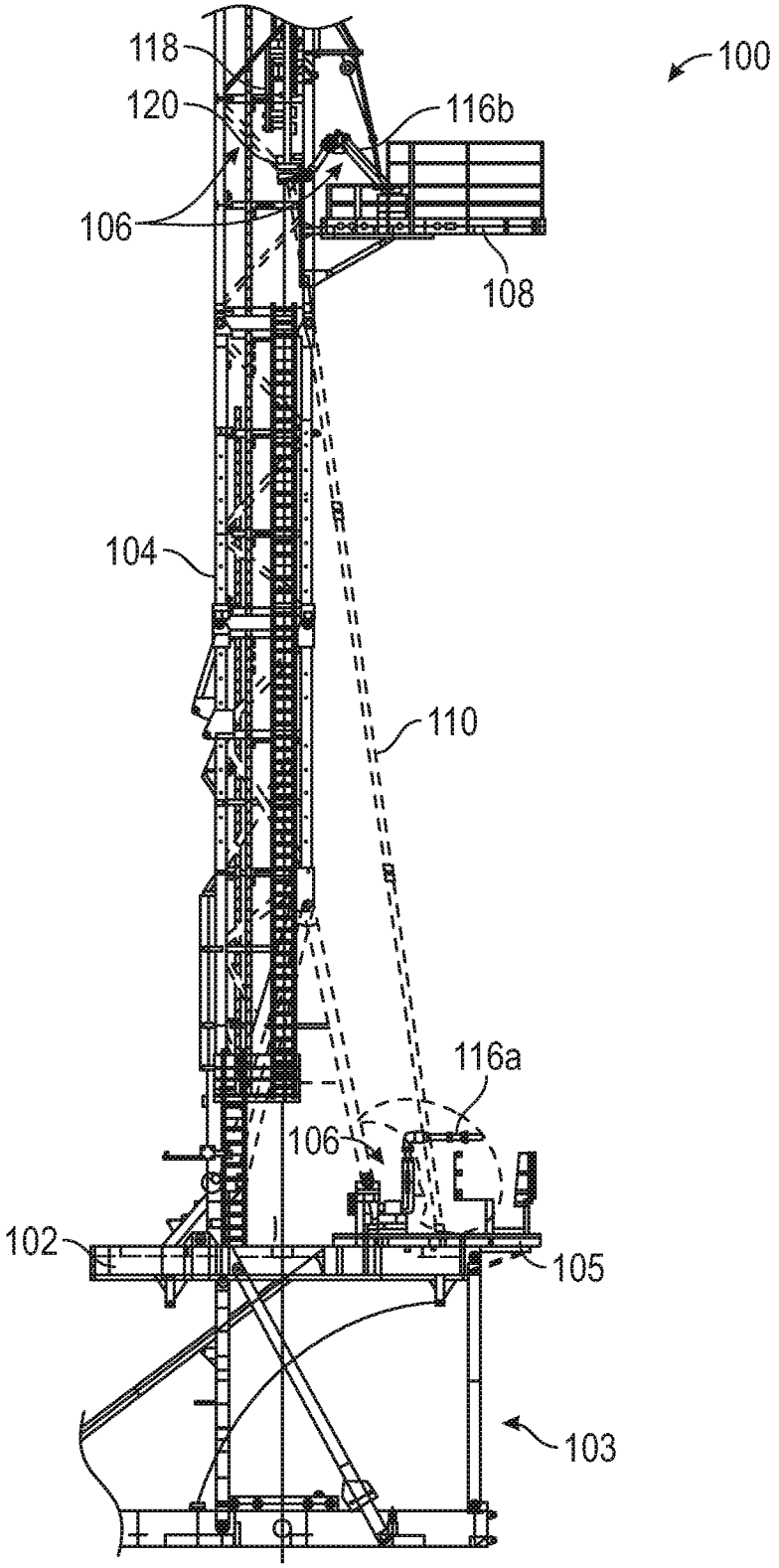
FIG. 1 is a side view of a drill rig having a drill pipe handling system of the present disclosure, according to one or more embodiments.

Turning now to FIG. 1, a drilling rig 100 of the present disclosure is shown. The drilling rig 100 may be configured for onshore oil drilling in some embodiments. However, in other embodiments, other drilling rigs of the present disclosure may be configured for other drilling operations, including offshore drilling. The drilling rig 100 may be configured to be a mobile or stationary rig. The drilling rig 100 may generally have a drill floor 102, a mast 104, and a pipe handling system.

The drill floor 102 may include a platform positioned above or over a well and supported by a substructure 103. As shown, the drill floor 102 may be configured to provide a working space for drilling operations and/or a storage space for equipment and drill pipe. The drill floor 102 may have an opening arranged at or near well center for accessing the well during drilling operations. The drill floor 102 may additionally include a setback area 105 configured for receiving and/or storing lengths of drill pipe. For example, lengths of drill pipe may be stored as single stands, or may be combined into double stands, triple stands, quadruple stands, or other sized stands 110, and positioned on end in the setback area 105.

The mast 104 may extend from the drill floor with a height suitable for accommodating and/or building single, double, triple, quadruple, or other sized drill pipe stands. For example, the mast 104 may have a height of up to 50 feet, 100 feet 150 feet, 200 feet, or more. In other embodiments, the mast 104 may have any other suitable height or height range. In some embodiments, a racking board 108 may extend from the mast 104. The racking board 108 may be configured for managing the top portion of pipe stands to maintain or store stands of pipe in a generally organized manner. In some embodiments, pipe stands 110 may be stored with a first or lower end arranged on the drill floor 102 in the setback area 105, and a second end or upper end extending in or through a racking board 108. The racking board 108 may extend laterally from the mast 104 at height of between approximately 30 feet and approximately 200 feet from a ground or pad surface, or between approximately 40 feet and approximately 150 feet, or between approximately 50 feet and approximately 100 feet. In other embodiments, the racking 108 board may extend from the mast 104 at any other suitable height.

Figure 2:
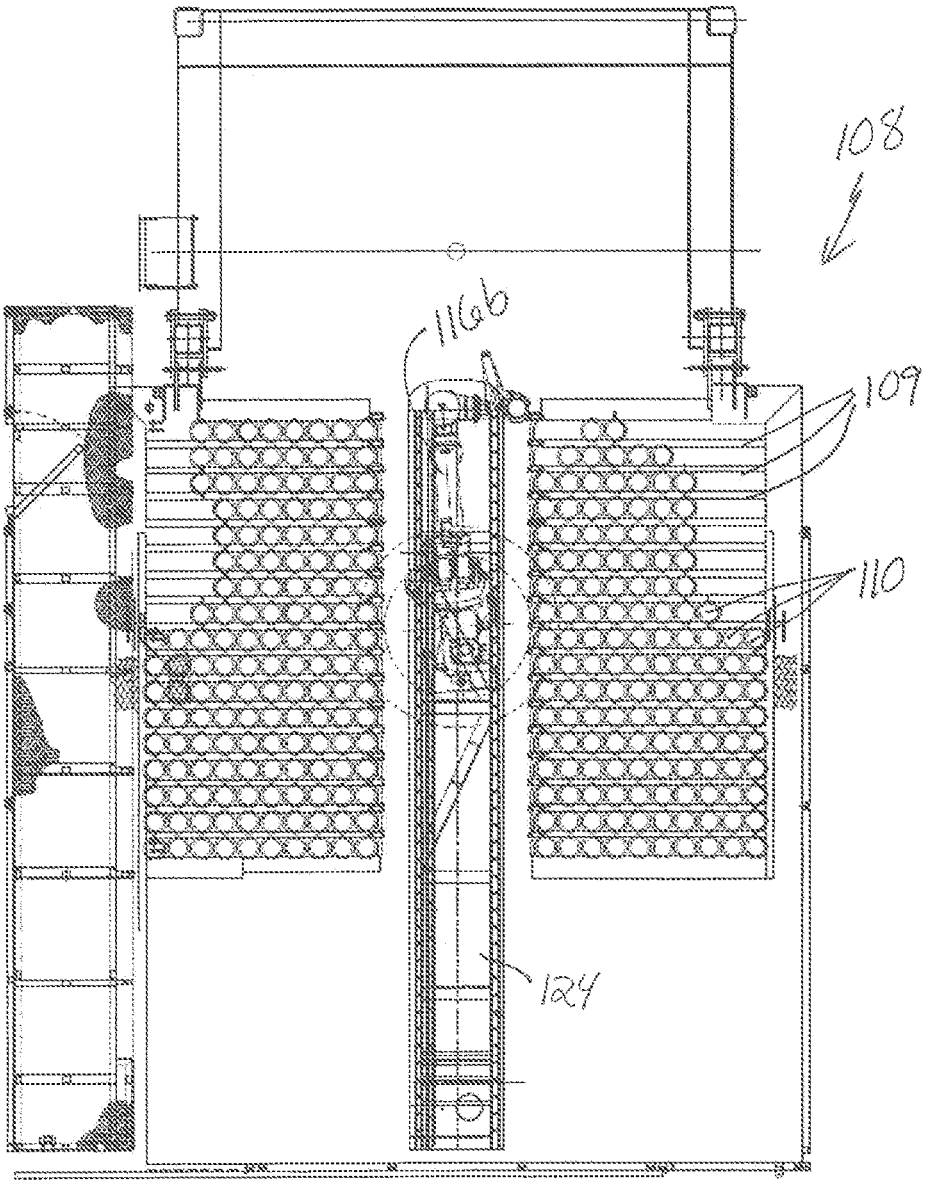
FIG. 2 is an overhead view of a racking board of the present disclosure, according to one or more embodiments.
Figure 3:
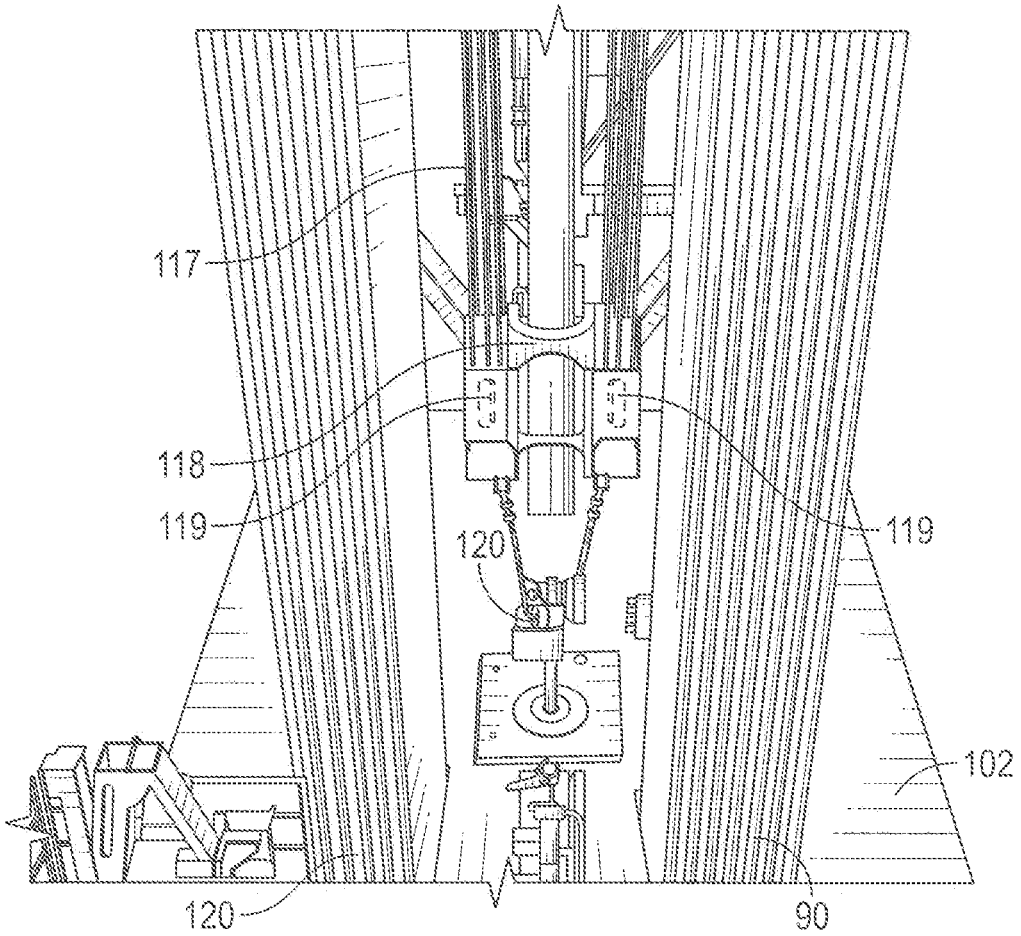
FIG. 3 is a close-up side view of a traveling block and a pipe elevator of the present disclosure, according to one or more embodiments.

FIG. 2 shows an overhead view of a racking board 108, according to some embodiments. The racking board 108 may include a plurality of fingers 109, which may be arranged in a parallel configuration, configured to receive stands 110 of pipe therebetween so as to maintain the pipe stands in an upright, on-end configuration. The fingers 109 of the racking board 108 may operate to maintain stands of pipe in organized rows or columns. In particular, the racking board 108 may be configured such that a plurality of pipe stands 110 may be arranged in a row or column between each pair of racking board fingers 109. In some embodiments, pipe stands 110 may be added to the racking hoard 108 as they are built. The racking board 108 may store the pipe stands 110 until they are added to a drill string during a trip in operation. Moreover, during a trip out operation, pipe stands 110 may be removed from the drill string and added to the racking board 108 until they are either tripped back into the well or disassembled. The racking board 108 may additionally or alternatively be configured to store pipe stands 110 during other operations as well.

As may be appreciated, the pipe stands may be placed in the setback area such that the pipe stands lean outwardly so as to be reasonably stable when released. In one or more embodiments, the pipe stands may be placed in the setback area in multiple stacks, groups, or sets of pipe stands and the sets of pipe stands may be separated by an alley (see e.g., FIG. 9). Due to the outward lean of the pipe stands, the bottom or drill floor end of the sets of pipe stands may be arranged slightly closer together than the top or racking board end of the sets of pipe stands. In one or more embodiments, as shown for example in FIGS. 9 and 10, the spacing between sets of pipe stands at or near the drill floor may be approximately 2 feet, while the spacing between the sets of pipe stands at or near the racking board may be approximately 4 feet.

With reference back to FIG. 1, the drilling rig may additionally include a pipe handling system. The pipe handling system may be configured for manipulating and moving lengths or stands of pipe, such as for trip in and trip out operations, stand building, and/or other operations. The pipe handling system may include a lifting system, a pipe coupling mechanism 114 (see FIG. 4A), and one or more robots or robotic handlers 116.

The lifting system may be configured for supporting the load of a pipe stand 110 and/or drill string during a trip in, trip out, and/or other pipe handling operation. For example, the lifting system may be configured to support a pipe stand load as robots 116 or operators maneuver the pipe stand 110 between a racking board 108 and a well center. The lifting system may include a drill line or cable extending from a draw works. The drill line may be reeved between a crown block, arranged at or ear a top of the mast 104, and a traveling block 118, arranged beneath the crown block and within the mast. In some embodiments, the drill line may be a main or primary line that may be otherwise configured for use during drilling operations using a top drive, for example. A pipe elevator 120 configured for coupling to a drill pipe may extend from the traveling block 118. In some embodiments, the pipe elevator 120 may be incorporated into a top drive, which may be coupled to the traveling block 118 via a hook dolly or the pipe elevator 120 may be more directly coupled to the traveling block 118 via a hook dolly. In either case, the traveling block 118 may be configured to raise and lower the pipe elevator 120, so as to raise and lower a length or stand of pipe 110, between the drill floor 102 and the crown block. The traveling block 118 may include one or more sheaves 119 through which the main drill line 117 may be reeved.

The pipe handling system may include one or more mechanisms for coupling and/or decoupling lengths of drill pipe. In particular and with reference to FIG. 4A, one or more iron roughnecks 114 may be arranged on the drill floor 102. For example, an iron roughneck 114 may be arranged on the drill floor 102 near well center, and may be configured to reach drill pipe stands 110 above or on the drill floor. The iron roughneck may be configured to couple stands 110 of drill pipe together to form the drill string, such as during a trip in operation, and/or may be configured to decouple stands of drill pipe from the drill string, such as during a trip out operation. The iron roughneck 114 may additionally operate to couple lengths of drill pipe together to form a pipe stand 110, and/or to decouple lengths of pipe to deconstruct a stand. The iron roughneck 114 may generally have static and torque wrenches configured to screw together pipe lengths with threaded ends. In other embodiments, the pipe handling system may include additional or alternative pipe coupling devices or mechanisms.

The robots may be configured to manipulate drill pipe lengths or stands 110, drill collar, and/or other piping. The robots 116 may each be programmable for carrying out particular sequences of operations. A handling system 106 may have one, two, three, four, or any other suitable number of robots 116. For example, a pipe handling system of the present disclosure may include a first robot 116*a* arranged on or near the drill floor 102, and a second robot or pair of robots 116*b* arranged on or near the racking board 108. In some embodiments, two robots 116 may be generally aligned with one another. For example, the racking board robot 116*b* may be centrally arranged on a racking board 108, and the drill floor robot 116*a* may be positioned in a setback area 105 of the drill floor 102 beneath and generally aligned with the racking board robot. However, as shown in several examples throughout this disclosure, robots 116 may be positioned differently.

Figure 4A:
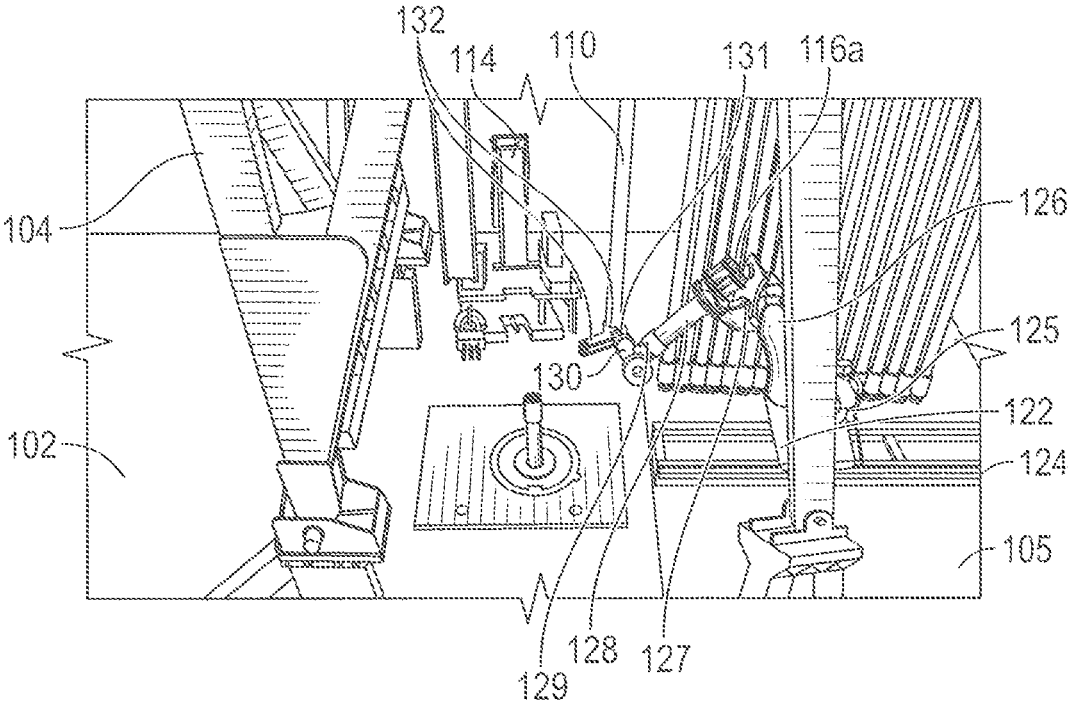
FIG. 4A is a side view of a pipe handling robot of the present disclosure arranged on a drill floor, according to one or more embodiments.
Figure 4B:
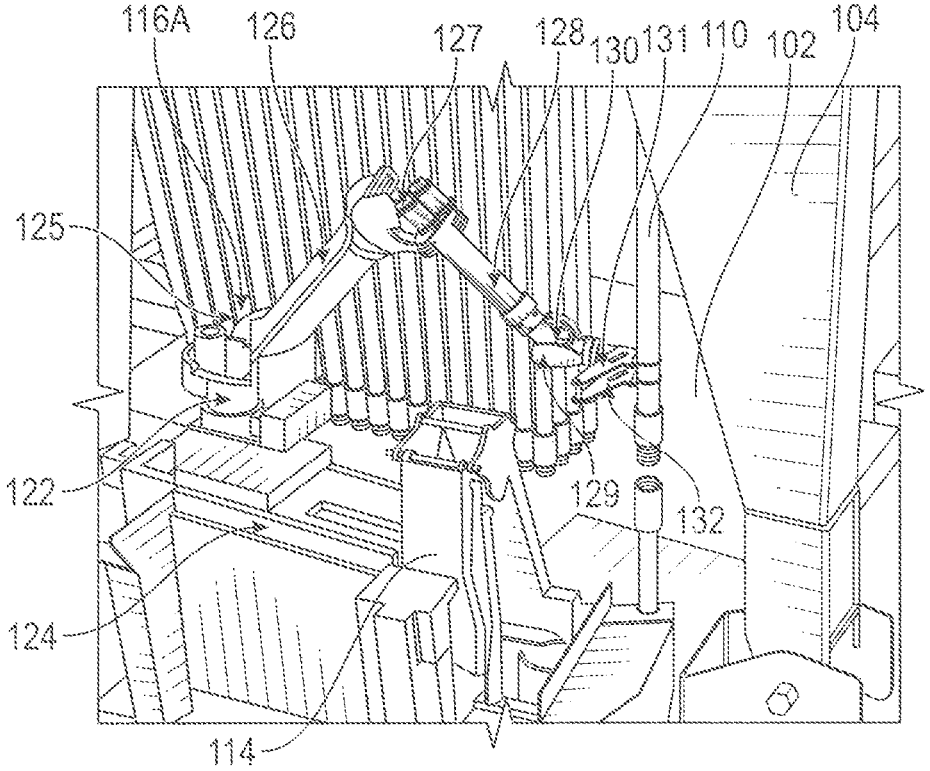
FIG. 4B is another side view of the pipe handling robot of FIG. 4A, according to one or more embodiments.
Figure 5A:
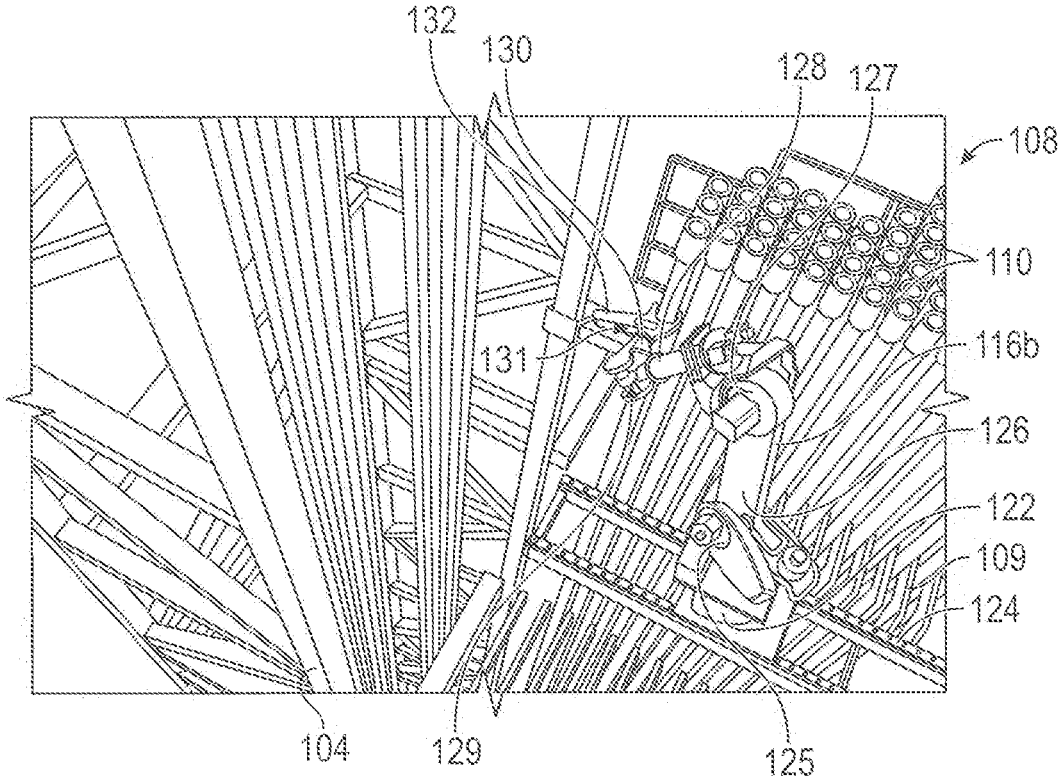
FIG. 5A is a perspective view of a pipe handling robot of the present disclosure arranged on a racking board, according to one or more embodiments.
Figure 5B:
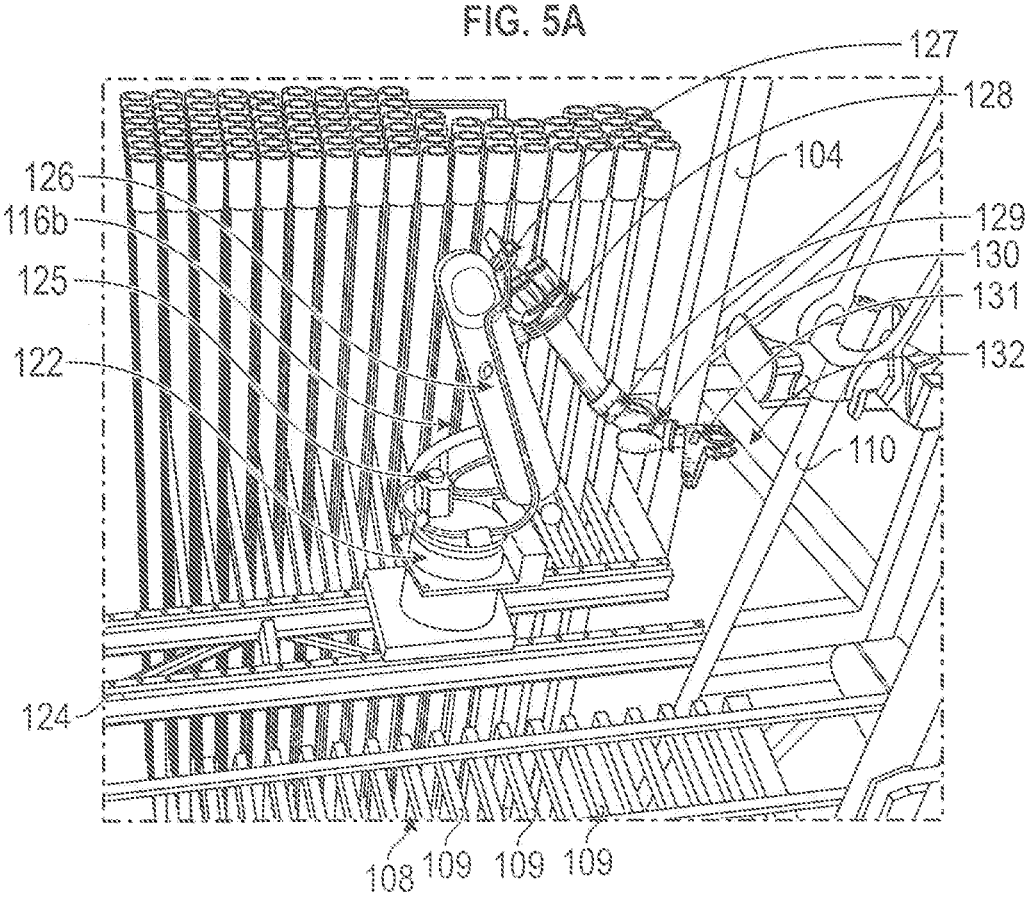
FIG. 5B is another side view of the pipe handling robot of FIG. 5A, according to one or more embodiments.

FIGS. 4A and 4B shows an embodiment of a robot 116*a* arranged on the drill floor 102, according to one or more embodiments. The drill floor robot 116*a* may be configured for handling a first end of pipe stands 110, the first end being an end positioned closest the drill floor 102 when the pipe stands are arranged within the racking board 108. In some embodiments, the first end of the pipe stand 110 may be referred to as a lower end. FIGS. 5A and 5B show an embodiment of a robot 116*b* arranged on the racking board 108, according to one or more embodiments. The racking board robot 116*b* may be configured for handling a second end of pipe stands 110, the second end being an end positioned closest the racking board 108 when the pipe stands are arranged within the racking board. In some embodiments, the second end of the pipe stand 110 may be referred to as an upper end. As shown in FIGS. 4 and 5, each of the robots 116 may include a base portion 122, which may be arranged on a track 124.

The robots 116 may additionally each include a shoulder portion 126, an articulated arm 128, a wrist portion 130, and an end effector 132. Each robot 116 may have a reach capacity of between approximately 4 feet and approximately 20 feet, or between approximately 6 feet and approximately 15 feet, or between approximately 8 feet and approximately 10 feet. In other embodiments, each robot 116 may have any other suitable reach capacity. Moreover, each robot 116 of the present disclosure may have a load capacity at full reach of between approximately 200 pounds and approximately 900 pounds, or between approximately 300 pounds and approximately 700 pounds, or between approximately 400 pounds and approximately 500 pounds. In other embodiments, each robot 116 may have any other suitable load capacity at full reach.

Figure 15:
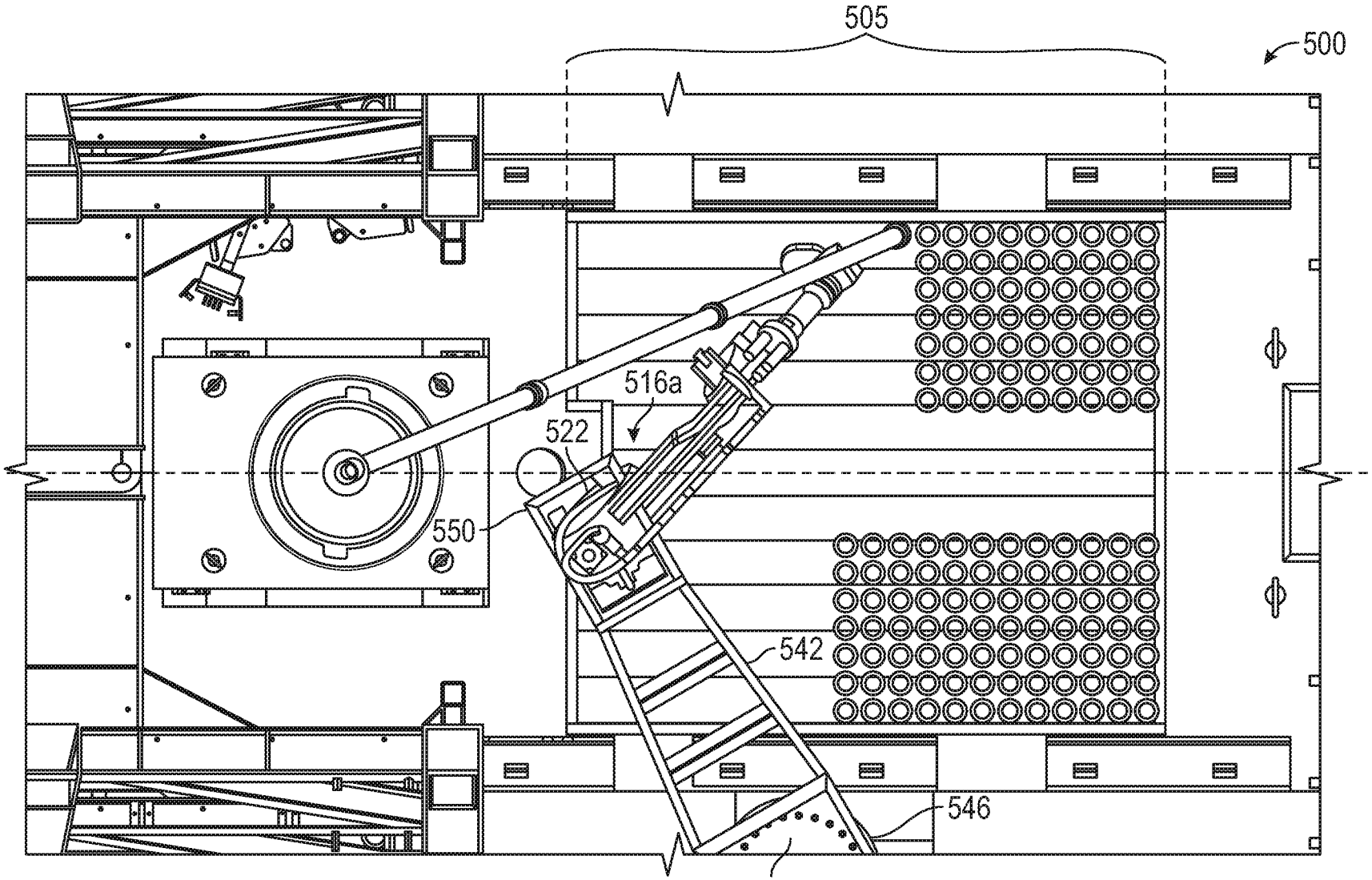
FIG. 15 is a plan view of a drill floor on a drill rig, with a pipe handling robot arranged on a boom, according to one or more embodiments.

The base portion 122 of each robot 116 may be configured to couple the robot to the drill floor 102, racking board 108, or another suitable location on the drilling rig 100. In one or more embodiments, the base may be configured to be stationary and may be secured to the drill floor. In some embodiments, the base portion 122 may additionally be configured to facilitate movement of the robot 116 on the drill floor 102, racking board 108, or other surface of the drill rig 100. For example, the base portion 122 may be configured to engage with a track 124 or rail, as shown in the embodiments of FIGS. 4*a*-5*b*, 9, 11, 13, and 16, or, for example, a boom as shown in FIG. 15. In the case of a rail or track, the base portion 122 may have skids or rollers configured for sliding engagement with the track 124. The track 124 may provide a first axis of movement. In some embodiments, the track 124 may provide a second axis of movement, such that the base portion 122 may move in both an X-direction and a Y-direction. In some embodiments, the track 124 may be positioned so as to be centrally arranged with respect to stored pipe stands 110. For example, where pipe stands 110 are stored on two sides of a racking board 108 and/or setback area 105, the track 124 may be centrally aligned between the two sides, such that the robot may readily access pipe stands stored on both sides of the racking board and/or setback area. In particular, the track 124 may be arranged between a driller's side and an off-driller's side of the setback area 105, and may provide an axis of movement extending between the well center and an edge of the drill floor. In other embodiments, such as that of FIG. 16, the track may be arranged outboard of the setback area and, for example, a track may be provided on each side of the setback area. The track 124 may have a length of between approximately 1 foot and approximately 20 feet, or between approximately 2 feet and approximately 15 feet, or between approximately 3 feet and approximately 10 feet. In at least one embodiment, the track 124 may have a length of approximately 13 feet. In some embodiments, the track 124 of either or both robots 116 may have a length equal to or slightly larger or slightly smaller than a length of the racking board 108. In some embodiments, the robots 116 may have tracks 124 of equal length and configuration, while in other embodiments an upper robot 116*b* may have a track with a different length and/or different configuration than that of a lower robot. In still other embodiments, the tracks may extend well beyond the length of the setback area and racking board such that the drill floor robots may be positioned beyond the setback area in a direction toward well center and reach back toward the setback area to retrieve pipe stands, in one or more front rows of the setback area, for example.

It is to be appreciated that in other embodiments, the base portion 122 may have other movement means for moving the robot 116 along a drill floor 102, racking board 108, or other surface. For example, the base portion 122 may have wheels or treads or may be configured with a walking mechanism. In still other embodiments, other movement means are contemplated as well. For example, as shown in FIG. 15, the base portion 122 may be mounted on a boom, for example.

Each robot 116 may have a shoulder portion 126 extending from the base portion 122. The shoulder portion may couple to the base portion via a joint 125, which may be a swivel joint in some embodiments. The swivel joint 125 may allow the shoulder portion 126 to twist or rotate about a central axis with respect to the base portion 122. In some embodiments, the shoulder portion 126 may be configured to twist up to 360 degrees, up to 270 degrees, up to 180 degrees, up to 90 degrees, up to 45 degrees, or up to a different suitable degree of rotation. In other embodiments, the shoulder portion 126 may couple to the base portion 122 with a different joint, or the shoulder may couple to the base portion without a joint. The shoulder portion 126 may extend generally upward from the base portion 122, and in some embodiments, may extend upward at an angle, such that a longitudinal axis of the shoulder portion may be offset from a longitudinal axis of the base portion by approximately 10, 15, 20, 25, 30, 35, 40, 45 degrees, or any other suitable degree of offset. The shoulder portion 126 may have a length of between approximately 12 inches and approximately 100 inches, or between approximately 18 inches and approximately 75 inches, or between approximately 24 inches and approximately 60 inches.

The articulated arm 128 may extend from the shoulder portion 126. In particular, where the shoulder portion 126 couples at a first, or proximal, end to the base portion 122, the articulated arm 128 may extend from a second, or distal, end of the shoulder portion. A joint or elbow 127, which may be a pitch joint, may be arranged between the articulated arm 128 and the shoulder portion 126. The pitch joint 127 may allow the articulated arm 128 to pivot with respect to the shoulder portion 126 about an axis extending lateral to the shoulder portion and articulated arm. In some embodiments, the pitch joint 127 may allow the articulated arm 128 to pivot within a range of up to 360 degrees, up to 270 degrees, up to 180 degrees, up to 90 degrees, up to 45 degrees, or up to any other suitable degree of rotation. In other embodiments, the articulated arm 128 may couple to the shoulder portion 126 via a different joint or without a jointed connection. The articulated arm may have a length of between approximately 20 inches and approximately 100 inches, or between approximately 28 inches and approximately 75 inches, or between approximately 35 inches and approximately 50 inches.

The wrist portion 130 may extend from the articulated arm 128. For example, where the articulated arm 128 couples at a first, or proximal, end to the shoulder portion 126, the wrist 130 may extend from a second, or distal, end of the articulated arm. A joint 129 may be arranged between the wrist portion 130 and the articulated arm 128 and may provide for pivotable or rotational movement of the wrist with respect to the articulated arm about one or more axes. The joint 129 may be or include a pitch joint allowing for pivotable movement about a first lateral axis extending lateral to the articulated arm 128 and wrist 130, a yaw joint allowing for pivotable movement about a second lateral axis perpendicular to the first lateral axis, and/or a roll joint allowing for pivotable or rotational movement about an axis extending longitudinally through the wrist portion. The wrist portion 130 may have pivotable or rotational movement about each axis within a range of up to 360 degrees, up to 270 degrees, up to 180 degrees, up to 90 degrees, up to 45 degrees, or up to any other suitable degree of rotation. In other embodiments, the wrist portion 130 may couple to the articulated arm 128 via a different joint or without a jointed connection. The wrist 130 may be configured to provide a mechanical interface or mounting point for coupling an end effector 132 to the robot 116. In some embodiments, a joint 131, such as a pitch, yaw, and/or roll joint, may allow for pivotable movement of the end effector with respect to the wrist portion.

Figure 6:
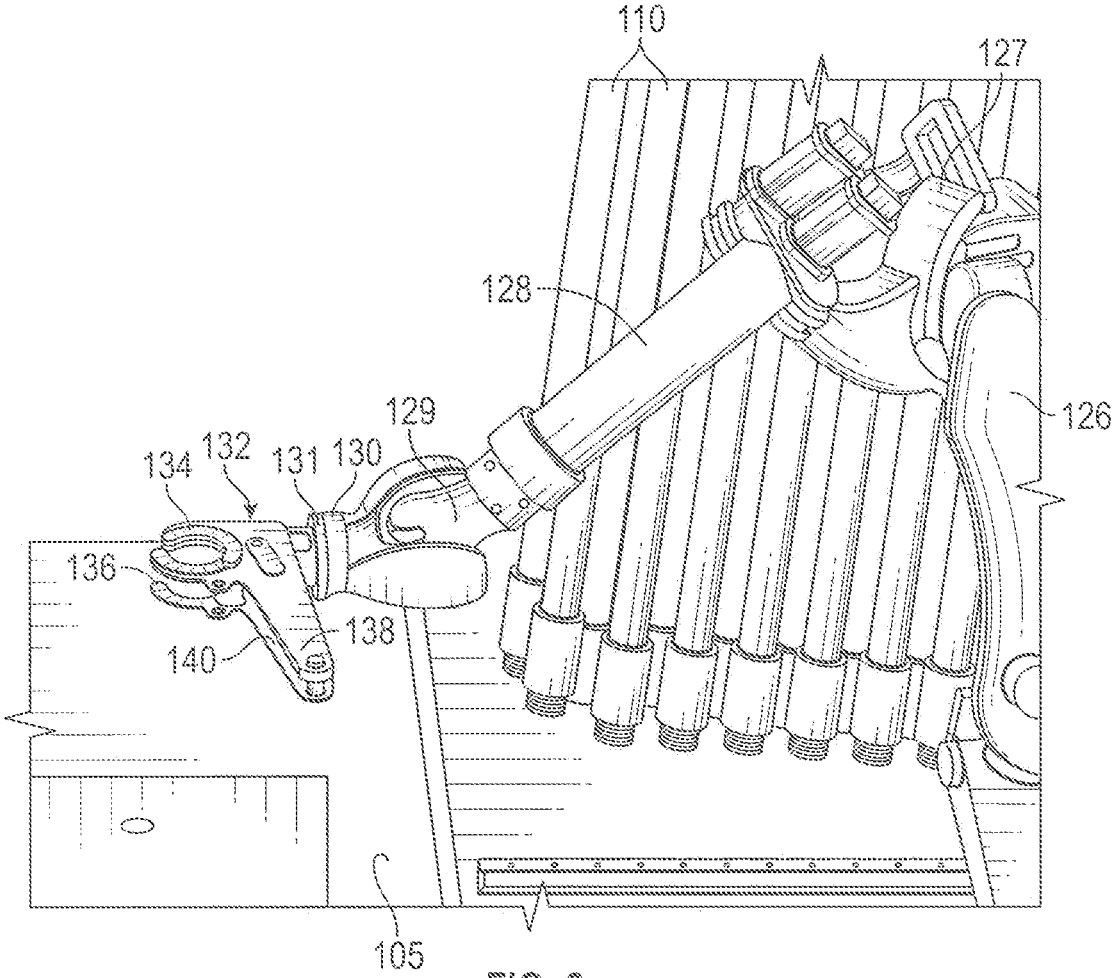
FIG. 6 is a close-up view of an end effector of a pipe handling robot of the present disclosure, according to one or more embodiments.
Figure 7A:
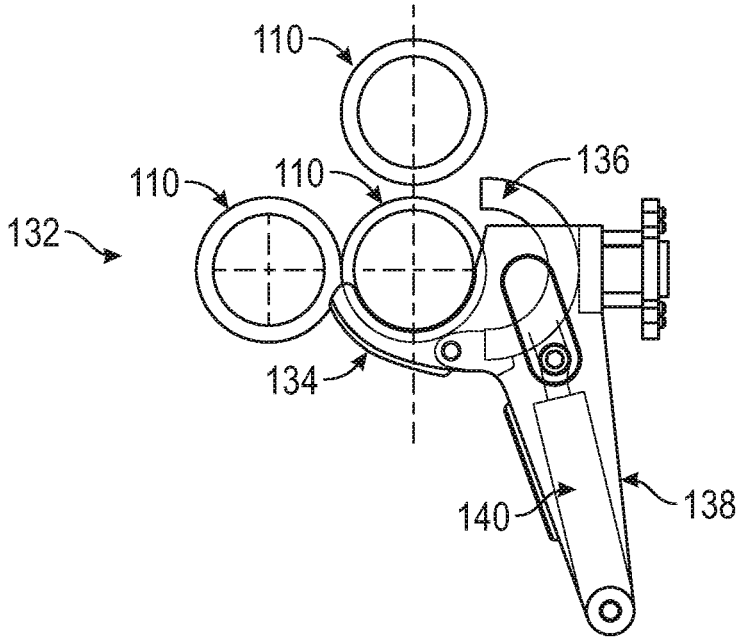
FIG. 7A is a side view of an end effector of the present disclosure approaching a pipe stand in an open position, according to one or more embodiments.
Figure 7B:
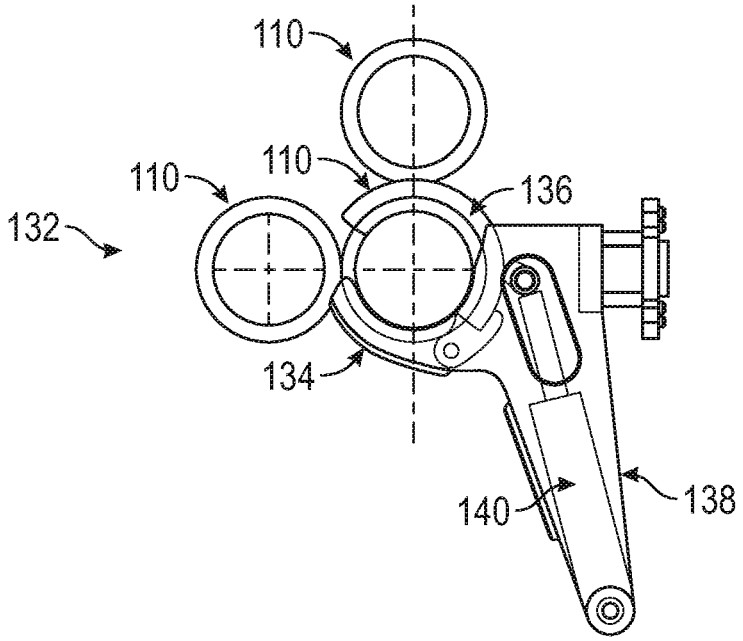
FIG. 7B is a side view of the end effector of FIG. 7A in a closed position around the pipe stand, according to one or more embodiments.

The end effector 132 may extend from the wrist portion 130 and may be configured to provide an operational or tooling hand for various operations performed by the robot 116. For example, in some embodiments, the end effector 132 may include a movable claw or gripper configured for grasping objects. FIG. 6 shows a close-up view of an end effector 132. FIGS. 7A and 7B show additional view of the end effector 132. The end effector 132 may be configured for handling lengths or stands of drill pipe, drill collar, and/or other piping. As shown in FIG. 6, the end effector 132 may have a first finger 134, which may be a fixed or stationary finger, and a second finger 136, which may be a movable finger. The movable finger 136 may have a hinged connection to the stationary finger 134. In some embodiments, the movable finger 136 may have a hinged connection to a bracket 138 of the end effector. An actuator 140, such as a hydraulic cylinder, lead screw mechanism, ball screw mechanism, or other actuator may be configured to pivot the movable finger 136 about its hinged connection.

The fingers 134, 136 may each have a curved shape with an inner contour sized and configured to receive a pipe stand. Inner contours of the two fingers 134, 136 may have a same radius of curvature for receiving a same pipe size or range of pipe sizes. The two fingers 134, 136 may be arranged such that their inner contours curve toward one another to form a closed or substantially closed loop. The movable finger 136 may be configured to pivot between an open configuration and a closed configuration. In an open configuration, as shown in FIG. 7A, the movable finger 136 may pivot away from the fixed finger 134 such that a pipe stand 110 may be received between the two fingers. In a closed configuration, the fingers 134, 136 may be configured to form a closed loop or partially closed loop, so as to close around an outer wall of a pipe stand 110.

In some embodiments, the fingers 134, 136 may be sized and shaped to receive a particular pipe diameter or a particular range of pipe diameters. In some embodiments, the end effector 132 may have a coating on one or more surfaces to facilitate handling operations. For example, the end effector 132 may have a low-friction coating arranged on an inner contour surface of the movable finger and/or fixed finger. A low-friction coating may include wearable fluoro-plastic or another relatively low-friction metallic alloy having a static coefficient of friction against pipe steel of less than 0.2, for example. Other relatively low-friction coatings or materials may be used as well. Such a low-friction coating may facilitate sliding engagement of the end effector with a pipe, for example. In this way, a pipe section may be free to rotate or pivot while engaged by the end effector. In other embodiments, the end effector 132 may have a high-friction coating or surface to facilitate gripping operations. Other coatings may be used as well.

In some embodiments, the end effector 132 may be configured to engage with one pipe stand 110 at a time without disturbing, or substantially without disturbing, adjacent or nearby pipe stands. For example, the movable finger 136 may have a thickness or width configured to slide between a pair of pipe stands 110 stored in the racking board 108 so as to close around a single pipe stand without disturbing an adjacent pipe stand. FIGS. 7A-7B illustrate the end effector 132 sleeving around a pipe stand 110. As shown in FIG. 7A, the end effector 132 may approach the pipe stand 110 with its movable finger 136 in an open configuration. With the movable finger 136 in an open configuration, the robot 116 may position the fixed finger 134 around the pipe stand 110, and may then close the movable finger around the pipe stand, as shown in FIG. 7B. The movable finger 136 may slide between the pipe stand 110 and an adjacent pipe stand. In this way, it is to be appreciated that the end effector 132 may also be configured to position a pipe stand 110 on the setback area 105 and/or within the racking board 108 without disturbing, or substantially without disturbing, other pipe stands stored nearby.

In other embodiments, one or more robots of the present disclosure may have a different end effector or tooling end. In some embodiments, the mechanical interface between the end effector and the wrist portion may allow the end effector to be readily removed by an operator. For example, the mechanical interface may include a threaded connection, clamped connection, a ball and plunger mechanism, and/or any other suitable connection or mechanism allowing for the end effector to be disconnected from the wrist portion on demand. In this way, an operator may remove and replace the end effector as needed.

In some embodiments, the end effector 132 may have one or more sensors or feedback devices. For example, a proximity sensor or other electromagnetic sensor may be arranged on or about the claw for detecting a presence of a pipe or other object positioned within the claw. Additionally or alternatively, a contact switch or other position sensor may be arranged on or about the claw for detecting an open or closed position of the movable finger 136. Each robot 116 may have other sensors and/or feedback devices, such torque feedback devices, proximity sensors, position sensors, and/or other devices or sensors configured to indicate other movements or conditions.

It is to be appreciated that each robot 116 may have a plurality of movable components and/or a plurality of movement axes with respect to each movable component. In some embodiments, each movable component and/or each axis of movement may be independently controllable and may be configured for coordinate movement with another robot or system. In some embodiments, one or more components or axes of movement may be actively controlled during a pipe handling operation. That is, a controller may be configured to actively control a position of the end effector 132, wrist portion 130, articulated arm 128, and/or other components of the robot(s). In some embodiments, one or both end robot end effectors 132 may be actively controlled during a pipe handling operation. In particular, a position and angle of the end effector 132 at joint 131 may be controlled to maintain a vector extending perpendicularly between the end effector fingers in parallel or near-parallel alignment with the pipe stand. This may help ensure that the end effector 132 can smoothly grab onto and release the pipe stand. Additionally, this may help to reduce excess torsion on the robots themselves.

In some embodiments, one or more components or axes of movement of the robot(s) may be permitted to experience free movement. For example, in some embodiments, the end effector 132 of a robot 116 may be permitted to pivot or rotate freely at joint 131 with respect to the wrist 130. In this way, movement at the end effector/wrist joint 131 may freely respond to a position of the articulated arm 128 and wrist 130, a position and angle of a pipe stand 110 engaged by the end effector 132, and/or other factors. In particular, to accommodate tilting of the pipe stand 110, the robot 116 may be configured or programmed to minimize torque applied by the stand while it is engaged by the end effector 132. This may be accomplished, for example, by relaxing (i.e., not powering) an actuator controlling position of the joint 131.

In some embodiments, the pipe handling system may have one or more controllers, each configured for controlling one or more components of the pipe handling system. For example, each of the lifting system, iron roughneck, drill floor robot, and racking board robot may have a controller controlling operations thereof. Each controller may be in wired or wireless communication with one or more associated components of the handling system. For example, a controller may be associated with at least one robot 116 and may be encoded with instructions for controlling a position of the robot on the track 124, a position of the shoulder portion 126, a position of the articulated arm 128, a position of the wrist 130, a position of the end effector 132, and/or a position of the movable finger 136 or other movable component(s) of the end effector. The controller may additionally be configured to receive feedback from one or more feedback devices or sensors. In some embodiments, the controller may be configured to respond to received feedback or sensor information by, for example, making one or more position adjustments of the robot 116.

With respect to particular methods of operation, a pipe handling system of the present disclosure, or components thereof, may be configured to operate as a coordinated system. For example, two robots, such as an upper robot and a lower robot, may operate together to manipulate a single pipe stand, with the upper robot manipulating an upper end of the pipe stand and the lower robot manipulating a lower end of the pipe stand. Movements of the two robots may be coordinated such that the two robots may operate as a team. The two robots may additionally operate in conjunction with operation of a lifting system to handle the load of the pipe stand and to raise/lower the pipe stand as needed to facilitate operations. An iron roughneck may additionally be operated in conjunction with the robots and/or lifting system to perform coordinated operations. This coordination of the various components of a pipe handling system 106 of the present disclosure may be appreciated with particular reference to FIGS. 17-61 and the following discussion.

Figure 8:
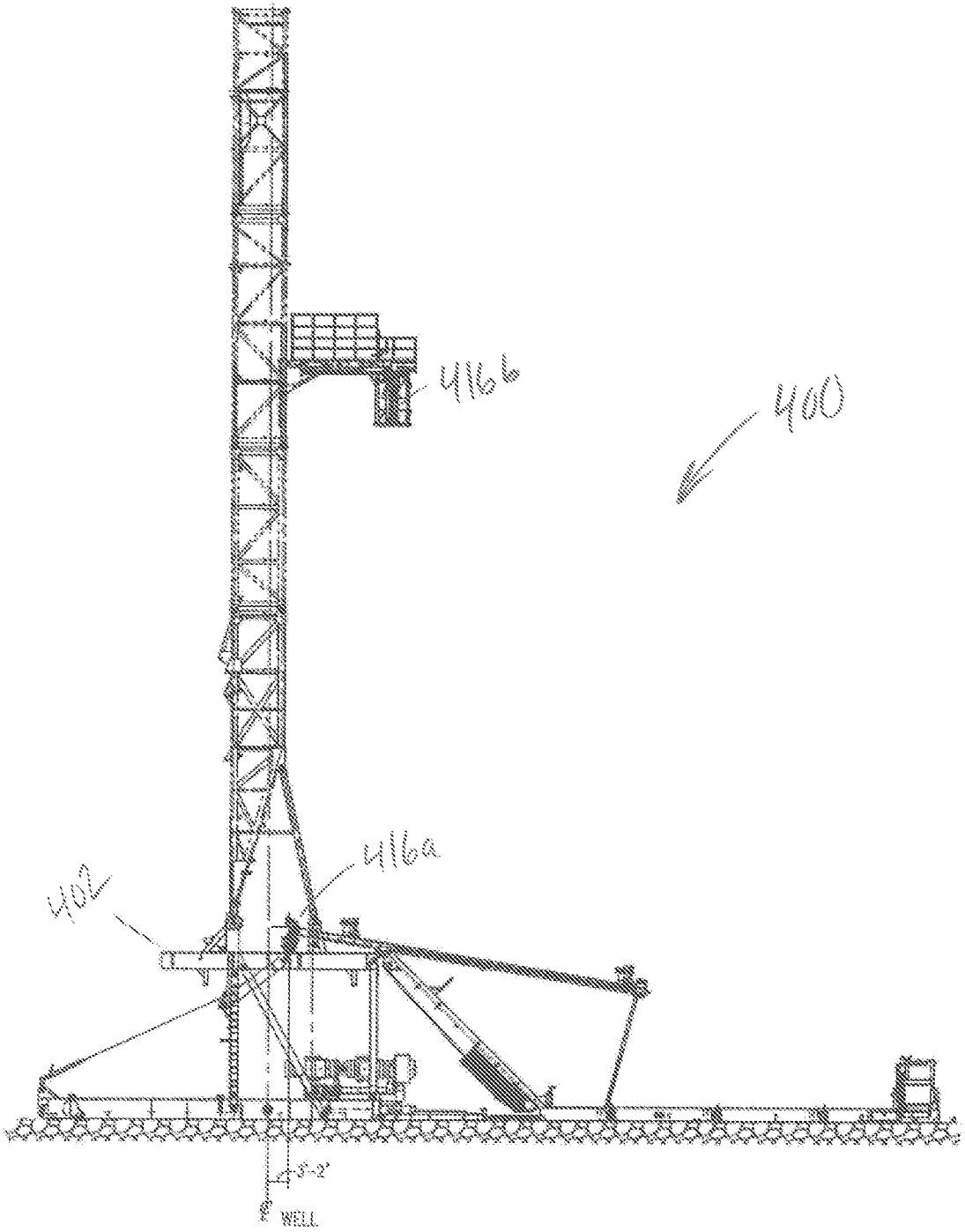
FIG. 8 is a side view of a drill rig, according to one or more embodiments.
Figure 9:
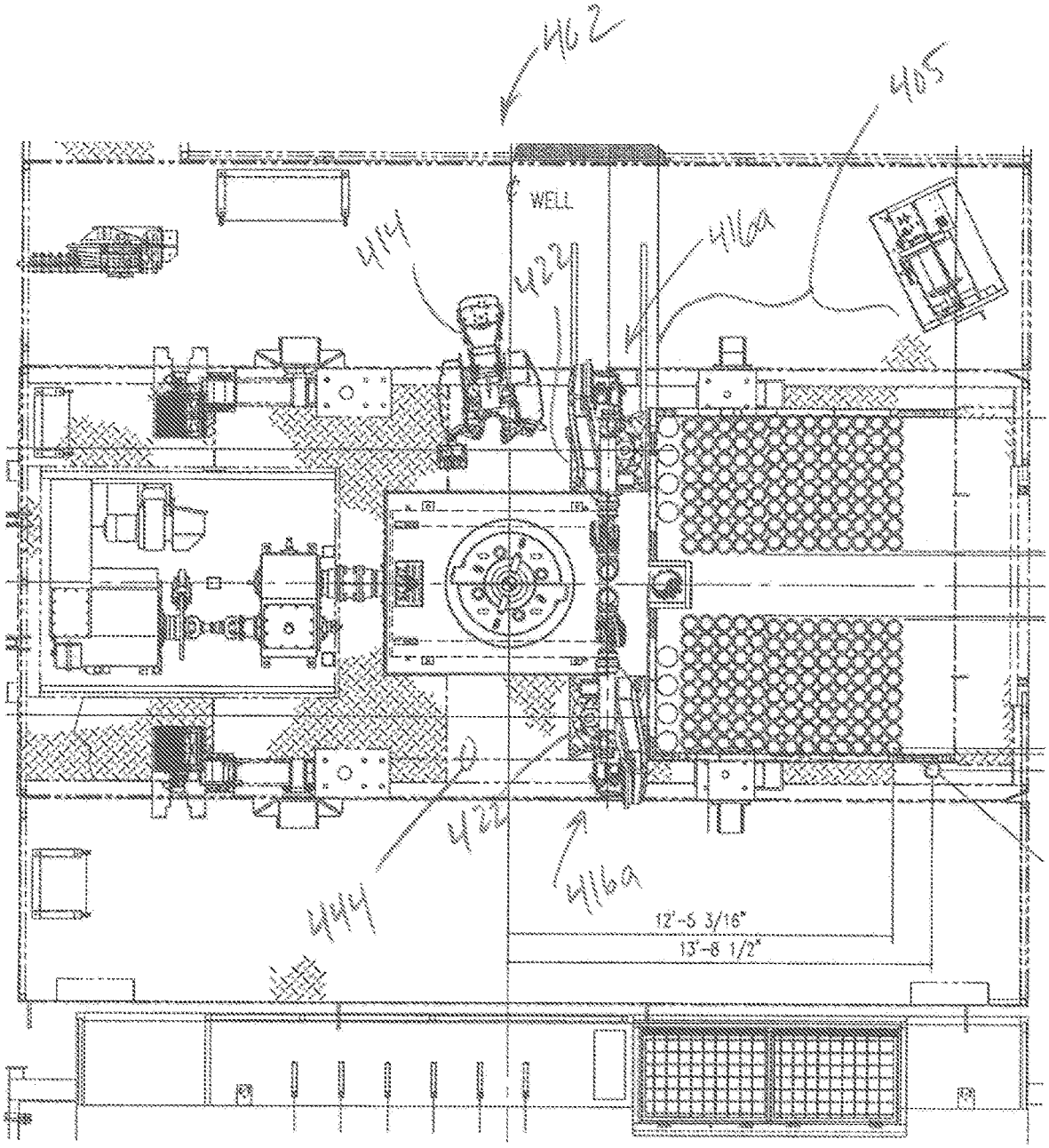
FIG. 9 is a plan view of a drill floor on a drill rig, with pipe handling robots arranged between the setback area and well center, according to one or more embodiments.
Figure 10:
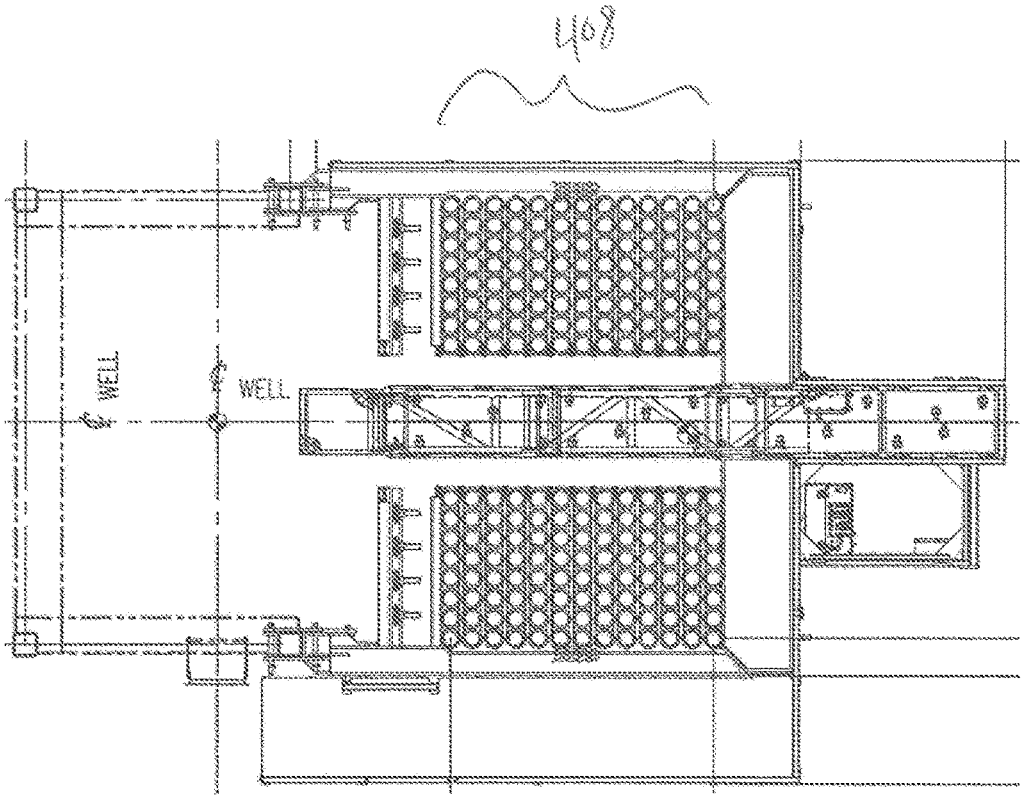
FIG. 10 is a plan view of a racking board on a drill rig, with a track for a pipe handling robot arranged between racks of pipes in the setback area, according to one or more embodiments.
Figure 11:
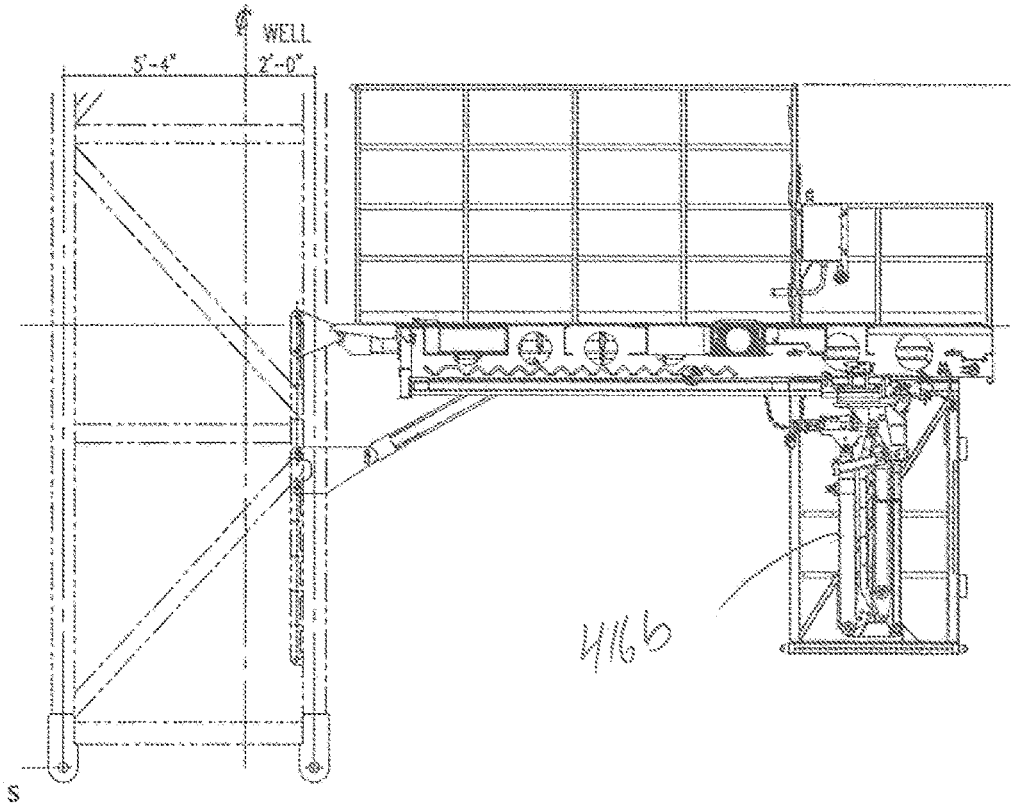
FIG. 11 is a side elevation view thereof.
Figure 12:
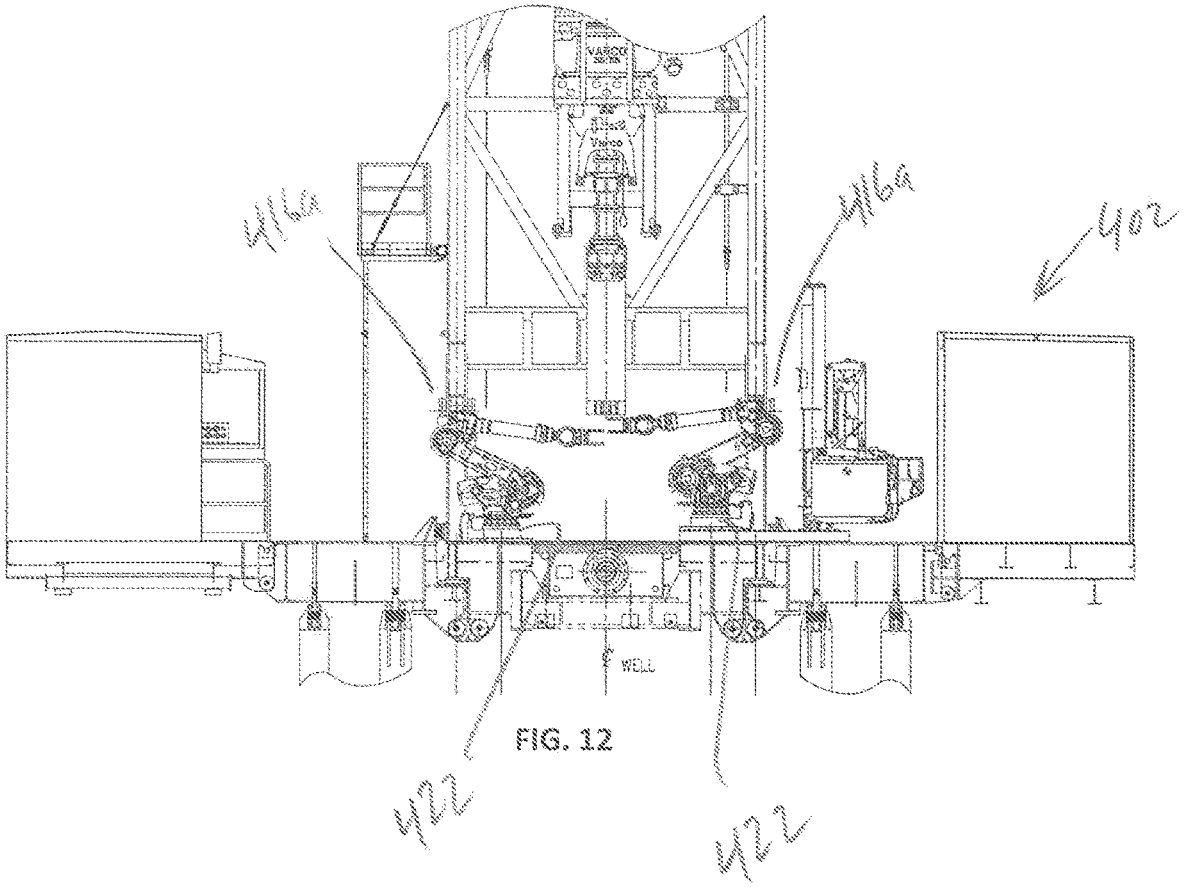
FIG. 12 is a side elevation view of the drill floor of FIG. 9.
Figure 13:
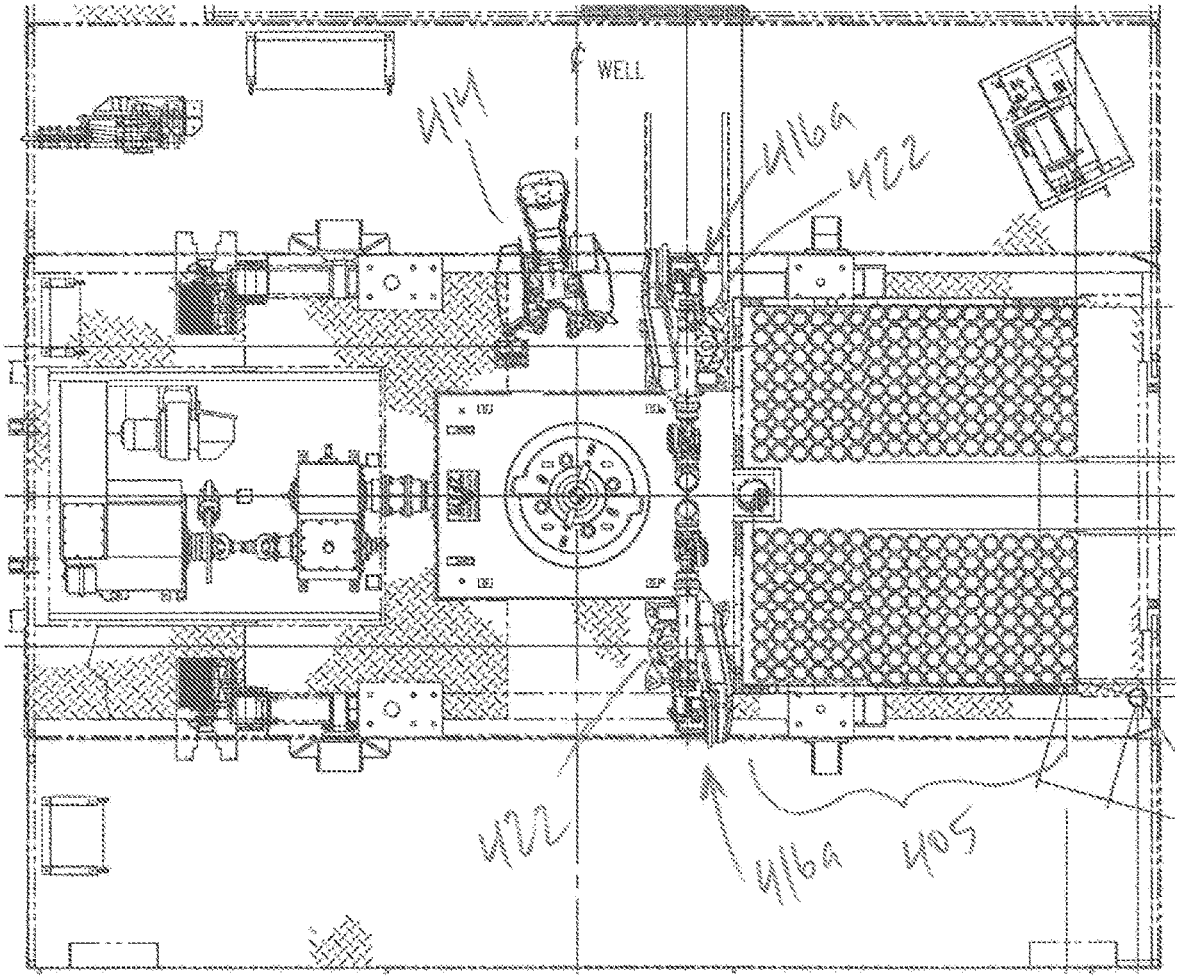
FIG. 13 is a plan view of a drill floor on a drill rig, with pipe handling robots arranged between the setback area and well center and having a larger number of pipe stands in the setback area as compared to FIG. 9, according to one or more embodiments.
Figure 14:
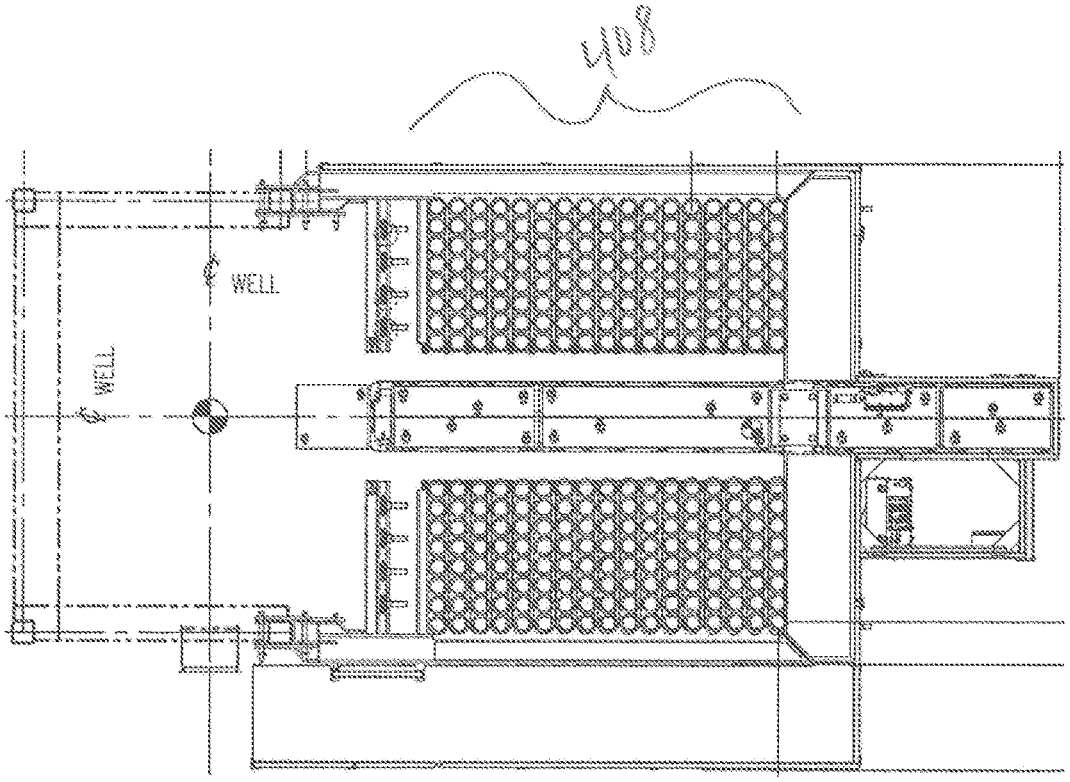
FIG. 14 is a plan view of a racking board on a drill rig, with a track for a pipe handling robot arranged between racks of pipes in the setback area and having a larger number of pipe stands in the setback area as compared to FIG. 10, according to one or more embodiments.
Figure 16:
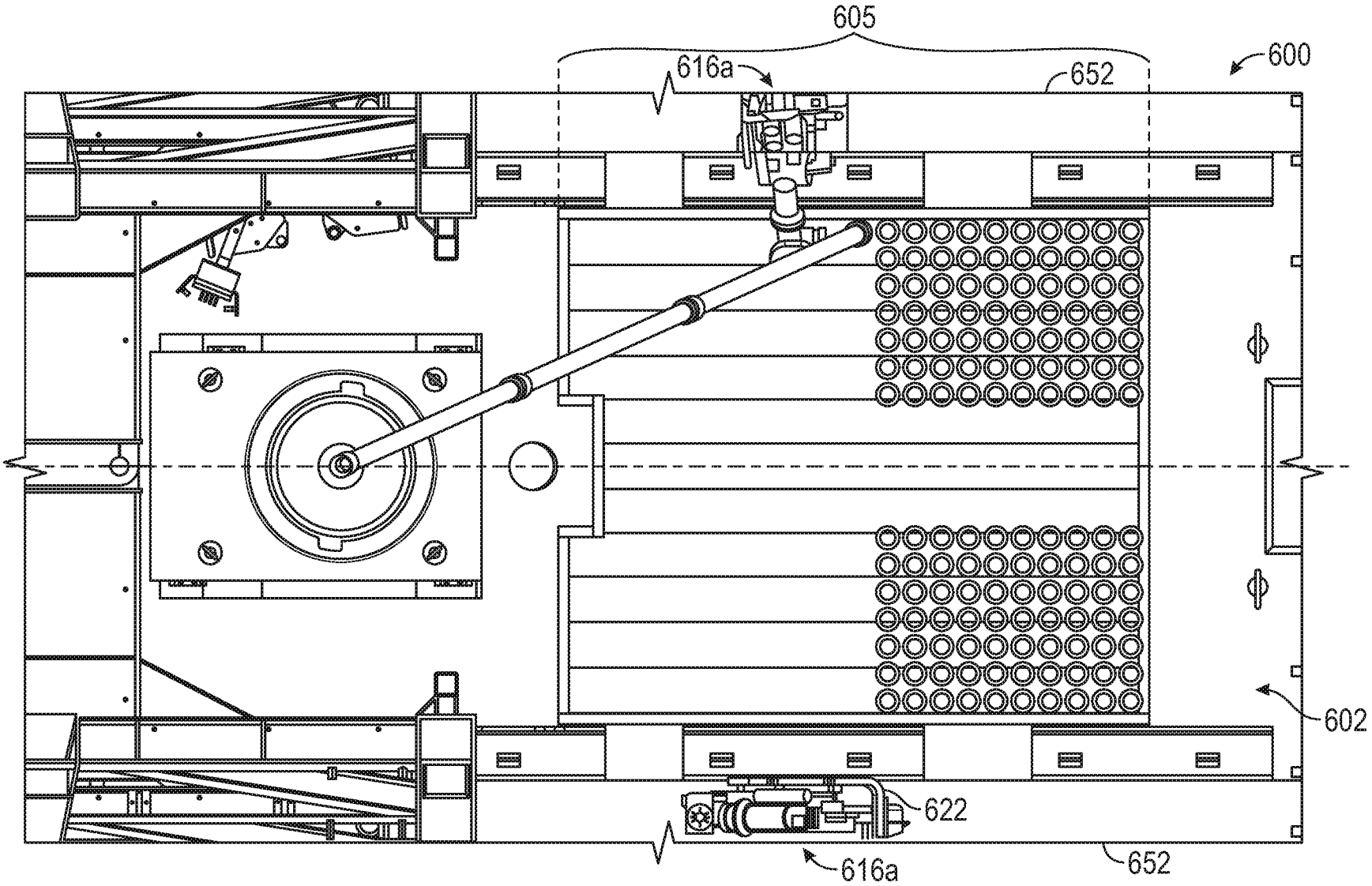
FIG. 16 is a plan view of a drill floor on a drill rig, with pipe handling robots arranged along outboard sides of drill pipe stacks in the setback area, according to one or more embodiments.
Figure 17:
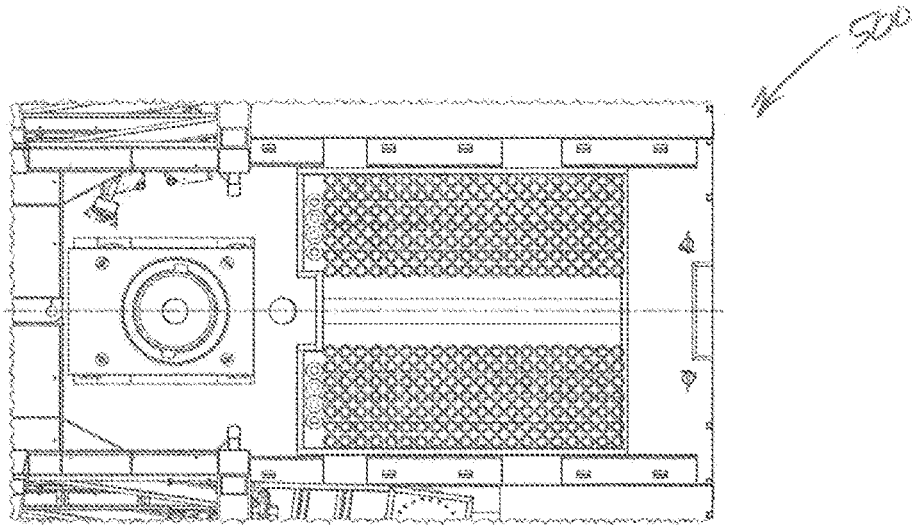
FIG. 17 is a plan view of a stage of tripping in operations using a robot arranged on a boom, according to one or more embodiments.

Several robot configurations are shown, for example, in FIGS. 8-14, 15, and 16. Uniquely, in all of these embodiments, the drill floor robots may have their bases supported from a location outside of the setback area. That is, the setback area may include a plan view area on the drill floor and the bases of the robots may be supported from a location that is outside the plan view envelope defined by the setback area. For example, FIGS. 9, 12, and 13 show drill floor robots 416*a* having one or more stationary bases 422 mounted in front of the setback area 405. FIG. 15 shows a drill floor robot 516*a* with a base 522 mounted on a boom 542 and, while the robot 516*a* may swing across the setback area 505, nonetheless, its base 522 is supported from a location outside of the setback area 505 via the boom. FIG. 16 shows robots 616*a* arranged on rails on the outboard side of the setback area 605. Depending on space constraints on the drill floor 602, arranging a robot 616*a* within the setback area 605 and between the drillers's side stack of pipe stands and the off-driller's side stack of pipe stands may be difficult or even unfeasible. Each of the embodiments shown in FIGS. 8-16 address this problem with different solutions.

As shown in FIGS. 9, 12, and 13, a pair of drill floor robots 416*a* may be provided. The pair of drill floor robots 416*a* may operate with the racking board robot 416*b* to assist with tripping operations. As shown, and given the space constraints relating to the size of the setback area 405 and its position relative to well center, each robot of the pair of robots may be arranged in a substantially stationary position relatively close to the front of a respective side of the setback area 405 and between the setback area and well center. In one or more embodiments, as shown in FIGS. 9 and 13, the base 422 of each robot 416*a* may be arranged to substantially abut a boundary line 444 extending directly from and parallel to the outboard edge of its respective side of the setback area 405. In one or more embodiments, one of the robots 416*a* may be arranged on a track to move in and out of the working area, for example. That is, the robot 416*a* arranged adjacent the iron rough neck may be arranged on a track and adapted to articulate toward and away from the working area.

As discussed in more detail below, tripping operations with this arrangement of robots 416*a* may involve the robots reaching across the aisle between the driller's side and off-driller's side of the setback area 405 and retrieving or delivering pipe stands from or to the opposing setback area. This may be particularly true for pipe stands that may be too close to the associated robot for it to reach the pipe stand. Accordingly, the robots in this embodiment may be sized and designed to reach/handle the front pipe stands in the stack of pipe stands across the aisle and reach/handle the rear most pipe stands in the adjacent stack of pipe stands. For example, the robot on the driller's side of well center may be configured to reach/handle the front pipe stands in the off-driller's side stack of pipe stands and reach/handle pipe stands in the driller's side stack of pipe stands that are further away from well center. The opposite, for example, may be true of the off-driller's side robot.

Referring now to FIG. 15, a drill floor robot 516*a* may be mounted on a boom 542. That is, as shown, a rotating boom 542 may be positioned outside of the footprint of the setback area 505. The boom 542 may be a substantially rigid and horizontally extending structure. The boom 542 may extend from a rotating turntable 546 at one end 548 to a free end 550 opposite the turntable 546. The boom 542 may be a cantilevering structure having lattice work or other framing to support a robot at its free end. As shown, a drill floor robot 516*a* may be arranged at the free end 550. As such, the boom 542 may provide for repositioning of the base 522 of the robot 516*a* and, thus, create a larger area within the reach of the robot. As shown, the base 522 of the robot 516*a* may travel along an arc defined by the distance between the turntable support 546 of the boom 542 and the position of the robot 516*a* on the boom 542. The arc may begin outside the setback area 505 and may extend into and across the setback area 505 to a position at or near the center of the setback area 505. In one or more embodiments, the arc may extend to a position that is substantially centered across the setback area 505 and in line with well center and also approximately ⅓ of the distance from the front of the setback area 505 to the back of the setback area 505 as shown, for example, in FIG. 30. In one or more embodiments, a telescoping boom structure may be provided to add further versatility to the robot position. In one or more embodiments, the range of motion of the boom may include a full 360 degrees or 180 degrees, or 90 degrees, for example. As shown in FIGS. 10-32, the range of motion of the boom 542 may be limited during tripping operations depending on how many pipe stands are present in the setback area 505 and where the pipes stands are located. In one or more embodiments, a range of motion of about 90 degrees may be sufficient to trip all of the pipe in the setback area into the well.

With reference now to FIG. 16, a pair of drill floor robots 616*a* are shown. In this embodiment, each of the robots 616*s* are arranged on a rail system 652 on a respective outboard side of the setback area 605. The rail system 652 may include one rail, a pair of rails, or another number of rails adapted to guide the location of the robot 616*a* as it moves along the setback area 605. The line of motion of the rail system 652 (e.g., the orientation of the rails) may be generally parallel to a line extending from well center and bisecting or substantially bisecting the setback area 605. Each robot 616*a* may be mounted directly on the rail or rails or a skid, trolley, car, or other moveable base may be provided for supporting the robot 616*a*. The range of motion of the base 622 of the robot 616*a* may include a substantially linear distance extending from the drill floor edge, along the setback area 605 and inward toward well center beyond the setback area. For example, the rail or range of motion may extend 1-10 feet beyond the front of the setback area 605 or approximately 2-8 feet, or approximately 3-6 feet. The distance beyond the setback area 605 may be selected based on space constraints of the drill floor 602 in addition to the size of the robot 616*a* such that the robot may turn back toward the front row of pipe stands in its adjacent stack of pipe stands and access those pipe stands.

In any of the above-mentioned arrangements of drill floor robots, a racking board robot may also be provided. With reference to FIGS. 8 and 11, a racking board robot 414*b* may be suspended from a bottom side of a racking board by a rail extending along the racking board and/or racking board walkway. The racking board robot 414*b* may be moveably secured to the rail with a trolley, for example, allowing the racking board robot to articulate back and forth toward and away from well center. The racking board robot may be an inverted version of the drill floor robot 416*a* and may include a base 422 secured to the trolley and the other articulating aspects of the robot 422 may be arranged below the base.

In use, a pipe handling system of the present disclosure may facilitate drill pipe, casing, and/or drill collar handling operations, such as trip in and trip out operations, stand building operations, and/or other pipe handling operations on a drilling rig.

For example, FIGS. 17-39 illustrate various stages of tripping operations for tripping pipe into a well using a boom mounted robot 516*a* and a racking board robot. As shown, the method may include tripping drill collar into the well. This operation may include tipping the top of a selected stand of drill collar toward the top drive or other lifting system with the racking board robot. To do so, the racking board robot may articulate toward the front of the setback area on its rail system and may turn its end effector to grasp a drill collar in the front row of the setback area on the side of the setback area closest to the boom system for the drill floor robot. That is, clearing the drill collar from the boom side of the setback area before the other side may begin to allow more range of motion for the boom and, as such, more range of motion for the drill floor robot. The stands may be unloaded from their respective rows by selecting the stands closest to the midline between the setback areas and working outward due to the slots between the fingers in the racking board opening inward toward the racking board robot.

Figure 18:
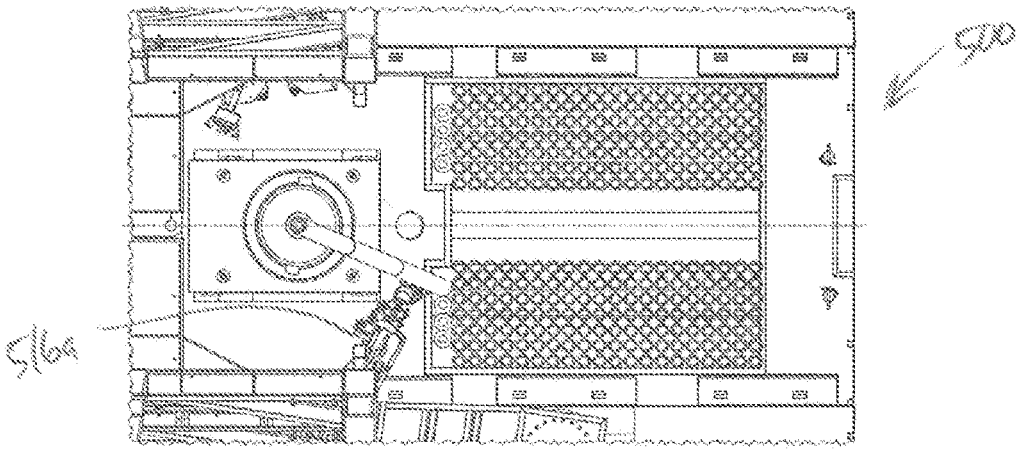
FIG. 18 is a plan view of a stage of tripping in operations using a robot arranged on a boom, according to one or more embodiments.
Figure 19:
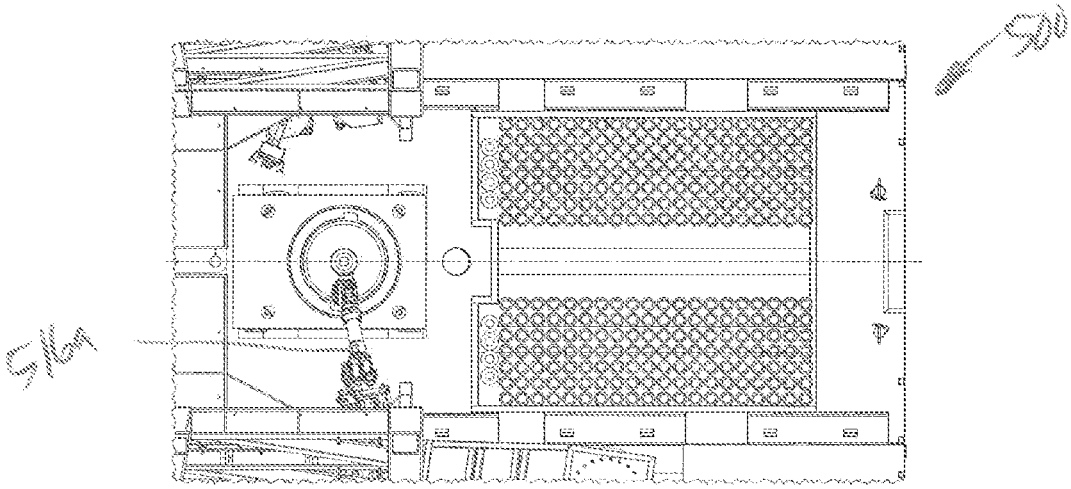
FIG. 19 is a plan view of a stage of tripping in operations using a robot arranged on a boom, according to one or more embodiments.
Figure 20:
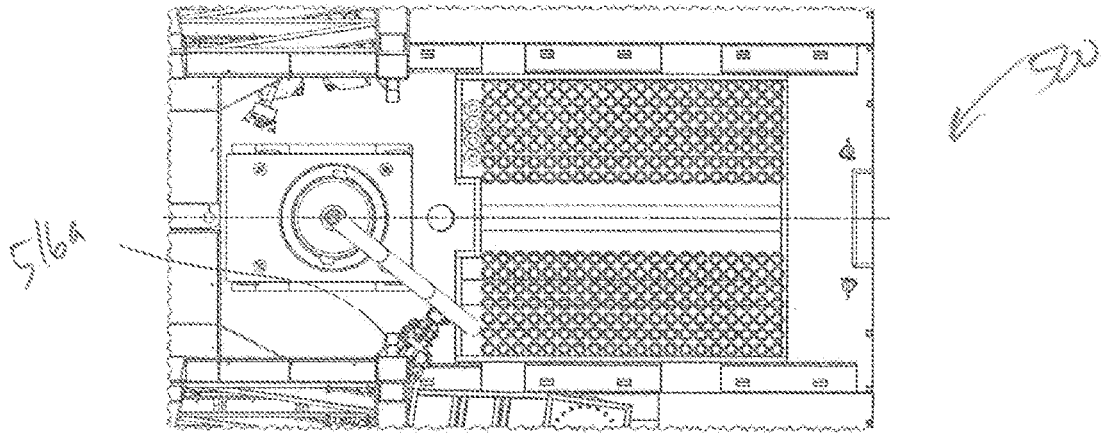
FIG. 20 is a plan view of a stage of tripping in operations using a robot arranged on a boom, according to one or more embodiments.
Figure 21:
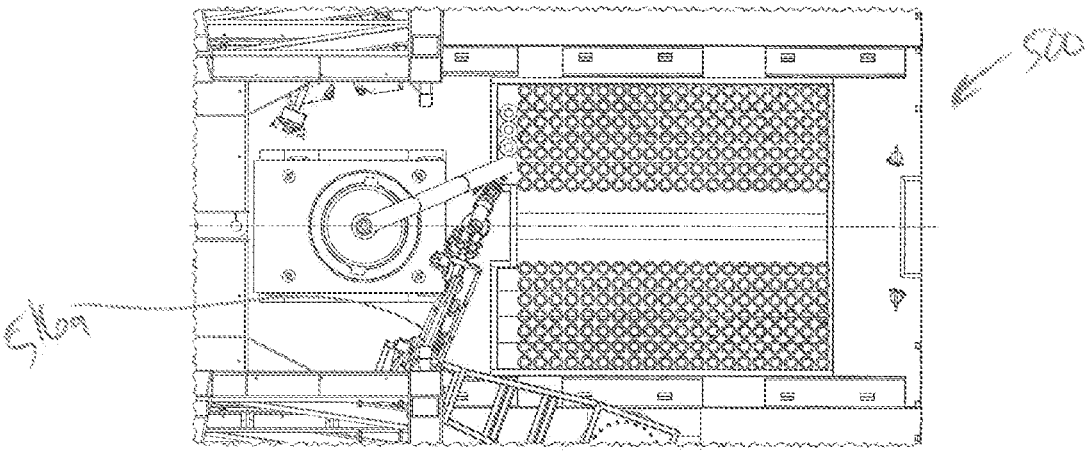
FIG. 21 is a plan view of a stage of tripping in operations using a robot arranged on a boom, according to one or more embodiments.
Figure 22:
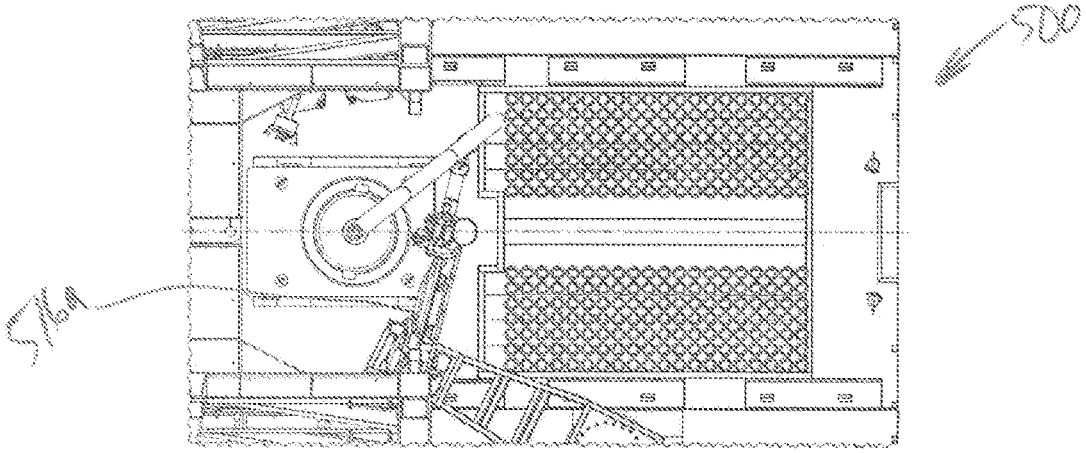
FIG. 22 is a plan view of a stage of tripping in operations using a robot arranged on a boom, according to one or more embodiments.
Figure 23:
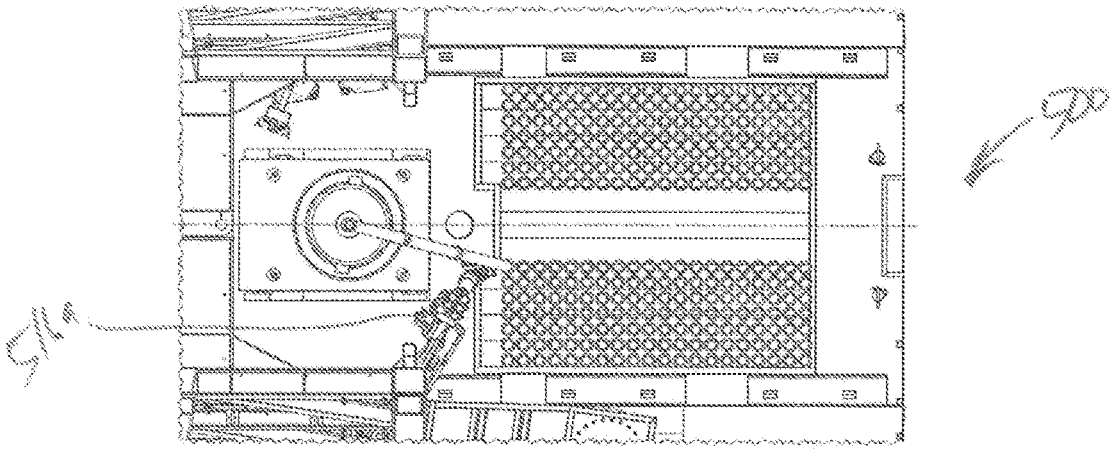
FIG. 23 is a plan view of a stage of tripping in operations using a robot arranged on a boom, according to one or more embodiments.
Figure 24:
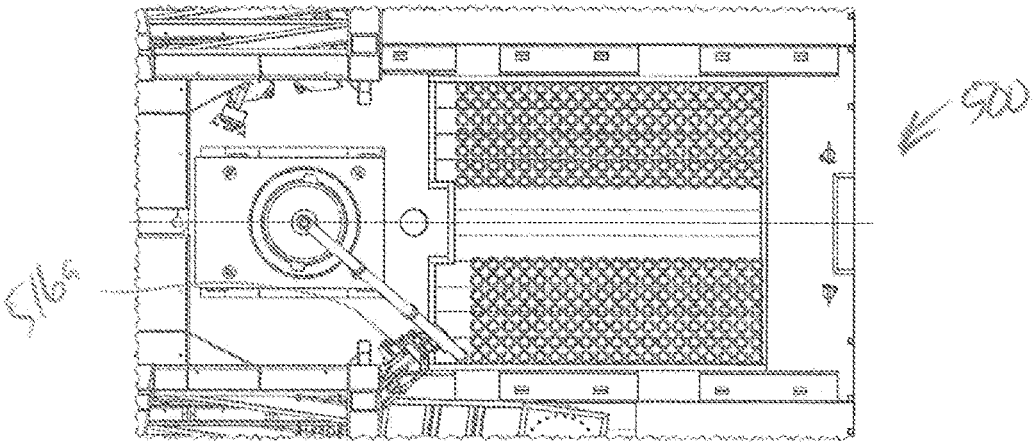
FIG. 24 is a plan view of a stage of tripping in operations using a robot arranged on a boom, according to one or more embodiments.
Figure 25:
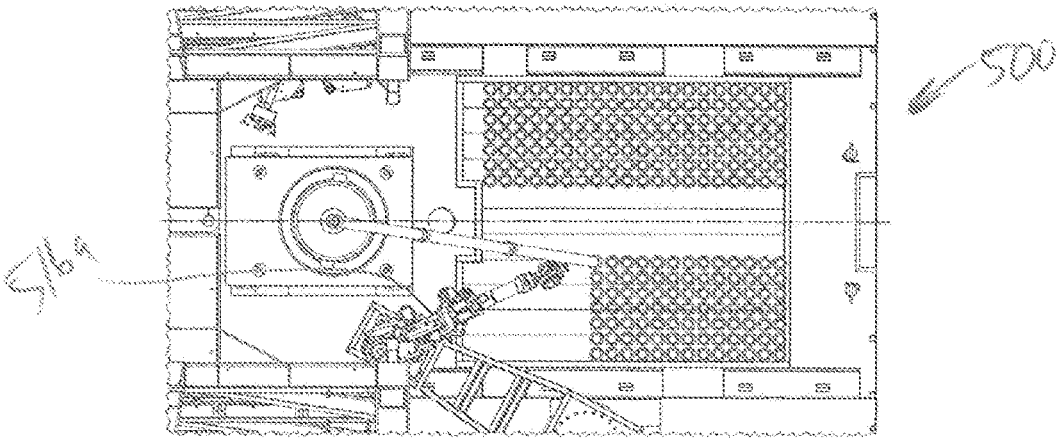
FIG. 25 is a plan view of a stage of tripping in operations using a robot arranged on a boom, according to one or more embodiments.
Figure 26:
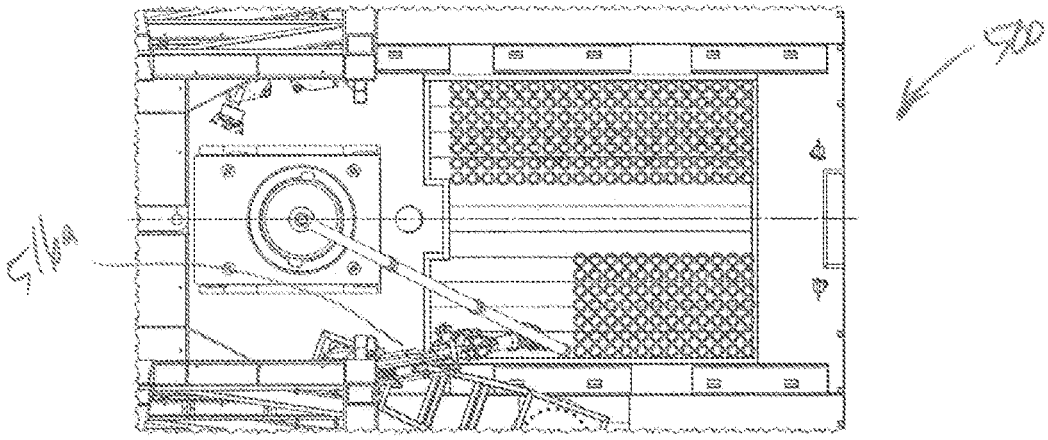
FIG. 26 is a plan view of a stage of tripping in operations using a robot arranged on a boom, according to one or more embodiments.
Figure 27:
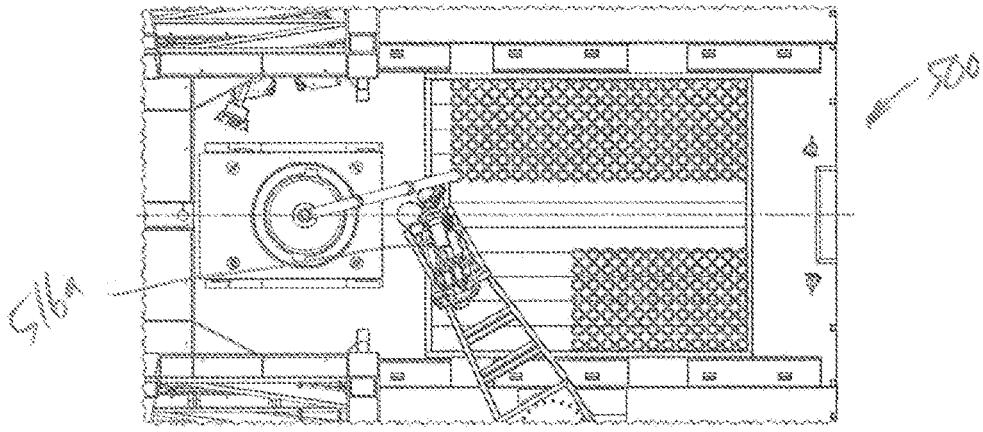
FIG. 27 is a plan view of a stage of tripping in operations using a robot arranged on a boom, according to one or more embodiments.
Figure 28:
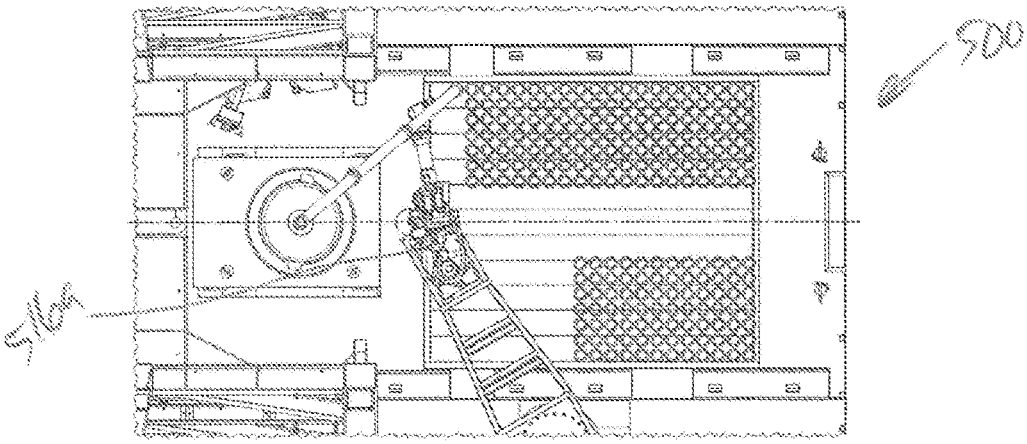
FIG. 28 is a plan view of a stage of tripping in operations using a robot arranged on a boom, according to one or more embodiments.
Figure 29:
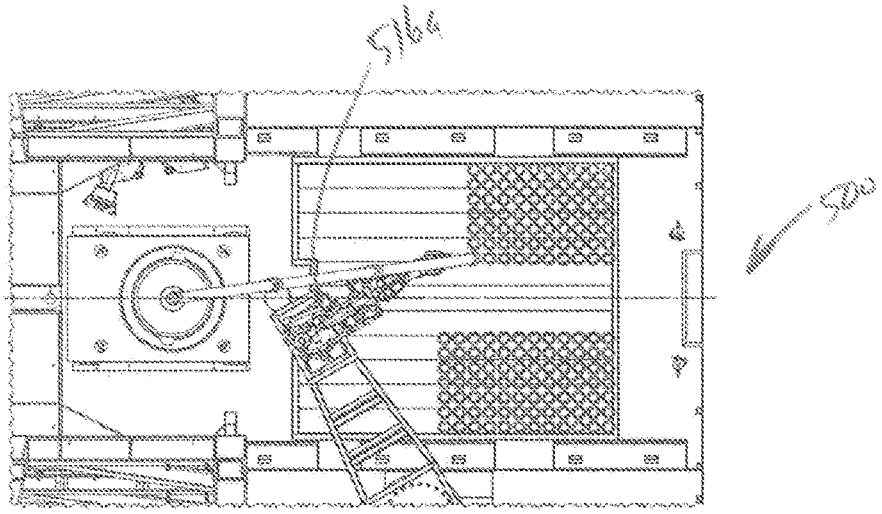
FIG. 29 is a plan view of a stage of tripping in operations using a robot arranged on a boom, according to one or more embodiments.
Figure 30:
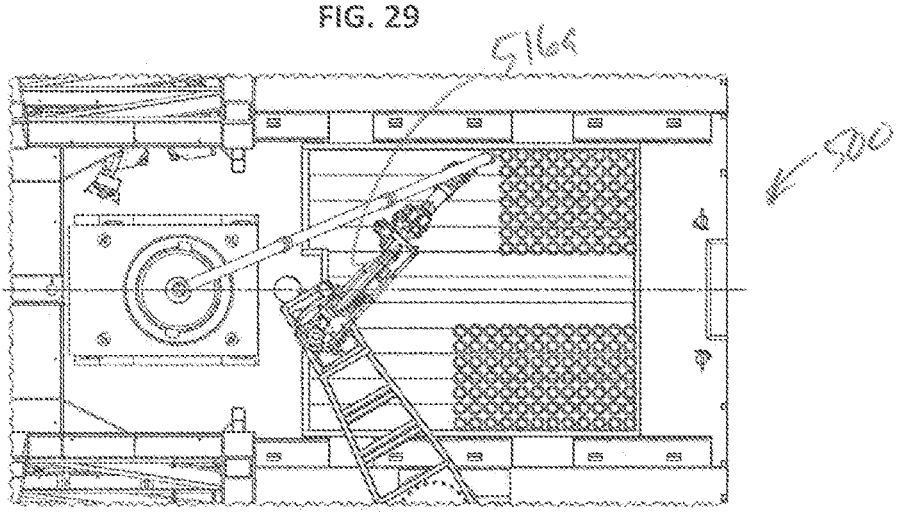
FIG. 30 is a plan view of a stage of tripping in operations using a robot arranged on a boom, according to one or more embodiments.

As shown in FIG. 18, as the racking board robot manipulates a top end of the drill collar, the drill floor robot may rotate about its secured position on the tip of the boom and secure the plan view position of the base of the drill collar. The top drive system and/or its elevators may grasp the drill collar and lift the drill collar off of the drill floor. The drill floor robot 516*a* may control the swing of the bottom of the drill collar and guide it toward well center as shown in FIG. 19. The top drive and iron roughneck may be used to secure the stand to the drill string and drive or lower the collar into the well. Slips in the drill floor may be used to secure the top end of the drill collar when it reaches the drill floor and the top drive may release the drill string and return to an upper position above the racking board to retrieve an additional stand. This process may be repeated for the front row of drill collar on the boom side of the set back area as shown in FIGS. 18-20. The process may then be performed for the drill collar on the other side of the set back area as shown in FIGS. 21-22. It is noted that as the drill floor robot reaches to the far side of the setback area, the boom supporting the robot may pivot toward the setback area to increase the reach of the robot. The swing of the boom may be limited by the pipe stands remaining in the boom side of the setback area.

Figure 31:
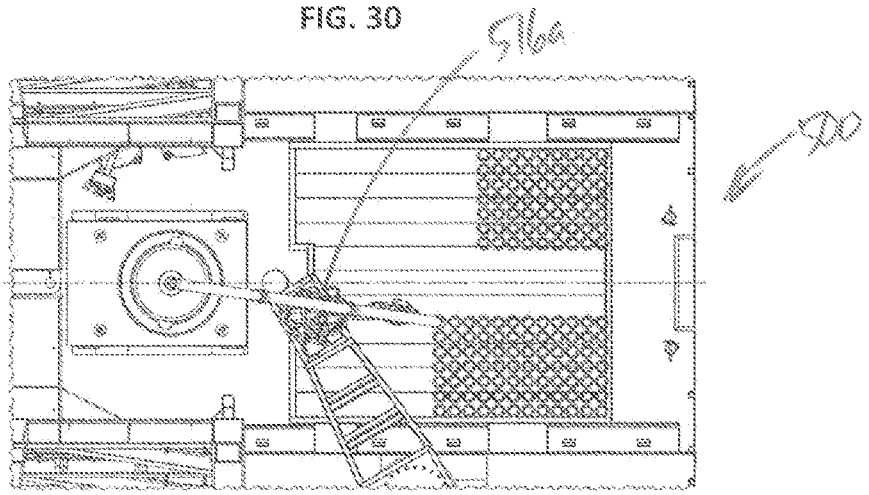
FIG. 31 is a plan view of a stage of tripping in operations using a robot arranged on a boom, according to one or more embodiments.
Figure 32:
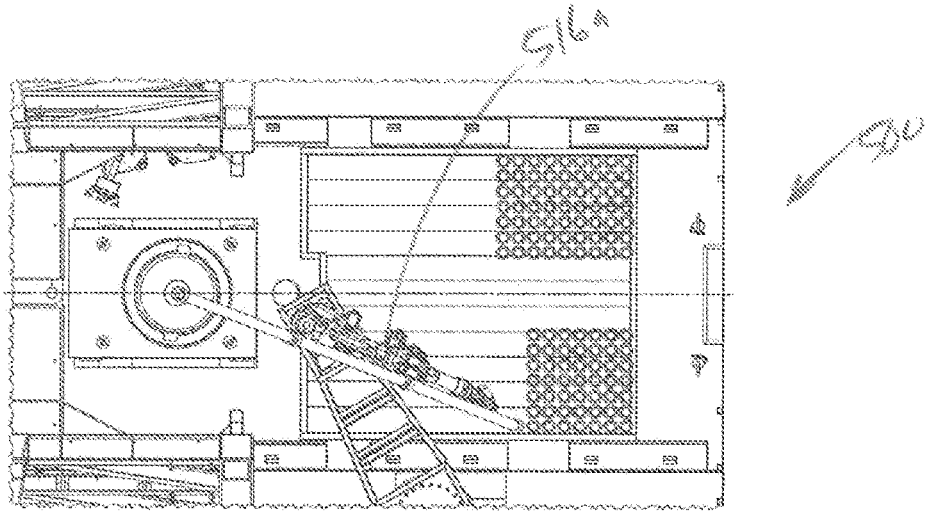
FIG. 32 is a plan view of a stage of tripping in operations using a robot arranged on a boom, according to one or more embodiments.
Figure 33:
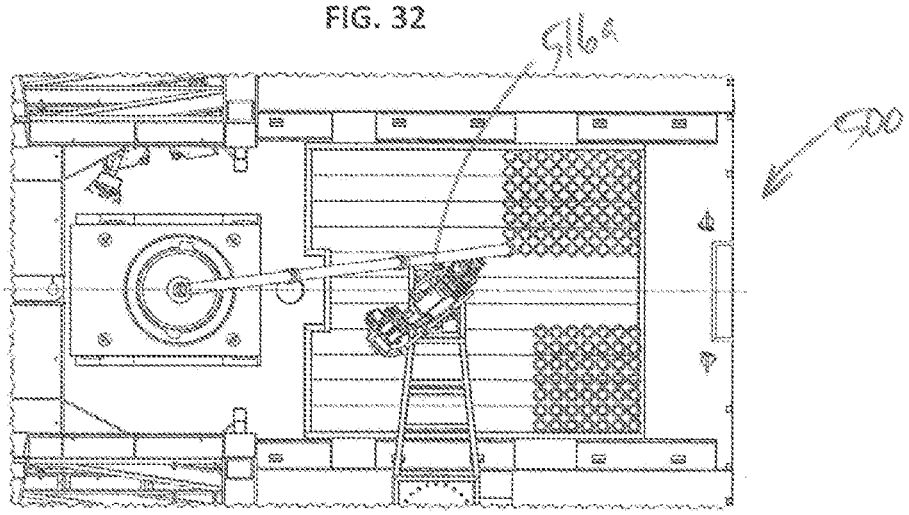
FIG. 33 is a plan view of a stage of tripping in operations using a robot arranged on a boom, according to one or more embodiments.
Figure 34:
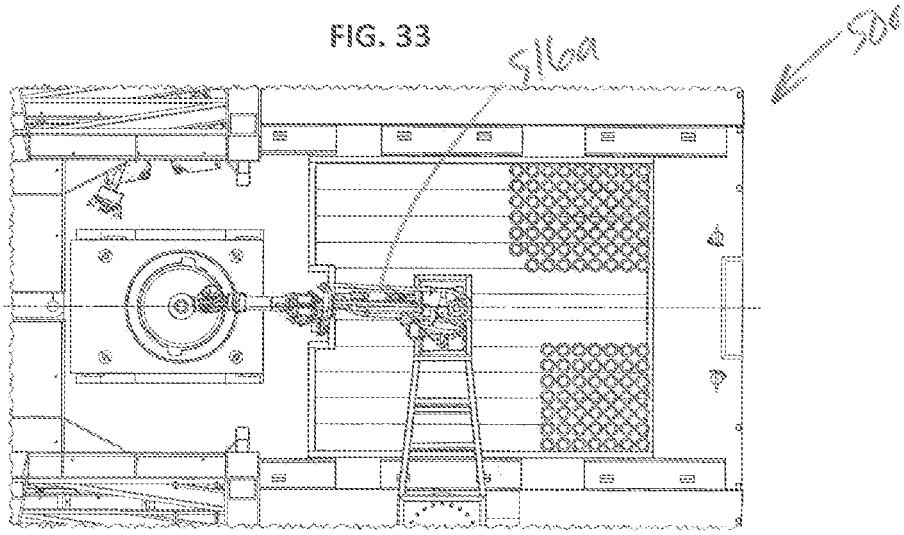
FIG. 34 is a plan view of a stage of tripping in operations using a robot arranged on a boom, according to one or more embodiments.
Figure 35:
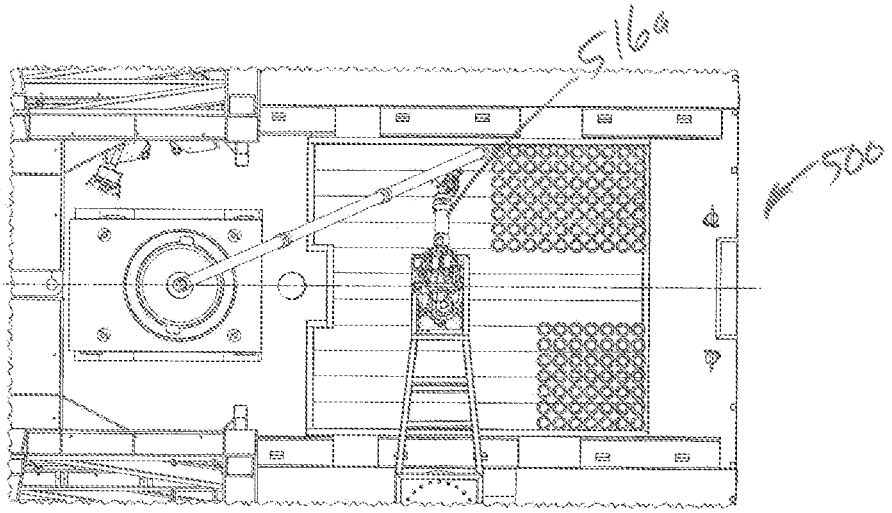
FIG. 35 is a plan view of a stage of tripping in operations using a robot arranged on a boom, according to one or more embodiments.
Figure 36:
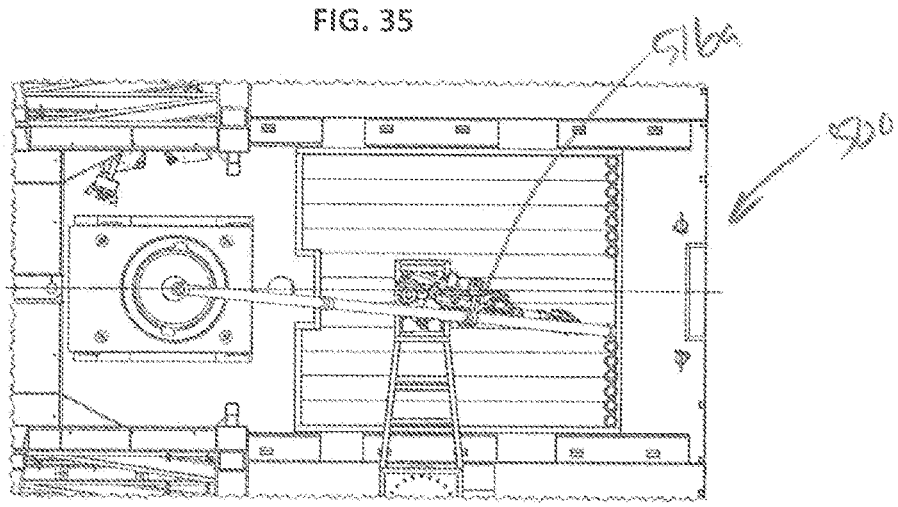
FIG. 36 is a plan view of a stage of tripping in operations using a robot arranged on a boom, according to one or more embodiments.

With the drill collar added to the drill string and extending downhole, the tripping operation may turn to adding lengths of drill pipe to the drill string. Like the drill collar, the method may include starting with a row of drill pipe on the boom side of the setback area 505 by retrieving the pipe stands from an inside position toward an outside position. However, nothing limits the process to retrieving one row and then turning to the opposite side of the setback area since all of the drill pipes are the substantially the same. Accordingly, and as shown in FIGS. 23-26, several rows of drill pipe stands from the boom side of the setback area may be retrieved before beginning to retrieve pipe stands from the other side of the setback area. This approach may be advantageous to free up the range of motion of the boom as shown in, for example, FIG. 27. With the boom range of motion more free, the process may continue by retrieving drill pipe stands from the other side of the setback area beginning with the front row and each row may be unloaded from the side closest to the midline of the setback area and working outward. This process is shown in FIGS. 27-30. As shown, the drill pipe in the boom side of the setback area may again begin to inhibit the range of motion of the boom for purposes of reaching the drill pipe stands on the opposite side of the setback area and, as such, the method may involve retrieving additional drill pipe from the boom side of the setback area as shown in FIGS. 31-32. Additional drill pipe may then be retrieved from the opposite side of the setback area as shown in FIGS. 33-35 and the final stands of drill pipe may be retrieved as shown in FIGS. 36-39.

In another example of tripping operations using strategically placed drill floor robots, FIGS. 40-61 show a process for tripping drill pipe into a well using drill floor robots 616*a* arranged on respective outboard sides of the setback area 605.

Figure 37:
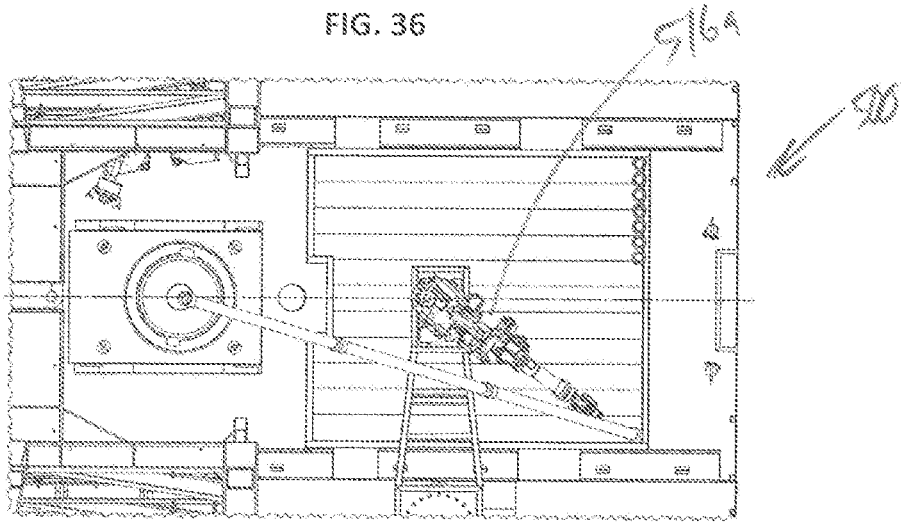
FIG. 37 is a plan view of a stage of tripping in operations using a robot arranged on a boom, according to one or more embodiments.
Figure 38:
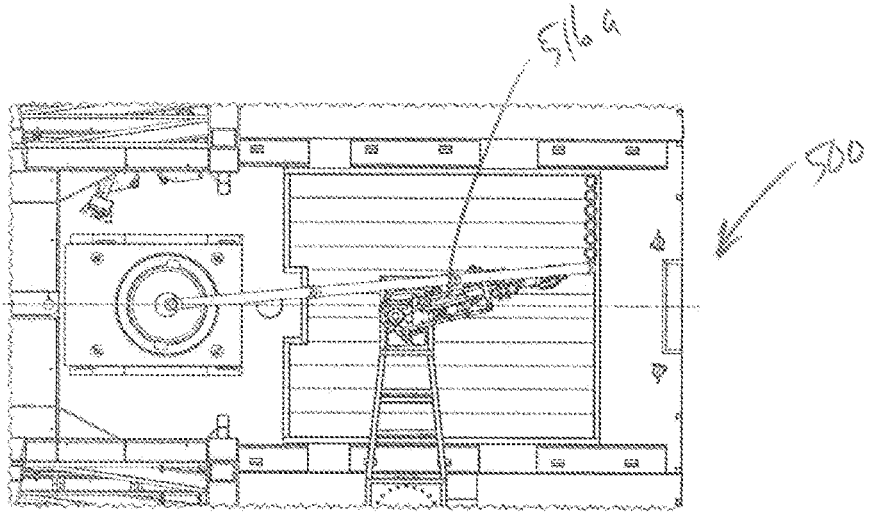
FIG. 38 is a plan view of a stage of tripping in operations using a robot arranged on a boom, according to one or more embodiments.

As with the approach using a boom mounted robot 516*a*, the process may begin by retrieving drill collar from a front row of the setback 605 area starting from the inboard side of the stack and working toward the outboard side as shown in FIGS. 40-44 and then turning to the other side of the setback area as shown in FIGS. 37-38. As with the above-described method, each retrieval of the drill collar or pipe stand, as the case may be, may involve moving a top end of the collar/stand toward a top drive, securing a bottom end of the collar/stand with a drill floor robot, lifting the collar/stand to free up the bottom end, and guiding the bottom end to well center using the drill floor robot. The collar/stand may be secured to the drill string with using the top drive and an iron roughneck and the drill string may be lowered into the well until the top of the string approaches the drill floor. The top of the string may be secured to the drill floor with slips allowing the top drive to release the drill string and return to a location above the racking board to retrieve an additional collar/pipe stand.

Figure 39:
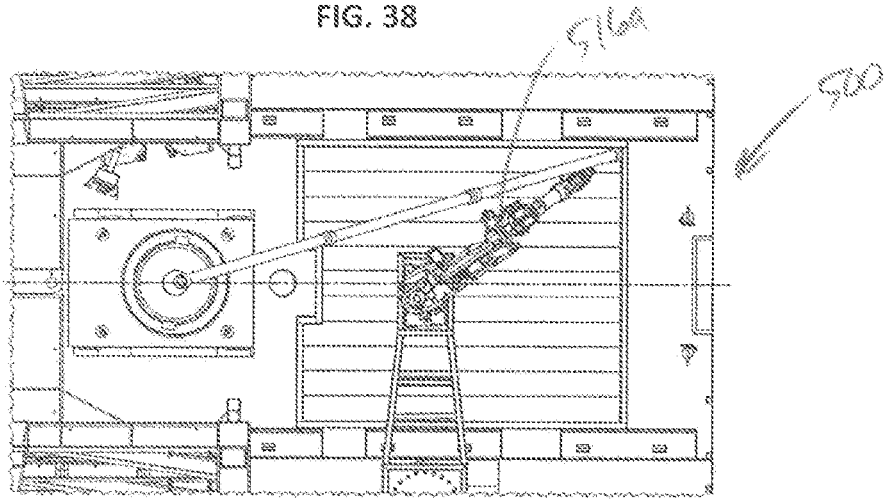
FIG. 39 is a plan view of a stage of tripping in operations using a robot arranged on a boom, according to one or more embodiments.
Figure 40:
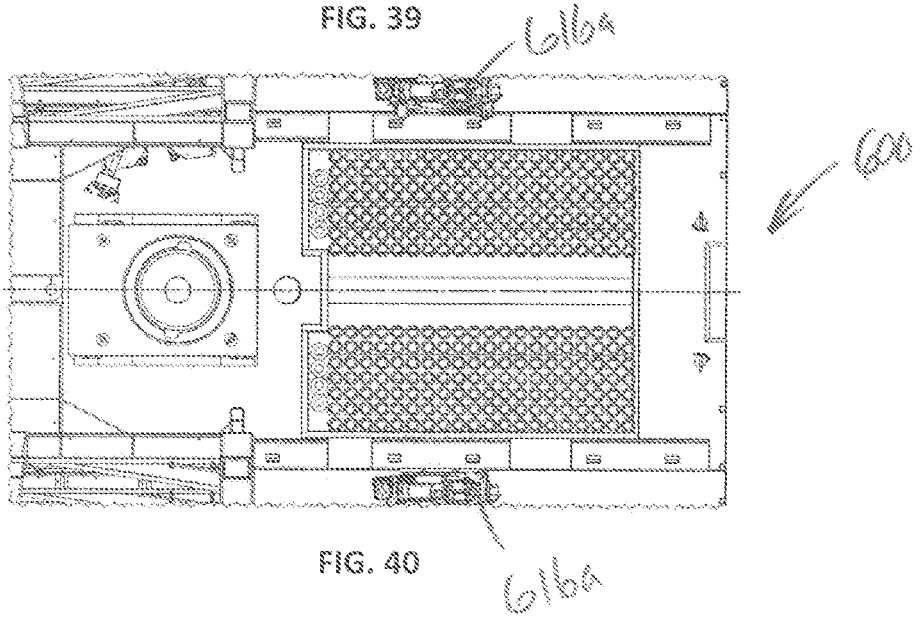
FIG. 40 is a plan view of a stage of tripping operations using robots arranged along outboard sides of drill pipe stacks in the setback area, according to one or more embodiments.
Figure 41:
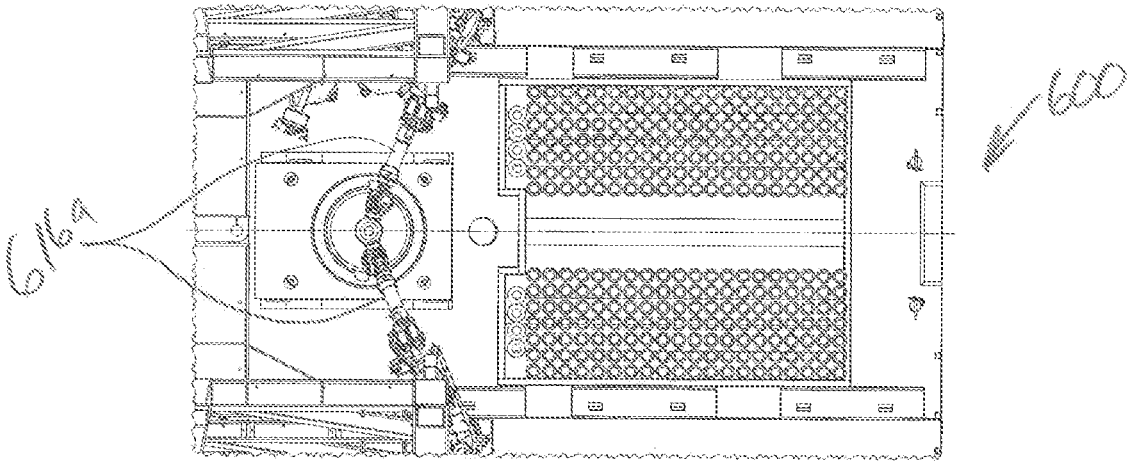
FIG. 41 is a plan view of a stage of tripping operations using robots arranged along outboard sides of drill pipe stacks in the setback area, according to one or more embodiments.
Figure 42:
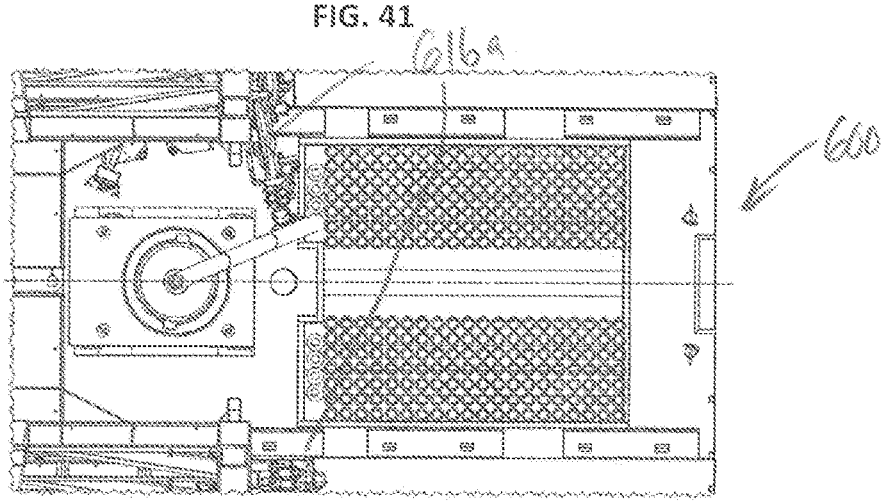
FIG. 42 is a plan view of a stage of tripping operations using robots arranged along outboard sides of drill pipe stacks in the setback area, according to one or more embodiments.
Figure 43:
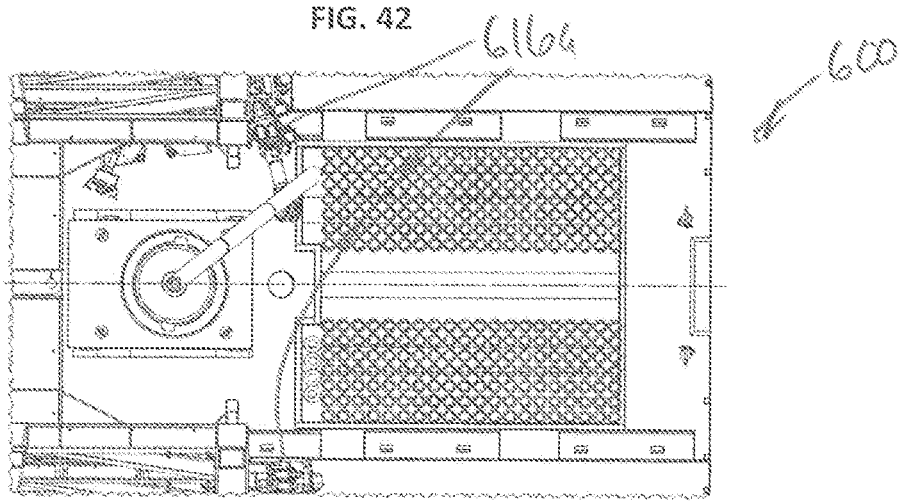
FIG. 43 is a plan view of a stage of tripping operations using robots arranged along outboard sides of drill pipe stacks in the setback area, according to one or more embodiments.
Figure 44:
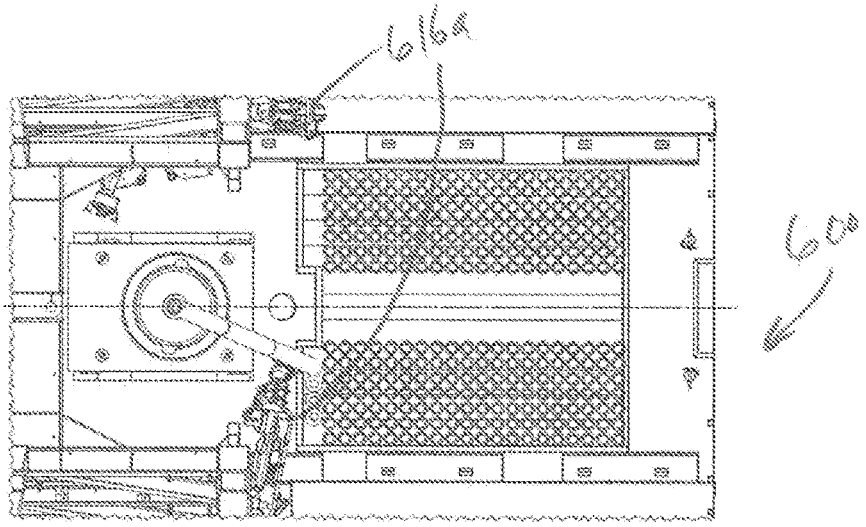
FIG. 44 is a plan view of a stage of tripping operations using robots arranged along outboard sides of drill pipe stacks in the setback area, according to one or more embodiments.
Figure 45:
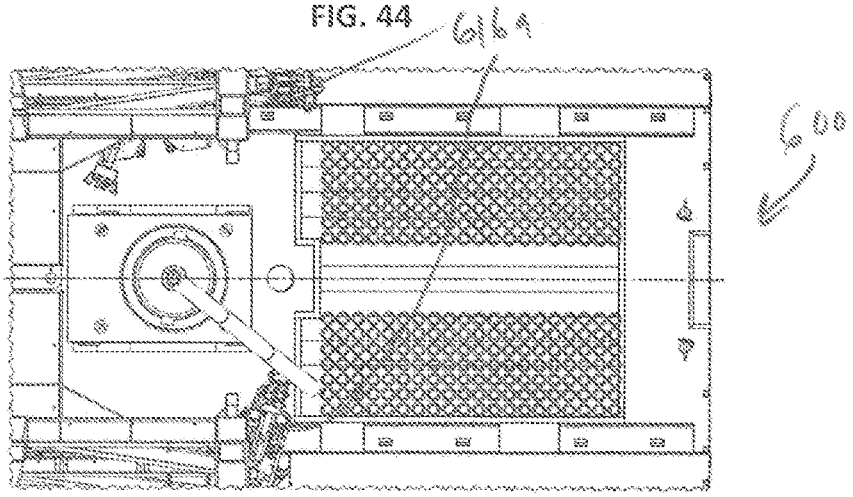
FIG. 45 is a plan view of a stage of tripping operations using robots arranged along outboard sides of drill pipe stacks in the setback area, according to one or more embodiments.
Figure 46:
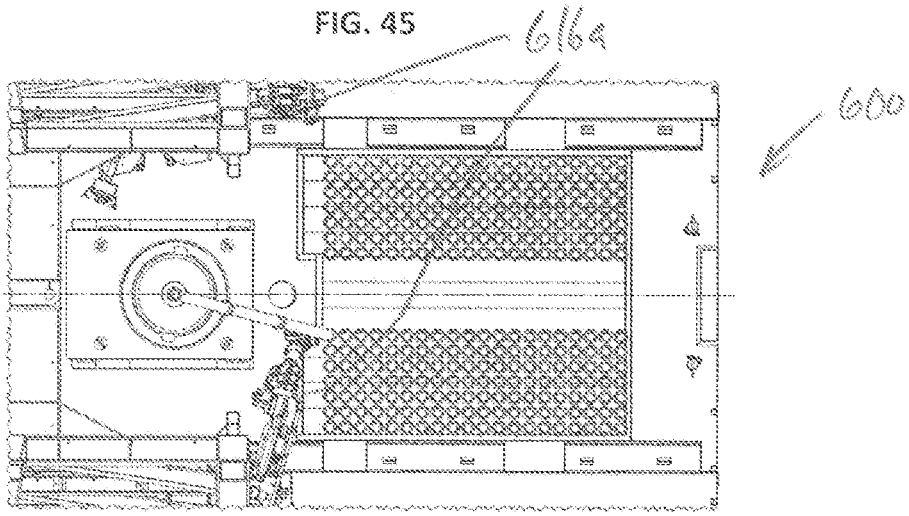
FIG. 46 is a plan view of a stage of tripping operations using robots arranged along outboard sides of drill pipe stacks in the setback area, according to one or more embodiments.
Figure 47:
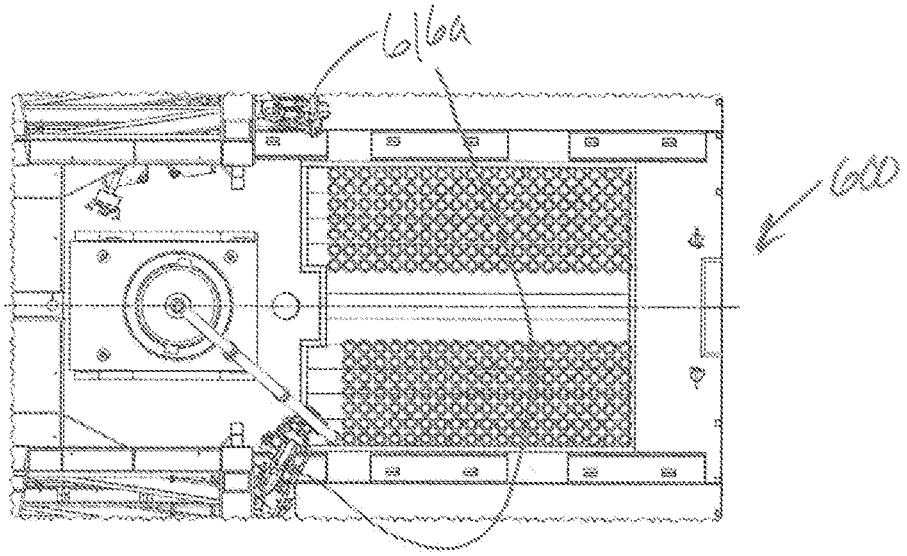
FIG. 47 is a plan view of a stage of tripping operations using robots arranged along outboard sides of drill pipe stacks in the setback area, according to one or more embodiments.
Figure 48:
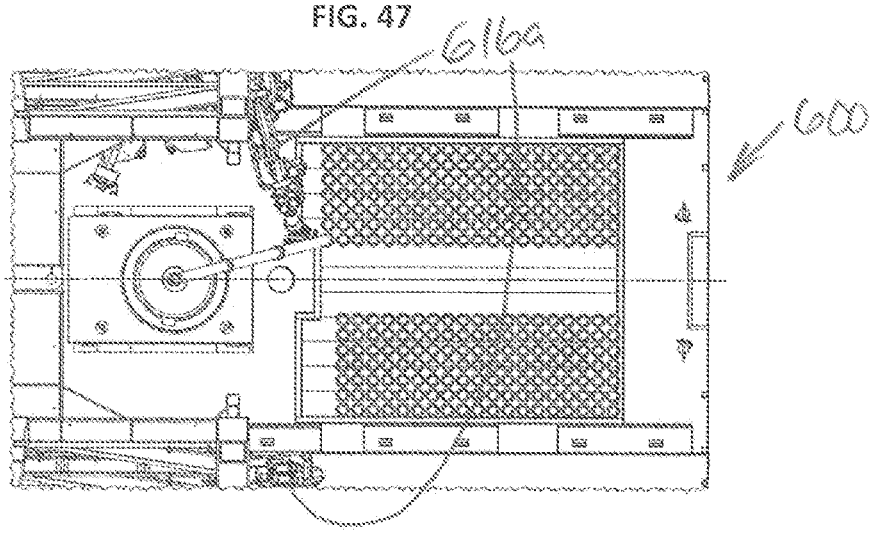
FIG. 48 is a plan view of a stage of tripping operations using robots arranged along outboard sides of drill pipe stacks in the setback area, according to one or more embodiments.
Figure 49:
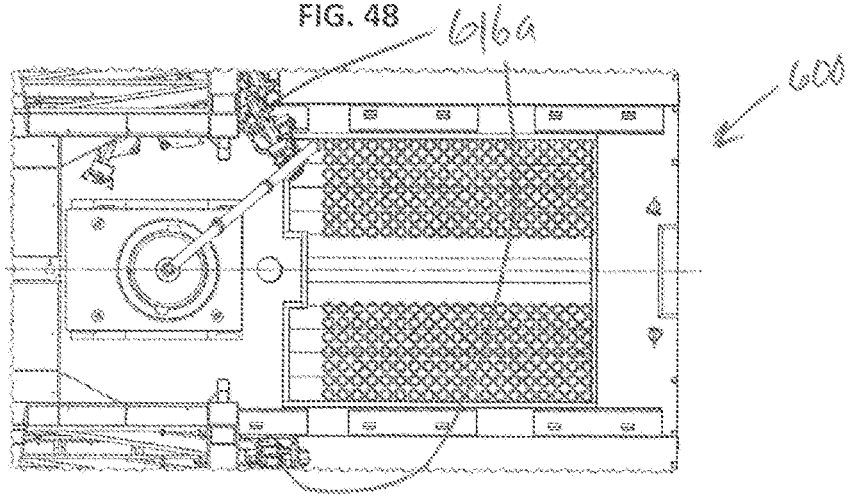
FIG. 49 is a plan view of a stage of tripping operations using robots arranged along outboard sides of drill pipe stacks in the setback area, according to one or more embodiments.
Figure 50:
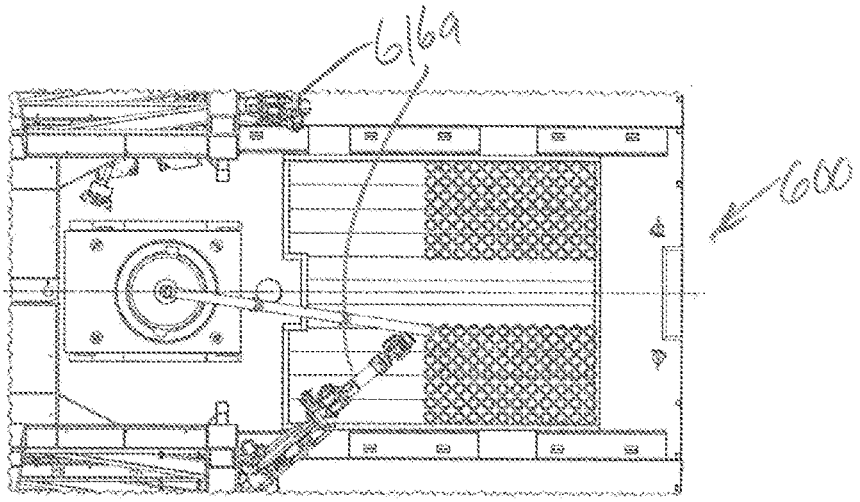
FIG. 50 is a plan view of a stage of tripping operations using robots arranged along outboard sides of drill pipe stacks in the setback area, according to one or more embodiments.
Figure 51:
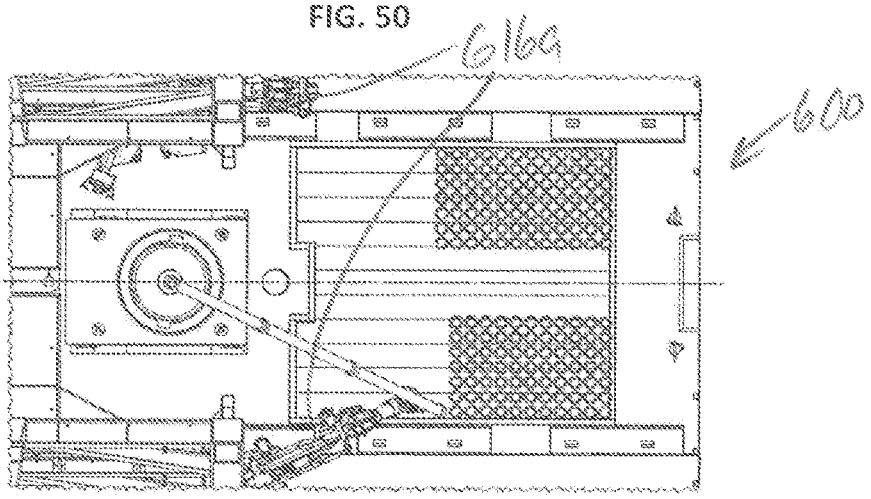
FIG. 51 is a plan view of a stage of tripping operations using robots arranged along outboard sides of drill pipe stacks in the setback area, according to one or more embodiments.
Figure 52:
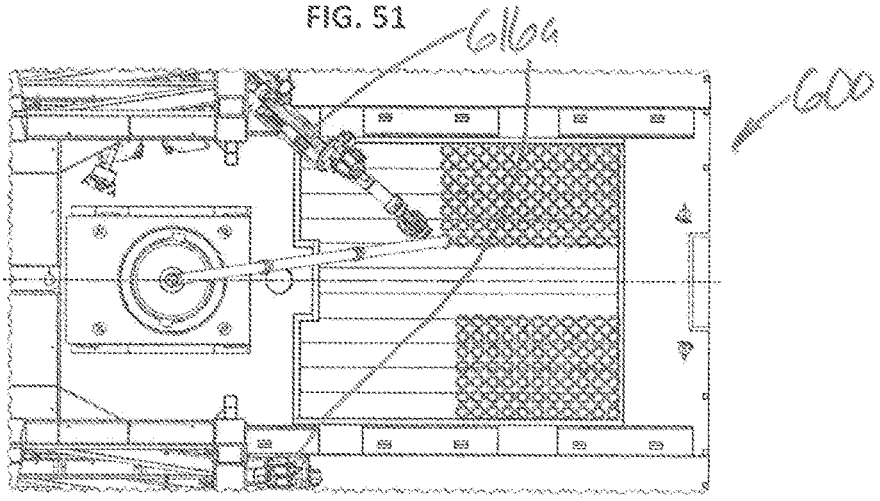
FIG. 52 is a plan view of a stage of tripping operations using robots arranged along outboard sides of drill pipe stacks in the setback area, according to one or more embodiments.
Figure 53:
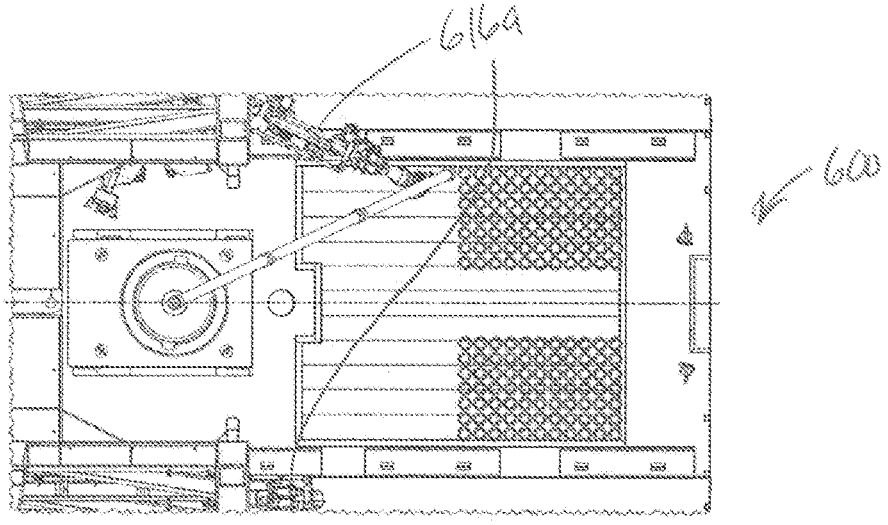
FIG. 53 is a plan view of a stage of tripping operations using robots arranged along outboard sides of drill pipe stacks in the setback area, according to one or more embodiments.
Figure 54:
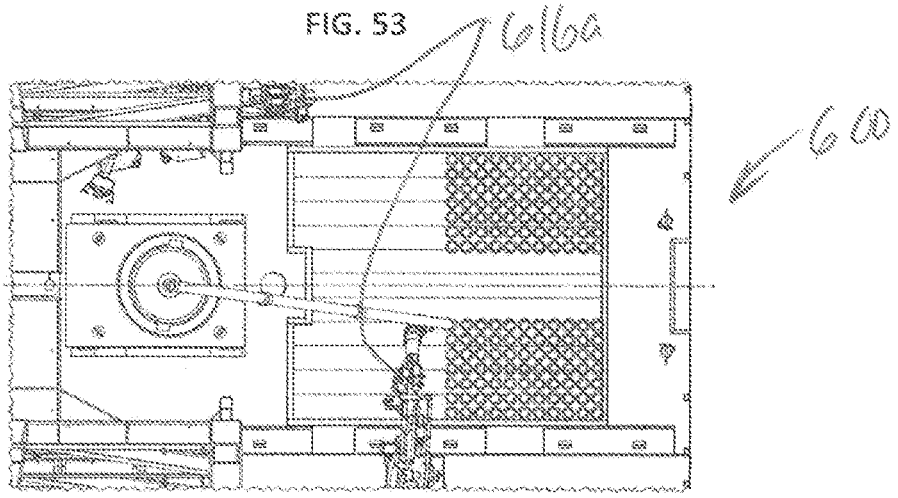
FIG. 54 is a plan view of a stage of tripping operations using robots arranged along outboard sides of drill pipe stacks in the setback area, according to one or more embodiments.
Figure 55:
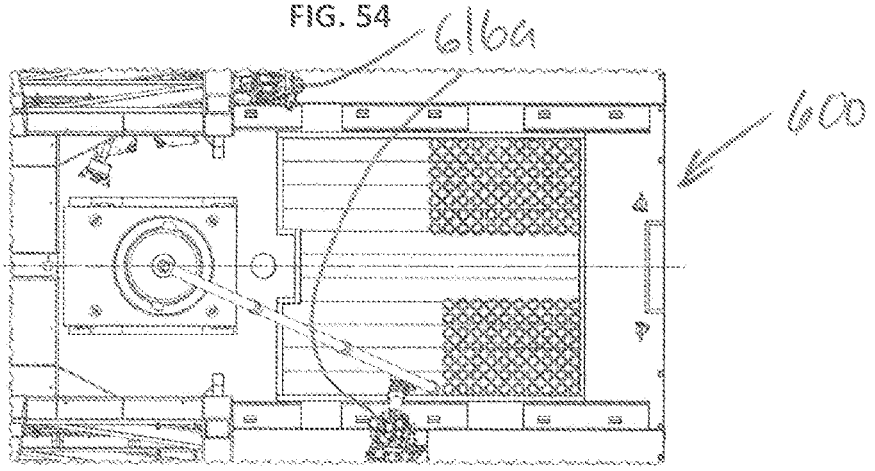
FIG. 55 is a plan view of a stage of tripping operations using robots arranged along outboard sides of drill pipe stacks in the setback area, according to one or more embodiments.
Figure 56:
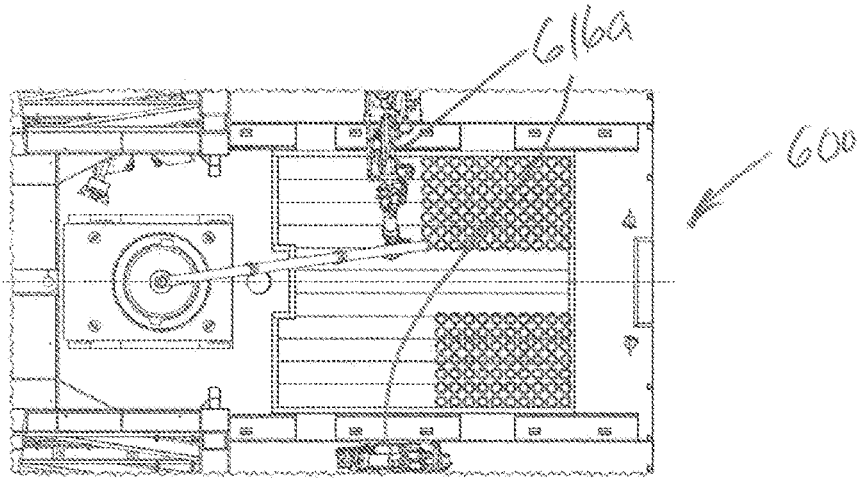
FIG. 56 is a plan view of a stage of tripping operations using robots arranged along outboard sides of drill pipe stacks in the setback area, according to one or more embodiments.
Figure 57:
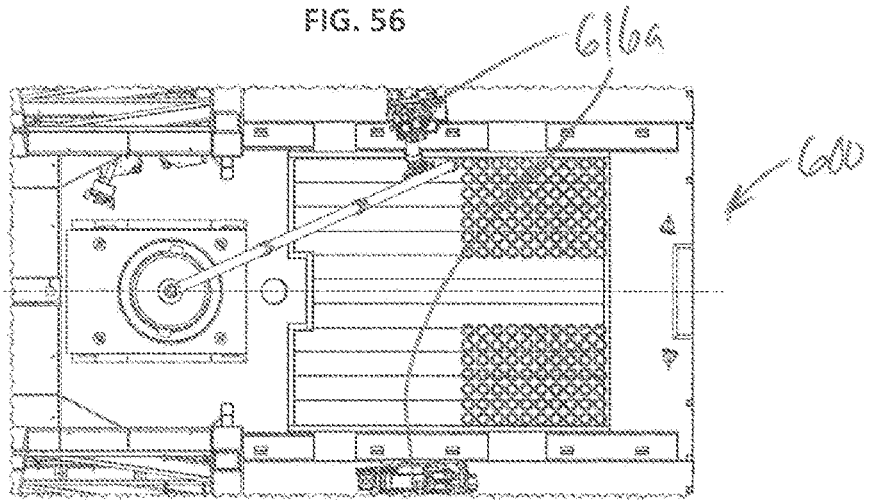
FIG. 57 is a plan view of a stage of tripping operations using robots arranged along outboard sides of drill pipe stacks in the setback area, according to one or more embodiments.
Figure 58:
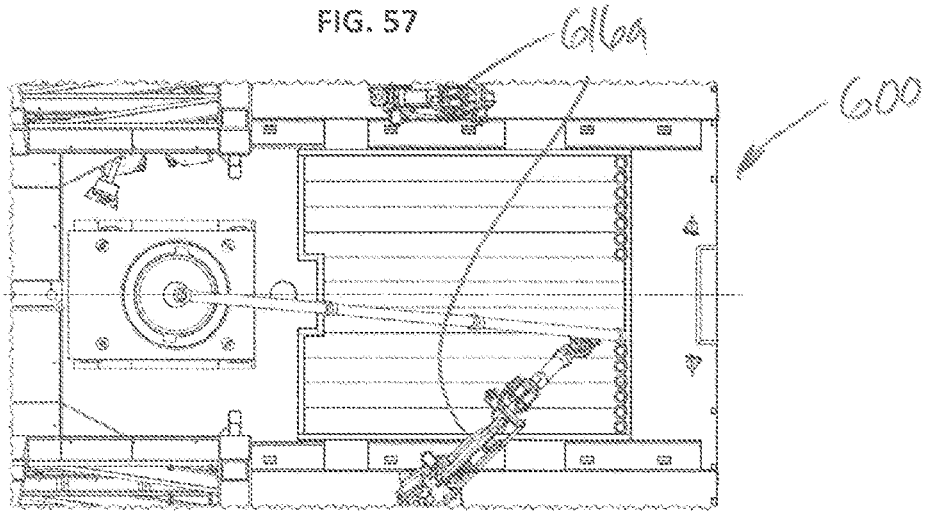
FIG. 58 is a plan view of a stage of tripping operations using robots arranged along outboard sides of drill pipe stacks in the setback area, according to one or more embodiments.
Figure 59:
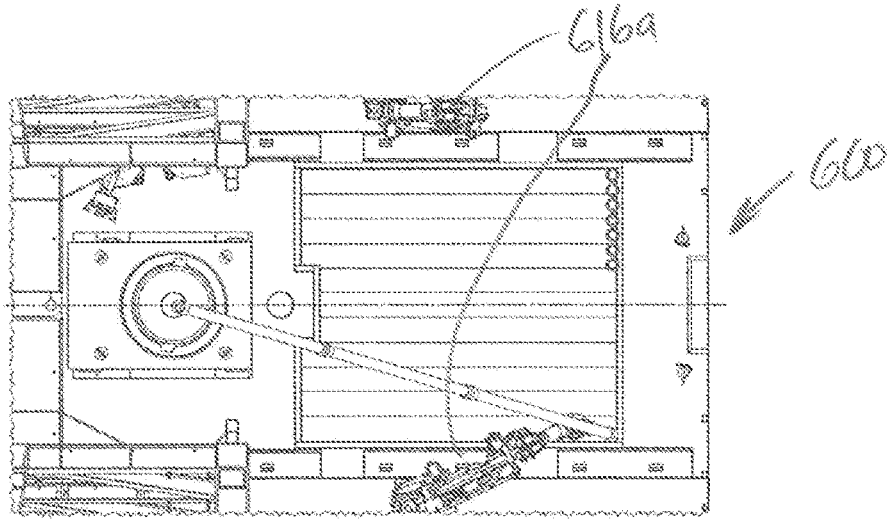
FIG. 59 is a plan view of a stage of tripping operations using robots arranged along outboard sides of drill pipe stacks in the setback area, according to one or more embodiments.
Figure 60:
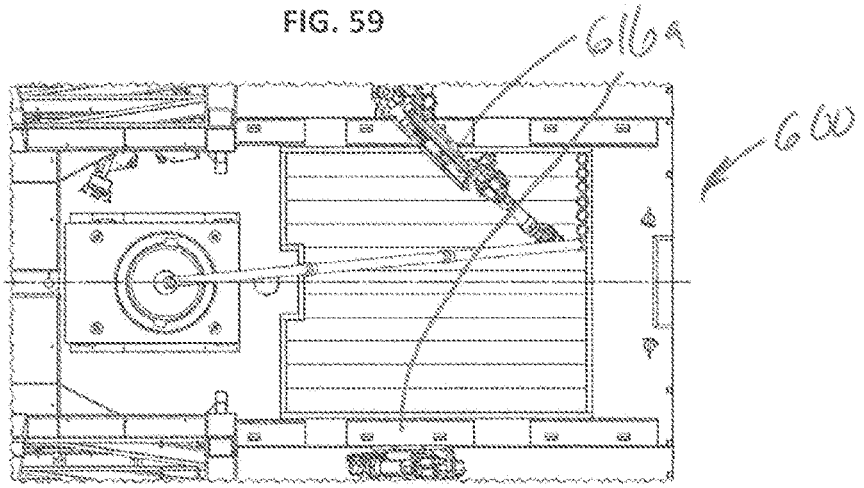
FIG. 60 is a plan view of a stage of tripping operations using robots arranged along outboard sides of drill pipe stacks in the setback area, according to one or more embodiments.
Figure 61:
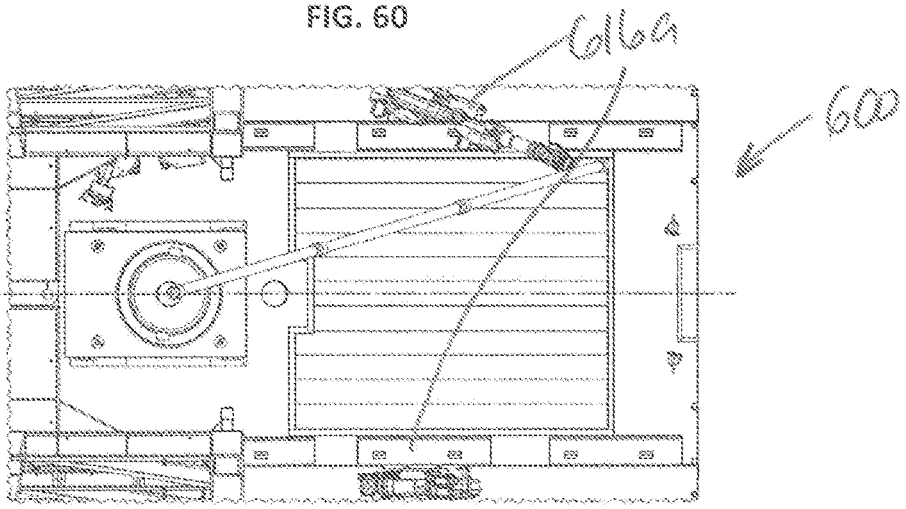
FIG. 61 is a plan view of a stage of tripping operations using robots arranged along outboard sides of drill pipe stacks in the setback area, according to one or more embodiments.

In this embodiment, the two drill floor robots may each unload a row from the setback area and the robots may alternate unloading corresponding rows as shown in FIGS. 39-40 for the first side of the setback area and then FIGS. 41-42 the second side. The process may continue row by row throughout the depth of the setback area as shown in FIGS. 43-54. In one or more embodiments, both drill floor robots may be activated and may alternate pipe for pipe rather than row for row to speed up tripping operations. However, in still other embodiments, while one robot is handling pipe, the other robot may change out its end effector and may handle pipe doping operations or mud bucket operations. Still other uses for the drill floor robot may be provided when not handling pipe.

While FIGS. 10-54 have described tripping operations relating to particular robot arrangements, the following trip out and trip in descriptions apply to all of the above-described operations and are provided here to supplement these more specific discussions.

Figure 62:
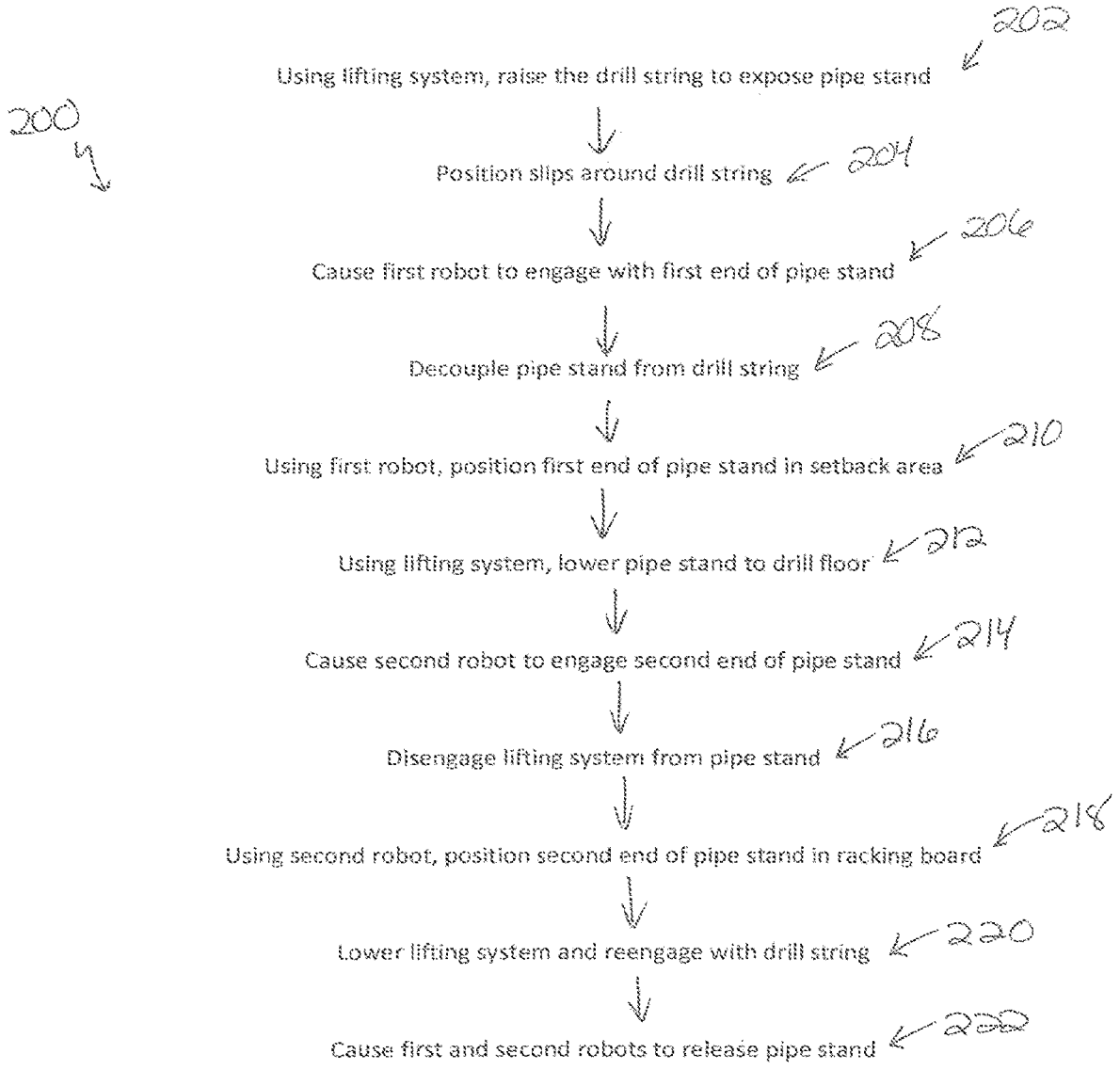
FIG. 62 is a flow diagram of a trip-out operation of the present disclosure, according to one or more embodiments.

FIG. 62 illustrates a flow diagram of a trip out operation performable using a pipe handling system of the present disclosure, according to one or more embodiments. As described above, a trip out operation may include disconnecting pipe stands from a drill string. A trip out operation may be performed to replace or change out a drill bit or other downhole components, for example. A trip out operation may also be performed after drilling is completed in a well. There may be other reasons to perform a trip out operation as well. The method 200, or portions thereof, may be encoded on one or more controllers as computer executable instructions. In some embodiments, the method 200, or portions thereof, may be performable by an operator such as a human operator controlling components of the pipe handling system. The method 200 may include the steps of using a lifting system, raising the drill string to expose a pipe stand 202; positioning slips around the drill string and loosening the pipe stand from the drill string with an iron roughneck 204; causing a first robot to engage with a first end of the pipe stand 206; decoupling the pipe stand from the drill string 208; using the first robot, position the first end of the pipe stand in a setback area 210; using the lifting system, lowering the pipe stand to the drill floor 212; causing a second robot to engage a second end of the pipe stand 214; disengaging the lifting system from the pipe stand 216; using the second robot, positioning the second end of the pipe stand in a racking board 218; lower the lifting system and reengage with the drill string 220; and causing the first and second robots to release the pipe stand 222.

As described above, the lifting system may be or include an elevator coupled to a traveling block, a lifting hook, a main line, an auxiliary line, an auxiliary lifting arm or claw, and/or any other suitable lifting or hoisting mechanism. In some embodiments, different components of the lifting system, or different lifting systems, may be used for different lifting operations throughout the method or other methods described herein. Raising the drill string (202) may include raising a pipe elevator, or another suitable lifting apparatus, coupled to the drill string. The lifting system may raise the drill string far enough out of the well to expose above the drill floor a first pipe stand, or length of pipe, to be disconnected from the drill string. With the pipe stand exposed, slips may be placed around the drill string (204) below the pipe stand to maintain a position of the drill string with respect to the drill floor and thus prevent the drill string from falling back into the well. The slips may generally be wedged between an outer diameter of the drill string and an inner diameter of an opening in the drill floor. In some embodiments, the slips may be placed manually by an operator. In other embodiments, a robot may be used to position the slips. In other embodiments, another suitable mechanism for holding a position of the drill string may be used.

With the pipe stand exposed, a first robot, which may be a lower robot positioned on or near the drill floor, may be directed to engage with a first end of the pipe stand (206). In the case of multiple robots at the drill floor, the first robot may be either one of these multiple robots. The first end of the pipe stand may be an end of the stand located nearest the drill floor and coupled to the remainder of the drill string. The first end of the pipe stand may be referred to herein as a lower end. To engage with the pipe stand, the drill floor robot may be directed to move, on its track or other moving mechanism, toward well center. The articulated arm may be used to reach toward the pipe stand. The end effector of the lower robot 416*a* may be controlled to grasp the lower end of the pipe stand. In particular, the end effector may be controlled to open or extend the movable finger, position the pipe stand between the movable finger and the fixed finger, and close or retract the movable finger. Decoupling the exposed pipe stand from the remainder of the drill string (208) may include directing an iron roughneck to disconnect the pipe stand. An iron roughneck 414 arranged on the drill floor 402 may be used to decouple the drill exposed pipe stand from the drill string. In other embodiments, a robot or one or more operators may disconnect the pipe stand from the drill string. It is to be appreciated that with the pipe stand disconnected from the drill string, the pipe elevator or other lifting system may still be supporting the weight of the pipe stand.

With the pipe stand disconnected from the drill string, the first robot may move to position the first end of the pipe stand in the setback area of the drill floor, beneath the racking board (210). In particular, the first robot may move along its track or other moving apparatus away from the well center to a setback area of the drill floor. The articulated arm may move to position the lower end of the pipe stand beneath the racking board 408. In some embodiments, the first robot may position the lower end of the pipe stand aligned with or near a particular racking location where the pipe stand is to be stored in the racking board. The lower robot 416*a* may position the lower end of the pipe stand beneath the racking board. The lifting system may be used to lower the pipe stand to the drill floor (212), so as to transfer the load of the pipe to the drill floor. The lower end of the pipe stand may be lowered to a particular location in the setback area, as positioned by the lower robot, where the pipe stand will be stored with respect to the racking board. In one or more embodiments, the elevator 120 may swing laterally away from well center to move the top of the pipe stand closer to the racking board and helping to facilitate placement of the bottom of the pipe stand in the set back area.

Additionally, the second robot, which may be an upper robot arranged on or near the racking board, may be directed to engage a second end of the pipe stand (214). The second end of the pipe stand may be an end opposing the first end, arranged furthest from the drill floor and/or nearest the racking board. The second end of the pipe stand may be referred to herein as the upper end. To engage with the pipe stand, the upper robot may be directed to move, on its track or other moving mechanism, toward well center. The articulated arm may be used to reach toward the pipe stand. The upper robot 416*b* may be arranged on the racking board and positioned to engage an upper end of the pipe stand. The end effector of the upper robot 416*b* may be controlled to grasp the upper end of the pipe stand. In particular, the end effector may be controlled to open or extend the movable finger, position the pipe stand between the movable finger and the fixed finger, and close or retract the movable finger. Moreover, the wrist and/or other aspects of the second robot may be manipulated to position the end effector in a manner that accommodates the angle of the pipe stand based on the position of the top and bottom of the pipe, which may be known based on the first robot position and the elevator position. With both ends of the pipe stand engaged by the first and second robots, and with the weight of the pipe stand supported by the drill floor, the pipe elevator or other lifting system may be disengaged from the pipe stand (216). Additionally, the upper robot may move to position the upper end of the pipe stand within the racking board, such as between two fingers of the racking board (218). The upper robot may position the upper end of the pipe stand in line with the lower end of the pipe stand as positioned by the lower robot. The upper robot 416*b* may position the pipe stand within the fingers of the racking board. In one or more embodiments, the end effectors of the first and second robots may be manipulated to track and/or follow the changing angle of the pipe stand as the second robot moves the top of the stand into the fingers of the racking board.

After it disengages from the pipe stand, the lifting system may be lowered to begin a next tip out sequence. In particular, the lifting system may be lowered and may reengage the drill string (220). If slips were placed, they may be removed from around the drill string, and the lifting system may repeat the method 200 by raising the drill string to expose another pipe stand. The lifting system may lower the pipe elevator to reengage the drill string while the lower 416*a* and upper 416*b* robots manipulate the pipe stand to a stored position between the setback area 405 and the racking board. It is to be appreciated that the weight of the pipe stand may be directed to the drill floor 402 while the upper robot 416*b* manipulates the upper end of the pie stand. Additionally, the first and second robots may release the pipe stand once it is positioned in the racking board and may move toward well center to engage with a next pipe stand (222). The pipe stand may be stored in the setback area 405 and racking board, as the lower robot 416*a* disengages from the pipe stand and moves toward well center to approach a next pipe stand.

In some embodiments some steps of the method 200 may be performed simultaneously or substantially simultaneously. For example, the lifting system may lower the pipe stand toward the drill floor while the lower robot moves to position the lower end of the pipe stand in the setback area, and while the upper robot moves toward well center in preparation for engagement with the upper end of the pipe stand. Additionally, operations of the various components of the pipe handling system may be coordinated together to carry out the method steps. In some embodiments, actions of the various components may be coordinated by timing individual steps or operations with respect to one another. Additionally or alternatively, operations of the various components may be coordinated based upon feedback data received from one or more components. For example, a weight sensor on or arranged in connection with the lifting system may provide an indication as to whether the pipe stand is held within the pipe elevator. As another example, a contact switch arranged on or in connection with each robot end effector may provide an indication as to whether the pipe stand is engaged by the end effector. A proximity sensor arranged on or in communication with each end effector may provide an indication as to whether the end effector is in an open or closed position. Still further, rotational motion of the several joints of the robots may be measured or monitored as the robot moves so as to continually track the position and orientation of the end effectors and, thus, the portion of the pipe stand surrounded by the end effector. Some steps or operations of methods of the present disclosure may be performed based upon such feedback data, as is described in more detail below.

Figure 63:
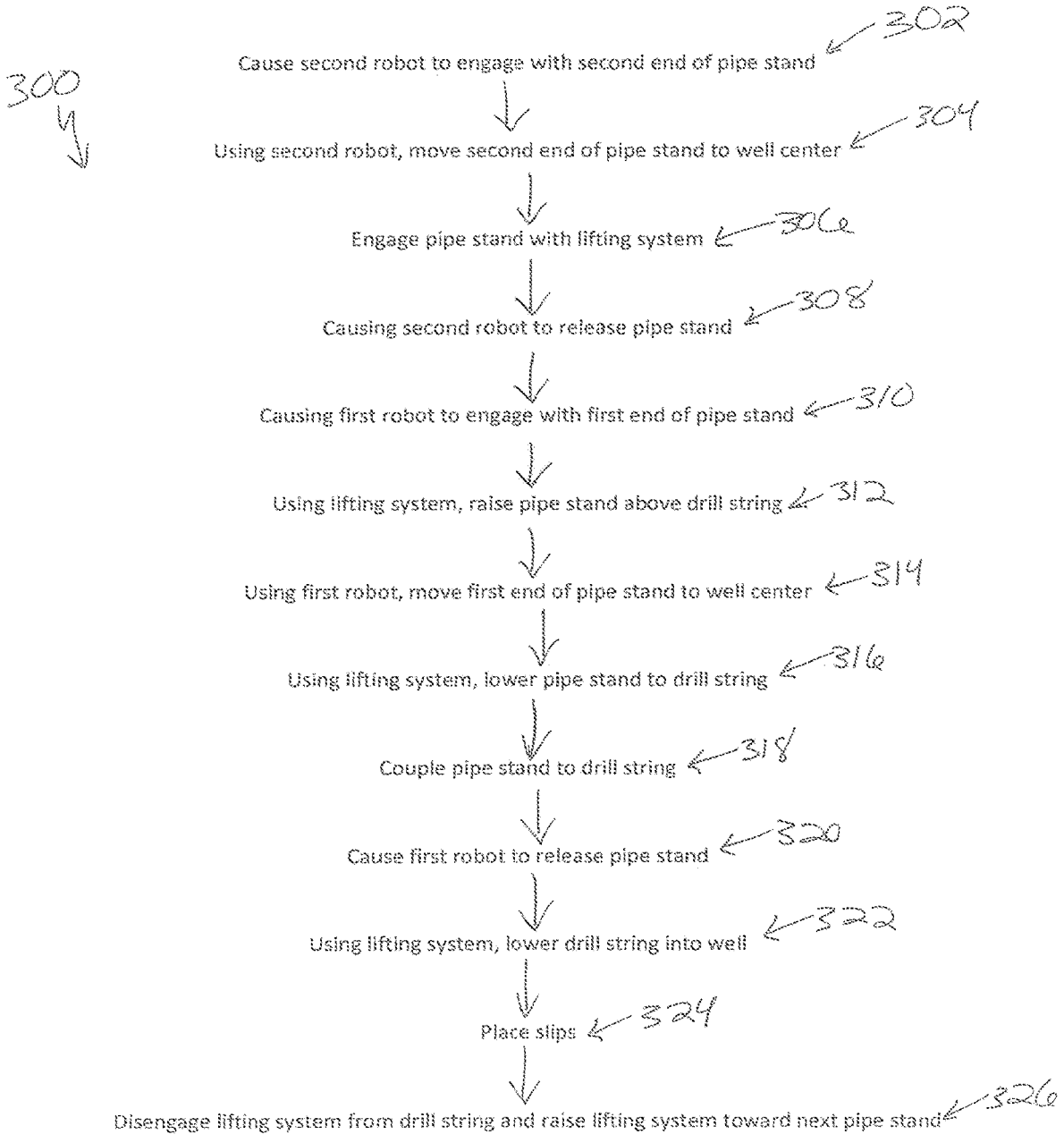
FIG. 63 is a flow diagram of a trip-in operation of the present disclosure, according to one or more embodiments.

FIG. 63 illustrates a flow diagram of a trip in operation performable using a pipe handling system of the present disclosure, according to one or more embodiments. The method 300 may be performed automatically, partially automatically, manually, or partially manually. The method 300, or portions thereof, may be encoded on one or more controllers as computer executable instructions. In some embodiments, the method 300, or portions thereof, may be performable by an operator such as a human operator controlling components of the pipe handling system. The method 300 may include the steps of causing the second (upper) robot to engage with the second (upper) end of a pipe stand (302); moving the second end of the pipe stand toward well center (304); using a lifting system, engaging the pipe stand with the lifting system (306); causing the second robot to release the pipe stand (308); causing the first (lower) robot to engage with the first (lower) end of the pipe stand (310); using the lifting system, raising the pipe stand (312); moving the first end of the pipe stand toward well center (314); lowering the pipe stand onto the drill string and loosely coupling the pipe stand with the drill floor robot (316); coupling the pipe stand to the drill string with an iron roughneck (318); causing the first robot to release the pipe stand (320); lowering the elevator with the drill string (322); placing slips around the drill string (324); and disengaging the lifting system from the drill string and raising the lifting system toward a next pipe stand (326). It is to be appreciated that a trip in operation may effectively be a reverse of a trip out operation. It is to be appreciated that the nomenclature of the first and second robots, as indicated with respect to the method 200, is maintained with respect to the method 300.

The second robot, which may be an upper robot arranged on or near the racking board, may engage with the second or upper end of a pipe stand (302). This may be a pipe stand stored in the setback area of the drill floor and arranged within the racking board. The robot may engage with the pipe stand by grasping it with the end effector. In some embodiments, the robot may be directed to the pipe stand based on a known location of the pipe stand. That is, the robot may be directed to open and close the end effector at a particular location above the racking board; where it is known that a pipe stand is stored. Alternatively or additionally, the robot may include sensors for determining the position of the pipe stand. As described above, the robot may be configured to engage with a single pipe stand without disturbing surrounding pipe stands stored nearby.

With the pipe stand engaged by the end effector, the upper robot may move the engaged upper end of the pipe stand toward well center (304). The upper robot may move along its track or other movement means on the racking board, and/or may use the articulating arm to position the upper end of the pipe stand at or near well center. It is to be appreciated that while the upper robot maneuvers the upper end of the pipe stand, the weight of the pipe stand may be held by the drill floor. The second robot may thus position the upper end of the pipe stand so that it may be lifted by a lifting system. A pipe elevator or other lifting system may engage the pipe stand to transfer the load from the drill floor (306). The upper robot may release its grip on the pipe stand (308), thus completing a handoff from the upper robot to the pipe elevator.

Additionally, the first robot, which may be a lower robot arranged on or near the drill floor and may be one of the multiple robots arranged at the drill floor, may engage with a lower end of the pipe stand, which may be arranged within the setback area of the drill floor (310). As described above, the first robot may engage the pipe stand without disturbing nearby pipe stands. Moreover, the first robot may adjust its end effector to accommodate the changed positioned of a portion of the pipe which may be slightly above the bottom due to the tilted nature of the pipe created by moving the top of the pipe to the pipe elevator or lifting system. The lifting system may operate to lift the pipe stand, so as to transfer the weight of the stand from the drill floor to the lifting system (312). With the weight of the pipe stand held by the lifting system, the lower robot may move the lower end of the pipe stand toward the well center, and in some embodiments may position the lower end of the pipe stand over the drill string extending from the well (314). As the lower robot moves the lower end of the pipe, the end effector on the lower robot may continually track the position and orientation of the pipe based on knowledge of the top and bottom positions of the pipe and may adjust the end effector to accommodate the continually changing pipe orientation. The lifting system may lower the pipe stand onto the drill string (316), and the pipe stand may be coupled to the drill string using, for example, an iron roughneck (318). The lower robot may release the lower end of the pipe stand (320).

In some embodiments, slips or another mechanism holding the drill string in place with respect to the drill floor may be removed or disengaged, and the lifting system may operate to lower the drill string so as to lower the newly attached pipe stand at least partially into the well (322). Slips or another suitable mechanism may be positioned around the drill string to maintain a position with respect to the drill floor (324). With a position of the drill string held by the slips, the lifting system may disengage from the drill string, and may raise upward toward the racking board to prepare for engagement with a next pipe stand (326). The method 300 may thus repeat in order to attach a next pipe stand to the drill string.

As described above with respect to the method 200, some steps of the method 300 may be performed simultaneously or substantially simultaneously. Additionally, operations of the various components of the pipe handling system may be coordinated together to carry out the method steps. In some embodiments, actions of the various components may be coordinated by timing individual steps or operations with respect to one another. Additionally or alternatively, operations of the various components may be coordinated based upon feedback data received from one or more feedback devices, such as a weight sensor, a contact switch, a proximity sensor, and/or other suitable feedback devices.

It is to be appreciated that while the methods 200 and 300 have been described with respect to the pipe handling system 400 of FIGS. 8-14, the method may also be performed with the system 100 of FIGS. 1-7, the system 500 of FIGS. 15 and 17-39, and the system 600 of FIGS. 16 and 40-61. The method may, thus, rely on the use of one or more robots at the drill floor for purposes of handling the bottom ends of the pipe stands. Moreover, the methods described with respect to FIGS. 17-61 for systems 500 and 600, as well as discussion throughout regarding the use of the system 400 may supplement the methods 200 and 300 depending on the robot layout being used.

The devices, systems, and methods described herein provide for automated or partially automated pipe handling operations. The automated and partially automated systems and methods described herein may provide for safer pipe handling operations relative to conventional operations. For example, a pipe handling robot of the present disclosure may perform many operations that may otherwise be performed by a human operator. Derrick hands and other human operators often maneuver upper and lower ends of pipe stands during trip in, trip out, and stand building operations. These operations can be dangerous for human operators, particularly due to the size and weight of drill pipes. The pipe handling robots described herein may thus improve the safety of pipe handling operations.

Additionally, systems and methods described herein may improve the efficiency of pipe handling operations relative to conventional operations. In particular, the state machine operations described above may coordinate the operations of system components in order to reduce or minimize lost time. The synchronization and coordination of system components, as described herein, may greatly improve the efficiency of trip in, trip out, and/or stand building operations. The use of pipe handling robots rather than derrick hands and other human operators may increase efficiency and reduce variability of pipe handling operations.

It is to be appreciated that systems and methods of the present disclosure may be relatively cost effective as compared with other automated or partially automated pipe handling systems. In particular, pipe handling systems of the present disclosure may operate using a lifting system that may be operable independent of one or more pipe handling robots. That is, in some embodiments, the pipe handling robots need not have the loading capacity to lift a drill pipe. Rather, the robots may operate to manipulate a length or stand of drill pipe while the lifting system and/or drill floor carries the load of the drill pipe. Pipe handling robots of the present disclosure may thus be more cost effective than robots of other systems. Moreover, in some embodiments, the lifting system may be or include components of the primary drill line and draw works of the drilling rig, without the need to introduce a secondary lifting device or mechanism. However, in other embodiments, a secondary lifting system, device, or mechanism may be used.

For example, in some embodiments, a lifting system of the present disclosure may include a secondary or auxiliary line or cable extending from a draw works. The auxiliary line may operate in addition to the primary or main drill line to facilitate pipe handling operations. In some embodiments, the lifting system may include a dual activity top drive having the ability to engage with a pipe stand with a first elevator while engaging with the drill string with a second elevator, as described in U.S. Provisional Application No.

62/809,093, entitled Dual Activity Top Drive, and filed Feb. 22, 2019, the content of which is hereby incorporated by reference herein in its entirety. In some embodiments, the lifting system may include a robotic drill floor lifting system, which may be or be similar to systems described in U.S. patent application Ser. No. 16/375,927, entitled System for Handling Tubulars on a Rig, and filed Apr. 5, 2019, the content of which is hereby incorporated by reference herein in its entirety. Additionally or alternatively, the lifting system may include an auxiliary lifting arm extending from the drill floor, mast, racking board, or another suitable location on the drilling rig. The lifting arm may be configured for holding a pipe stand above the drill floor while the pipe stand is manipulated by one or pipe handling robots. The lifting arm may be hydraulically or pneumatically actuated in some embodiments. The lifting arm may have a claw or elevator for coupling to or engaging with the pipe stand. In some embodiments, pipe handling operations of the present disclosure may incorporate a first lifting system for handling drill pipe and a second lifting system for handling drill collar.

In some embodiments, one or more robots of the present disclosure may be or include commercially available or off-the-shelf components. For example, one or more pipe handling robots may be or include any of the following: YASKAWA MH225, KAWASAKI BX200, ABB IRB 6620-205, ABB IRB 6700/6790. Other suitable robots and robot components may be used as well.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A pipe handling system for handling drill pipe on a drill rig, the system comprising:

a lifting system configured for handling a load of a pipe stand;

a boom pivotally supported at a location outside a setback area of a drill floor and extending to a free cantilevered end, the boom configured to swing about a vertical axis and across the drill floor;

a first pipe handling robot mounted on the free cantilevered end of the boom and configured to pivot about a vertical axis relative to the boom and to articulate for manipulating a bottom end of the pipe stand between a setback area on the drill floor and well center;

a second pipe handling robot arranged at or near a racking board of the drill rig and configured for manipulating a top end of the pipe stand between the racking board and well center.

2. The pipe handling system of claim 1, wherein the second pipe handling robot is arranged on a rail system positioned above the setback area, between first and second portions of the racking board when viewed in plan view, and generally aligned with well center.

3. The pipe handling system of claim 2, wherein the second pipe handling robot is configured to articulate along the rail system.

4. The pipe handling system of claim 3, wherein second pipe handling robot is suspended below the racking board.

5. The pipe handling system of claim 1, wherein the boom is configured to swing the first pipe handling robot along an arc to allow the first pipe handling robot to place pipe stands in or retrieve pipe stands from the setback area.

6. The pipe handling system of claim 5, wherein the arc passes across the setback area.

7. A pipe handling system for handling drill pipe on a drill rig, the system comprising:

a lifting system configured for handling a load of a pipe stand;

a pair of first pipe handling robots arranged at or near a drill floor of the drill rig and configured for manipulating a bottom end of the pipe stand between a setback area on the drill floor and well center;

a second pipe handling robot arranged at or near a racking board of the drill rig and configured for manipulating a top end of the pipe stand between the racking board and well center;

wherein, the pair of first pipe handling robots each have a base supported from a location outside a plan view envelope of the setback area of the drill floor and arranged on respective rail systems.

8. The pipe handling system of claim 7, wherein the pair of pipe handling robots are secured to the drill floor at a location generally between the setback area and well center.

9. The pipe handling system of claim 8, wherein the setback area includes a first portion and a second portion and each robot of the pair of pipe handling robots is associated with a respective first portion or second portion.

10. The pipe handling system of claim 9, wherein each robot of the pair of pipe handling robots is configured to handle pipe stands near a front of the first portion or the second portion, which the respective robot is not associated with.

11. The pipe handling system of claim 8, wherein a base of each of the pair of robots is positioned to substantially abut an outboard boundary line extending from an outboard edge of the setback area.

12. The pipe handling system of claim 7, wherein each rail system of the respective rails systems is arranged along a respective outboard edge of the setback area and generally parallel to a line extending through well center and bisecting the setback area.

13. The pipe handling system of claim 12, wherein the pair of pipe handling robots are configured to articulate along their respective rails systems.

14. A system of pipe handling robots on a drill rig, the system comprising:

a boom pivotally supported at a location outside a setback area of a drill floor and extending to a free cantilevered end, the boom configured to swing about a vertical axis and across the drill floor;

a first pipe handling robot mounted on the free cantilevered end of the boom and configured to pivot about a vertical axis relative to the boom and to articulate for manipulating a bottom end of the pipe stand between a setback area on the drill floor and well center, a second pipe handling robot arranged at or near a racking board of the drill rig and configured for manipulating a top end of a pipe stand between the racking board and well center.

* * * * *